US005989773A

United States Patent [19]

Fukui et al.

[11] Patent Number: 5,989,773

[45] **Date of Patent: *Nov. 23, 1999**

[54] DEVELOPMENT PROCESSING METHOD OF SILVER HALIDE PHOTOGRAPHIC MATERIAL AND IMAGE FORMING METHOD

[75] Inventors: Kouta Fukui; Minoru Sakai; Kazunobu Katoh, all of Kanagawa, Japan

[73] Assignee: Fuji Photo Film Co., Ltd, Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,777

[22] Filed: Mar. 31, 1997

Related U.S. Application Data

[63] Continuation of application No. 08/434,856, May 4, 1995.

[30] Foreign Application Priority Data

May 9, 1994 [JP] Japan ..... 6-117400
Aug. 19, 1994 [JP] Japan ..... 6-216703

[51] Int. Cl.[6] ..... G03C 5/29

[52] U.S. Cl. ..... 430/264; 430/440; 430/446

[58] Field of Search ..... 430/264, 265, 430/435, 436, 440, 446, 478, 483

[56] References Cited

U.S. PATENT DOCUMENTS

| | | | |
|---|---|---|---|
| 2,688,549 | 9/1954 | James et al. | 430/483 |
| 3,730,727 | 5/1973 | Olivares et al. | 430/483 |
| 4,929,535 | 5/1990 | Takahashi et al. | 430/264 |
| 4,965,169 | 10/1990 | Hirano et al. | 430/264 |
| 4,975,354 | 12/1990 | Machonkin et al. | 430/264 |
| 4,988,604 | 1/1991 | Machonkin et al. | 430/264 |
| 5,098,819 | 3/1992 | Knapp | 430/436 |
| 5,196,298 | 3/1993 | Meeus et al. | 430/440 |
| 5,236,816 | 8/1993 | Purol et al. | 430/492 |
| 5,480,886 | 1/1996 | Yamazaki et al. | 430/264 |

FOREIGN PATENT DOCUMENTS

| | | |
|---|---|---|
| 0191035 | 10/1984 | Japan . |
| 0011456 | 6/1993 | WIPO . |

*Primary Examiner*—Hoa Van Le
*Attorney, Agent, or Firm*—Sughrue, Mion, Zinn, Macpeak & Seas, PLLC

[57] ABSTRACT

A developing processing method and an image forming method are described, which comprise the steps of (a) exposing a silver halide photographic material comprising a support having thereon at least one light-sensitive silver halide emulsion layer; and (b) developing the exposed silver halide photographic material with a developer containing a developing agent, containing substantially no dihydroxybenzene developing agent, containing an auxiliary developing agent exhibiting a superadditive property, containing a quaternary onium salt compound, and having a pH value of from 9.5 to 11.5, or a developer containing a developing agent, containing substantially no dihydroxybenzene developing agent, and having a pH value of from 10 or less.

7 Claims, 1 Drawing Sheet

DEVELOPMENT PROCESSING METHOD OF SILVER HALIDE PHOTOGRAPHIC MATERIAL AND IMAGE FORMING METHOD

This is a Continuation of application Ser. No. 08/434,856 filed May 4, 1995.

FIELD OF THE INVENTION

The present invention relates to a process for forming a super high contrast image using a silver halide photographic material. More specifically, the present invention relates to a process for developing a super high contrast image with a stable developer containing no dihydroxybenzene developing agent and a process for forming an image.

BACKGROUND OF THE INVENTION

In the field of graphic arts, a system for forming an image having a photographic characteristic of super high contrast (especially γ of 10 or more) is required for enabling reproduction of a continuous resolution image through a half-tone image or reproduction of a line original image.

As a process for obtaining photographic characteristics of high contrast image, a lith developing method utilizing what is called an "infectious developing effect" has been used for a long time, but it has the disadvantage that the developer is unstable and, thus, it is difficult to be used.

On the other hand, processes for obtaining a high contrast image utilizing a more stable developer are disclosed in, for example, U.S. Pat. Nos. 4,224,401, 4,168,977, 4,166,742, 4,311,781, 4,272,606, 4,221,857, 4,332,878, 4,634,661, 4,618,574, 4,269,922, 5,650,746, and 4,681,836.

These image forming systems are those in which a surface latent image type silver halide photographic material to which a hydrazine derivative is added is processed with a stable MQ developer (a developer containing hydroquinone and p-aminophenols in combination) or PQ developer (a developer containing hydroquinone and 1-phenyl-3-pyrazolidones in combination) having a pH value of from 11 to 12.3 to obtain a super high contrast negative image having a γ value exceeding 10. According to these processes, because photographic characteristics of super high contrast and high sensitivity are obtained and a sulfite is allowed to be added to a developer in a high concentration, the stability of the developer to air oxidation is markedly improved in comparison with the conventional lith developer.

With regard to a photographic material for light room developing, which is used in assembly processes and dot-to-dot working operations, for example, in the case where the superimposition dot-to-dot working operation between a half-tone dot text and line original text is attempted to be carried out faithfully to the texts, a process for forming an image having super high contrast is required. For this purpose, the above-mentioned image forming systems using a hydrazine derivative is effective, and the typical application examples are disclosed in JP-A-62-640 (the term "JP-A" used herein means an "unexamined published Japanese patent application"), JP-A- 62-235938, JP-A-62-235939, JP-A-63-104046, JP-A-63-103235, JP-A-63-296031, JP-A-63-314541, and JP-A-64-13545.

U.S. Pat. Nos. 4,998,604 and 4,994,365 disclose a hydrazine compound having ethylene oxide repeating units and a hydrazine compound having a pyridinium group. However, as is clear from examples described therein, high contrast is not yet sufficient, and it is difficult to obtain a high contrast and a necessary $D_{max}$ value under the practical developing conditions.

Moreover, in the high contrast systems using a hydrazine compound, there is a high tendency of bringing about the phenomenon of enlargement of the image, causing the problem that the reproduced half-tone image area becomes narrow.

On the other hand, it has been known that endiols such as ascorbic acid function as the main developing agent, and they become the focus of attention as the main developing agent having no problem in terms of ecology and toxicology. For example, U.S. Pat. Nos. 2,688,549 and 3,826,654 disclose that an image can be formed under a strong alkaline condition of a pH value of 12 or more. However, no high contrast image can be obtained in these image forming processes.

Several attempts have been made to increase the contrast in the developing system using ascorbic acid. For example, Zwicky discloses that in the case of using ascorbic acid as a sole main developing agent, a type of lith effect is expressed (*J. Phot. Sc.* Vol. 27, p. 185 (1979)), but the system using ascorbic acid has a low contrast in comparison with a hydroquinone-containing system. U.S. Pat. No. 1,896,022 and JP-B-49-46939 (the term "JP-B" used herein means an "examined Japanese patent publication") disclose a system using a bis-quaternary ammonium salt and ascorbic acid in combination, but even though the system has a developing acceleration effect, it has little effect for increasing contrast. JP-A-3-249756 and JP-A-4-32838 also describe the combination effect of use of ascorbic acid and a quaternary salt, but the resultant image has insufficient contrast. Furthermore, according to JP-A-5-88306, a high contrast can be obtained by using ascorbic acid as a sole main developing agent and keeping the pH value at 12.0 or more, but this system has a problem in terms of stability of the developer.

U.S. Pat. No. 3,730,727 discloses an example where a special developer comprising ascorbic acid and a hydrazine derivative as main ingredients can be used to obtain a developed system having a high sensitivity and low stain and fogging, but does not disclose enhancement of contrast.

It has been known that a photographic material containing hydrazine is processed with an ascorbic acid developer, and it is disclosed in, for example, U.S. Pat. No. 5,236,816, and WO 93/11456. In each case, sufficient contrast cannot be obtained. In the case of WO 93/11456, although high contrast is obtained by incorporating an amine compound into a developer, it is not preferable in terms of environment. It is, therefore, desired to develop a developing process which gives a high contrast image using ascorbic acid, which is preferred in terms of toxicology, as a main developing agent.

As described above, the system for forming a super high contrast image using a hydrazine derivative is a system using a dihydroxybenzene compound such as hydroquinone, and has several drawbacks from the ecological and toxicological viewpoints. For example, hydroquinone, which has the effect of bringing about an allergy, is an undesirable component, and 1-phenyl-3-pyrazolidones has poor biodegradability. Moreover, a highly concentrated sulfite has a high COD (chemical oxide demand). Furthermore, amines as described in U.S. Pat. No. 4,975,354 are usually used in such an image forming system, but it is not preferable in terms of toxicity and volatility.

SUMMARY OF THE INVENTION

An object of the present invention is, therefore, to provide a novel developing process, which can give a high contrast image having less image enlargement required in the field of graphic art, using a very stable developer which is not problematic for the ecological system or the working environment and which ages less along with time elapse.

This and other objects of the present invention have been attained by a development processing method, which comprises the steps of (a) exposing a silver halide photographic material comprising a support having thereon at least one light-sensitive silver halide emulsion layer, wherein at least one layer of the light-sensitive silver halide emulsion layer and a hydrophilic colloid layer contains at least one hydrazine derivative represented by the following formula (I) and at least one compound selected from compounds represented by the following formula (II), (III), (IV) or (V) and an amine compound acting as an incorporated nucleating accelerator; and (b) developing the exposed silver halide photographic material with a developer containing a developing agent represented by formula (VI), containing substantially no dihydroxybenzene developing agent, containing an auxiliary developing agent exhibiting a superadditive property, containing a quaternary onium salt compound, and having a pH value of from 9.5 to 11.5:

(I)

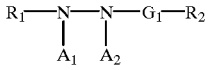

wherein $R_1$ represents an aliphatic group or an aromatic group; $R_2$ represents a hydrogen atom, an alkyl group, an aryl group, an unsaturated heterocyclic group, an alkoxy group, an aryloxy group, an amino group, a hydrazino group, a carbamoyl group or an oxycarbonyl group, which each may be substituted; $G_1$ represents —CO—, —$SO_2$—, —SO—, —PO($R_3$)—, —CO—CO—, a thiocarbonyl group or an iminomethylene group; $A_1$ and $A_2$ are both a hydrogen atom, or one of them is a hydrogen atom and the other is a substituted or unsubstituted alkylsulfonyl group, a substituted or unsubstituted arylsulfonyl group or a substituted or unsubstituted acyl group; $R_3$ has the same meaning as $R_2$, but it may be different from $R_2$;

(II)

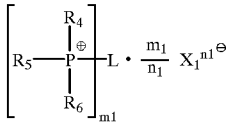

wherein $R_4$, $R_5$ and $R_6$ each independently represents an alkyl group, a cycloalkyl group, an aryl group, an alkenyl group, a cycloalkenyl group or a heterocyclic group, which each may be substituted; $m_1$ represents an integer of from 1 to 4; L represents an $m_1$-valent organic group which bonds to the P atom in formula (II) via its carbon atom; $n_1$ represents an integer of from 1 to 3; and $X_1$ represents an $n_1$-valent anion and $X_1$ may be connected to L;

(III)

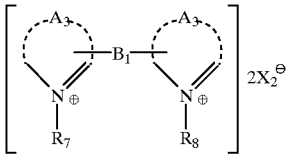

(IV)

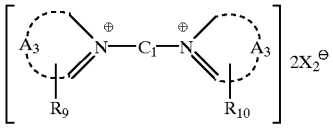

wherein $A_3$ represents an organic group necessary for forming a heterocyclic ring; $B_1$ and $C_1$ each independently represents a divalent group; $R_7$ and $R_8$ each independently represents an alkyl group or an aryl group, which each may be substituted; $R_9$ and $R_{10}$ each independently represents a hydrogen atom or a substituent; and $X_2$ represents an anion, with the proviso that, if an intermolecular salt is formed, $X_2$ does not exist;

(V)

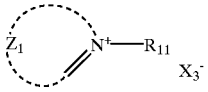

wherein $Z_1$ represents an atomic group necessary for forming a nitrogen-containing heteroaromatic ring; $R_{11}$ represents an alkyl group; and $X_3^-$ represents a counter anion;

(VI)

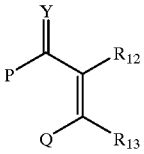

wherein $R_{12}$ and $R_{13}$ each independently represents a hydroxyl group, an amino group, an acylamino group, an alkylsulfonylamino group, an arylsulfonylamino group, an alkoxycarbonylamino group, an alkoxysulfonylamino group, a mercapto group or an alkylthio group; P and Q each independently represents a hydroxyl group, a carboxyl group, an alkoxy group, a hydroxyalkyl group, a carboxyalkyl group, a sulfo group, a sulfoalkyl group, an amino group, an aminoalkyl group, an alkyl group, an aryl group or a mercapto group, or P and Q may be bonded with each other to represent an atomic group necessary for forming a 5- to 7-membered ring together with the two vinyl carbon atoms substituted by $R_{12}$ and $R_{13}$ and the carbon atom substituted by Y; and Y represents =O or =N—$R_{14}$, in which $R_{14}$ represents a hydrogen atom, a hydroxyl group, an alkyl group, an acyl group, a hydroxyalkyl group, a sulfoalkyl group or a carboxyalkyl group.

Preferably, the above-described developer contains a salt of carbonic acid in an amount of 0.5 mol/l or more, and contains a 1-phenyl-3-pryrazolidone compound and/or a p-aminophenol compound as the auxiliary developing agent exhibiting a superadditive property.

Furthermore, this and other objects of the present invention have been attained by an image forming method, which comprises the steps of (a) exposing a silver halide photographic material comprising a support having thereon at least one light-sensitive silver halide emulsion layer, wherein at least one layer of the light-sensitive silver halide emulsion layer and a hydrophilic colloid layer contains at least one hydrazine derivative represented by the above-described formula (I) and at least one compound represented by the following formula (N-1); and (b) developing the exposed silver halide photographic material with a developer containing a developing agent represented by the above-described formula (VI), containing substantially no dihydroxybenzene developing agent, and having a pH value of from 10 or less:

(N-1)

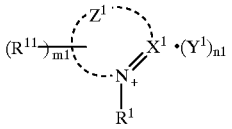

wherein $Z^1$ represents a nonmetal atomic group necessary for forming a 6-membered nitrogen containing-aromatic heterocyclic ring together with N and $X^1$; $X^1$ represents N or $CR^{12}$, in which $R^{12}$ has the same meaning as $R^{11}$; $R^1$ represents an alkyl group, an alkenyl group, an alkynyl group, an aryl group or a heterocyclic group; $R^{11}$ represents a hydrogen atom, a halogen atom or a substituent which is bonded to a heterocyclic ring via a carbon atom, an oxygen atom, a nitrogen atom or a sulfur atom; $m^1$ represents 0 or an integer of not more than the maximum possible substituting number, with the proviso that, when $m^1$ is 2 or more, the plurality of $R^{11}$ groups may be the same or different and may be bonded with each other to form a ring; $Y^1$ represents a counter ion for balance of the electric charge; $n^1$ represents a number necessary for the electric charge balance; and two radicals in which a hydrogen atom is removed from formula (N-1) are bonded to form a bis structure.

Figure 1A:
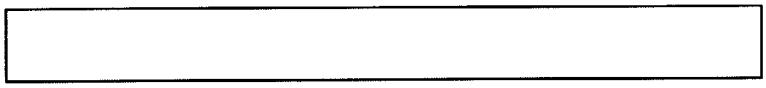
FIG. 1 shows a construction during exposing in the case of forming an enlarged letter image by a superimposition dot-to-dot working; in which symbols have the following meanings.

(a) a transparent or translucent pasting base;

(b) a line original text (the black portion is a line art);

(c) a transparent or translucent pasting base;

(d) a half tone text (the black portion is dots); and (e) a photographic material for dot-to-dot working (the shaded portion is a light-sensitive layer).

DETAILED DESCRIPTION OF THE INVENTION

The compound represented by formula (I) will now be described in detail.

In formula (I), the aliphatic group represented by $R_1$ is preferably an aliphatic group having from 1 to 30 carbon atoms, more preferably a straight-chain, branched or cyclic alkyl group having from 1 to 20 carbon atoms. The branched alkyl group may be cyclized to form a saturated heterocyclic ring containing one or more hetero atoms in the alkyl group. The alkyl group may be substituted with one or more substituent.

The aromatic group represented by $R_1$ in formula (I) includes a monocyclic or dicyclic aryl or unsaturated heterocyclic group. The unsaturated heterocyclic group represented by $R_1$ may form a heteroaryl group by fusing a monocyclic or dicyclic aryl group. Examples of the ring formed by $R_1$ include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. Among these, preferred is a benzene ring.

$R_1$ is more preferably an aryl group.

The aliphatic or aromatic group represented by $R_1$ may be substituted with one or more substituents. Examples of the substituents include an alkyl group, an alkenyl group, an alkynyl group, an aryl group, a heterocyclic group, a pyridinium group, a hydroxyl group, an alkoxy group, an aryloxy group, an acyloxy group, an alkylsulfonyloxy group, an arylsulfonyloxy group, an amino group, a carbonamido group, a sulfonamido group, a ureido group, a thioureido group, a semicarbazido group, a thiosemicarbazido group, a urethane group, a group having a hydrazide structure, a group having a quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphonamido group, a diacylamino group, an imido group, a group having an acylurea structure, a group containing a selenium atom or a tellurium atom, and a group having a tertiary sulfonium structure or a quaternary sulfonium structure. Of these, preferred are a strain-chain, branched or cyclic alkyl group (preferably one having from 1 to 20 carbon atoms), an aralkyl group (preferably monocyclic or dicyclic one containing an alkyl moiety having from 1 to 3 carbon atoms), an alkoxy group (preferably one having from 1 to 20 carbon atoms), a substituted amino group (preferably an amino group substituted with at least one alkyl group having from 1 to 20 carbon atoms), an acylamino group (preferably one having from 2 to 30 carbon atoms), a sulfonamido group (preferably one having from 1 to 30 carbon atoms), a ureido group (preferably one having from 1 to 30 carbon atoms) and a phosphonamido group (preferably one having from 1 to 30 carbon atoms).

In formula (I), the alkyl group represented by $R_2$ is preferably an alkyl group having from 1 to 4 carbon atoms, and the aryl group represented by $R_2$ is preferably a monocyclic or dicyclic aryl group such as an aryl group containing a benzene ring.

The unsaturated heterocyclic group represented by $R_2$ is preferably a 5- or 6-membered ring containing at least one nitrogen, oxygen or sulfur atom. Examples thereof include an imidazolyl group, a pyrazolyl group, a triazolyl group, a tetrazolyl group, a pyridyl group, a pyridinium group, a quinolinium group and a quinolinyl group. Among these, more preferred are a pyridyl group and a pyridinium group.

The alkoxy group represented by $R_2$ is preferably an alkoxy group having from 1 to 8 carbon atoms. The aryloxy group represented by $R_2$ is preferably a monocyclic aryloxy group. The amino group represented by $R_2$ is preferably an unsubstituted amino group or an alkylamino or arylamino group having from 1 to 10 carbon atoms.

$R_2$ may be substituted by one or more substituents, and examples of the substituents include those recited above with respect to $R_1$.

When $G_1$ represents —CO—, $R_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl) or an aryl group (e.g., phenyl, 3,5-dichlorophenyl, o-methanesulfonamidophenyl, 4-methanesulfonylphenyl, 2-hydroxymethylphenyl), and more preferably a hydrogen atom or a trifluoromethyl group.

When $G_1$ represents —$SO_2$—, $R_2$ is preferably an alkyl group (e.g., methyl), an aralkyl group (e.g., o-hydroxybenzyl), an aryl group (e.g., phenyl) or a substituted amino group (e.g., dimethylamino).

When $G_1$ represents —CO—CO—, $R_2$ is preferably an alkoxy group, an aryloxy group or an amino group.

In formula (I), $G_1$ is preferably —CO— or —CO—CO—, and more preferably —CO—.

Further, $R_2$ may be a group such that it can split the $G_1$—$R_2$ moiety off the residual molecule and thereby cause the cyclization reaction to form a cyclic structure containing the atoms of the $G_1$—$R_2$ moiety. Specific examples of such a group include those disclosed in JP-A-63-29751.

$A_1$ and $A_2$ is each preferably a hydrogen atom, an alkylsulfonyl or arylsulfonyl group having from 1 to 20 carbon atoms (more preferably, a phenylsulfonyl group or a phenylsulfonyl group substituted by substituent(s) having Hammett's reaction constant of −0.5 or more, such as a p-methylphenylsulfonyl group, a pentafluorophenylsulfonyl group, a p-ethoxycarbonylphenylsulfonyl group, a m-methoxyphenylsulfonyl group and a p-cyanophenylsulfonyl group) or an acyl group having from 1 to 20 carbon atoms (more preferably, a benzoyl group, a benzoyl group substituted by substituent(s) having Hammett's reaction constant of −0.5 or more, such as a p-methylbenzoyl group, a pentafluorobenzoyl group, a p-ethoxycarbonylbenzoyl group, a m-methoxybenzoyl group and a p-cyanobenzoyl group, or a straight-chain, branched or cyclic acyl group, which may be substituted by substituent(s) such as a halogen atom, an ether group, a sulfonamido group, a carbonamido group, a hydroxyl group, a carboxyl group or a sulfonic acid group), and more preferably a hydrogen atom.

The substituents of $R_1$ and $R_2$ may be further substituted by one or more substituents, and examples of the substituents include those recited above with respect to $R_1$. The substituted substituents may be further substituted by a substituent, a substituted substituent, a ((substituted substituent)-substituted substituent, and so on, and the examples of the substituents also include those recited above with respect to $R_1$.

Moreover, $R_1$ or $R_2$ in formula (I) may be a group into which a ballast group used commonly in immobile photographic additives, such as couplers, or a polymer is introduced. The ballast group is a group containing 8 or more carbon atoms and having a relatively slight influence upon photographic properties, and examples thereof include an alkyl group, an aralkyl group, an alkoxy group, a phenyl group, an alkylphenyl group, a phenoxy group, and an alkylphenoxy group. Examples of the polymer include those described in JP-A-1-100530.

Furthermore, $R_1$ or $R_2$ in formula (I) may be a group into which a group capable of intensifying the adsorption onto the grain surface of silver halide is introduced. Examples of the adsorption-intensifying group include an alkylthio group, an arylthio group, a thiourea group, a heterocyclic thioamido group, a mercapto heterocyclic group and a triazole group, such as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

The particularly preferred hydrazine derivative in the present invention is a hydrazine derivative represented by formula (I), wherein $R_1$ is a group capable of accelerating the adsorption onto a ballast group or a surface of silver halide grains or a phenyl group, a group having a quaternary ammonium structure or an alkylthio group; $G_1$ is —CO—; $R_2$ is a hydrogen atom or a substituted alkyl or substituted aryl group (the substituent thereof is preferably an electron attracting group or a hydroxymethyl group to the 2-position thereof). All the combinations of the above-described $R_1$ and $R_2$ can be selected and are preferred.

Specific examples of the compound represented by formula (I) are illustrated below. However, the invention should not be construed as being limited to these examples.

I-1

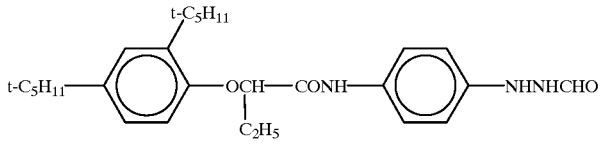

I-2

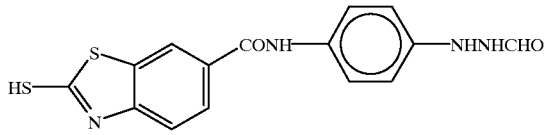

I-3

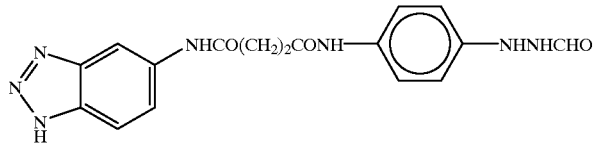

-continued
I-4
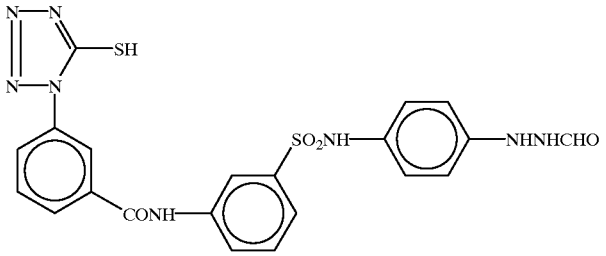
I-5
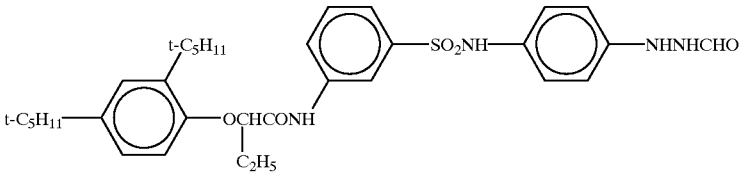
I-6
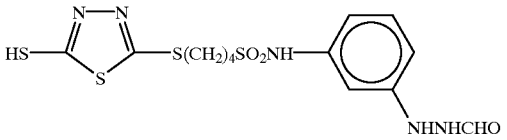
I-7
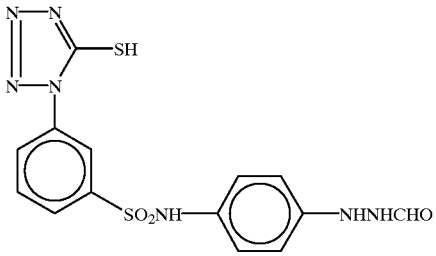
I-8
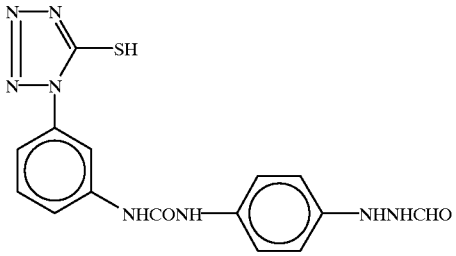
I-9
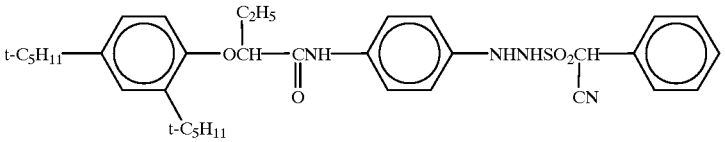
I-10
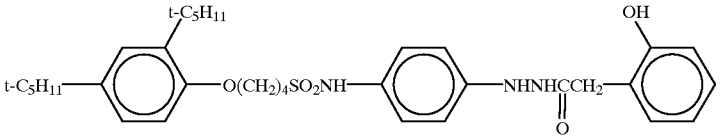
I-11
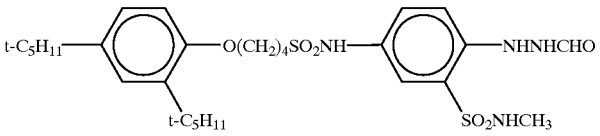

-continued
I-12
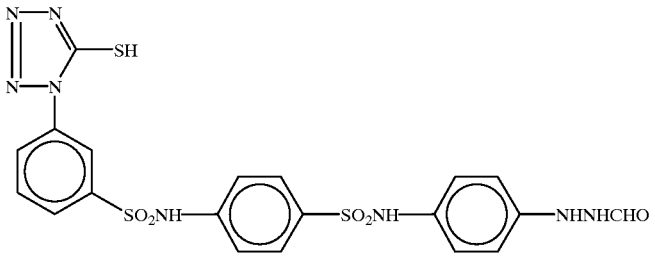
I-13
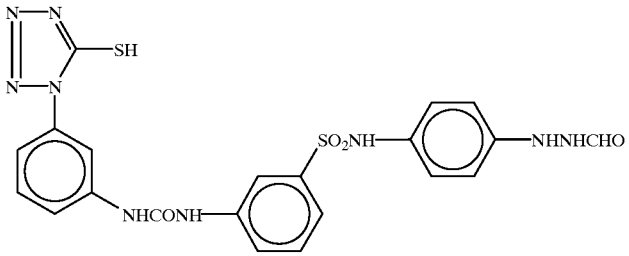
I-14
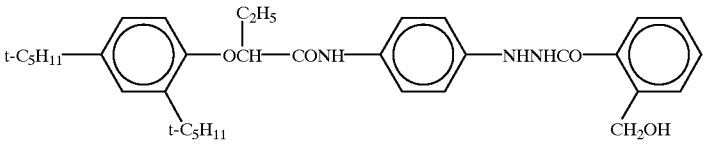
I-15
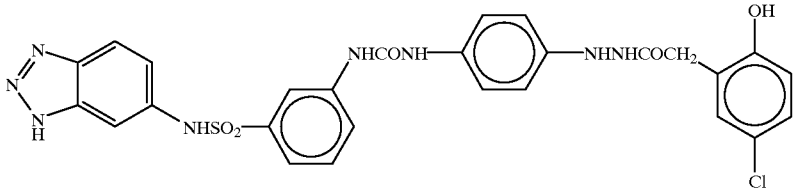
I-16
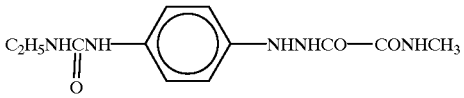
I-17
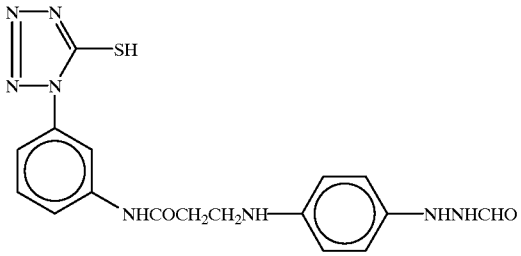
I-18
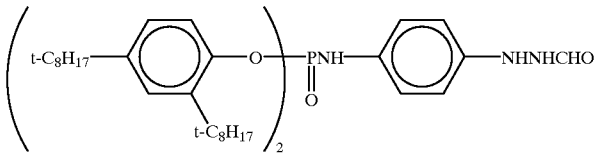

-continued
I-19
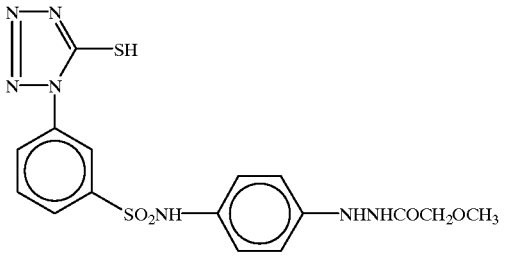
I-20
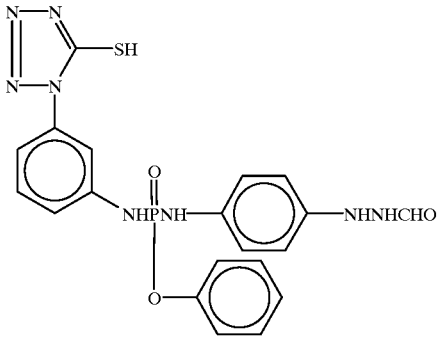
I-21
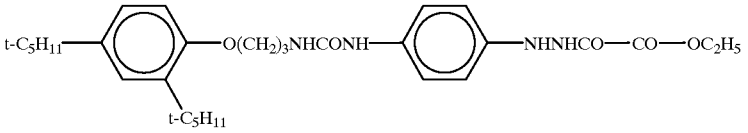
I-22
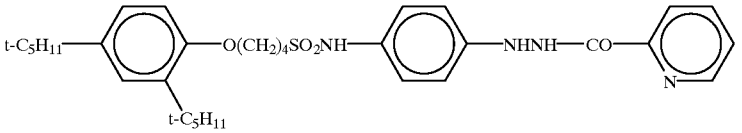
I-23
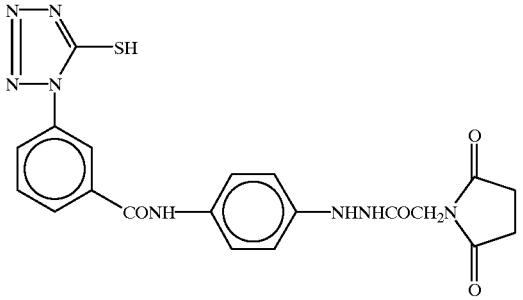
I-24
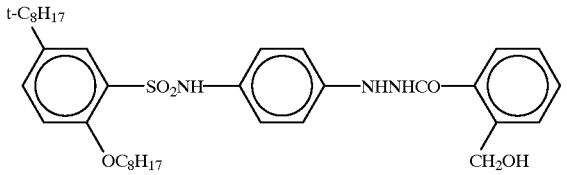

-continued
I-25
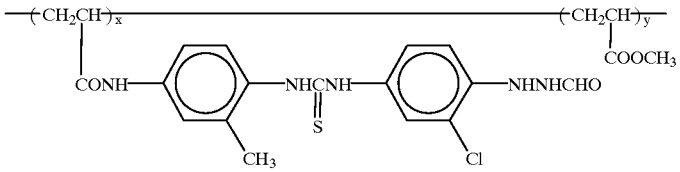
*x*:*y* = 3:97
Average Molecular
Weight = 100,000
I-26
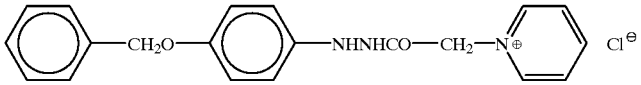
I-27
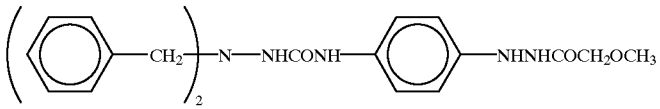
I-28
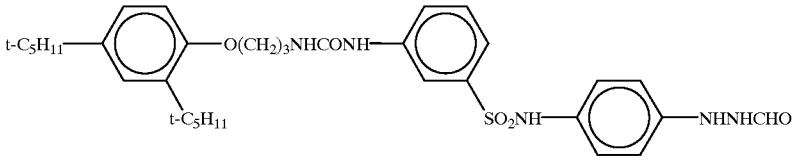
I-29
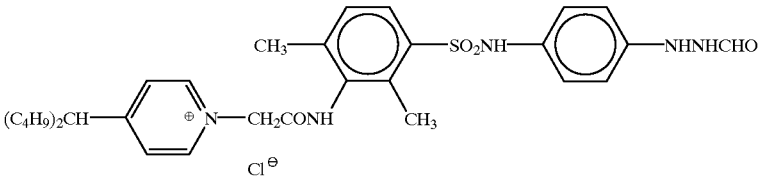
I-30
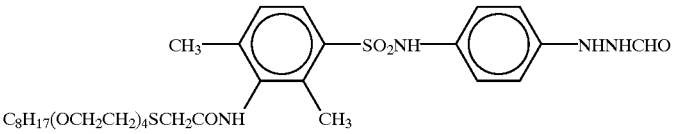
I-31
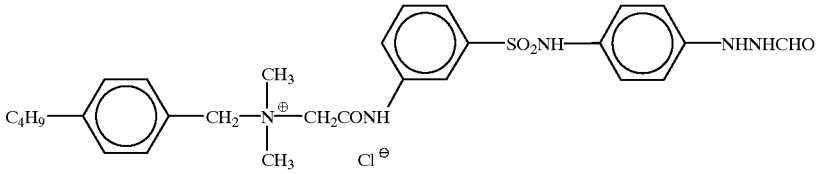
I-32
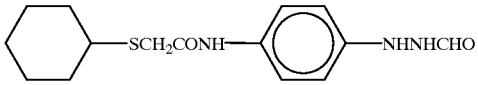
I-33
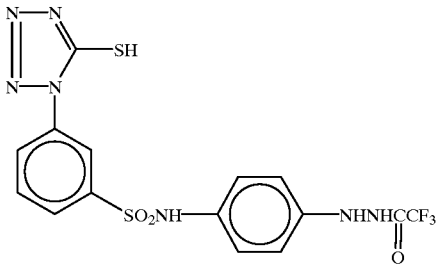

-continued
I-34
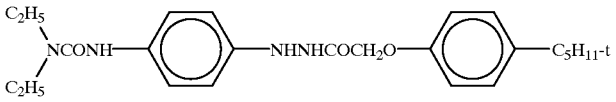
I-35
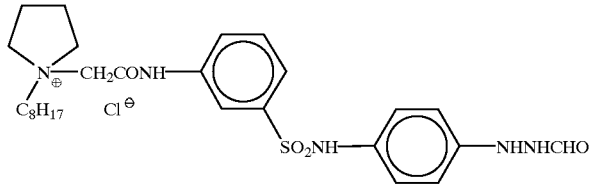
I-36
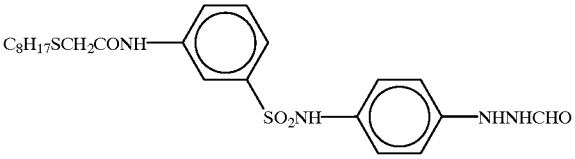
I-37
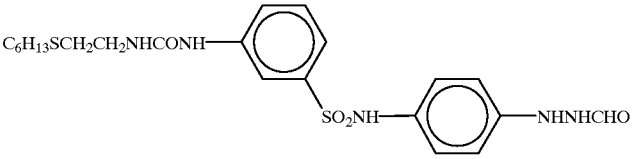
I-38
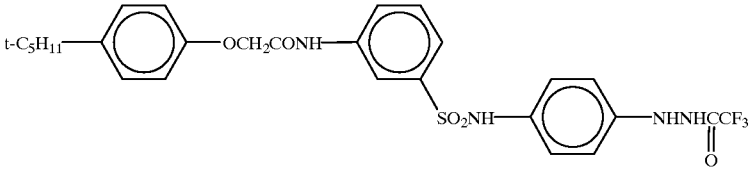
I-39
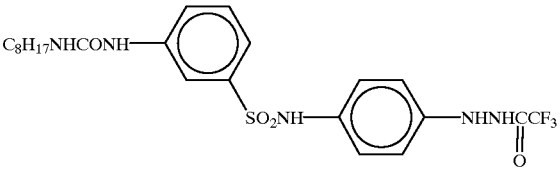
I-40
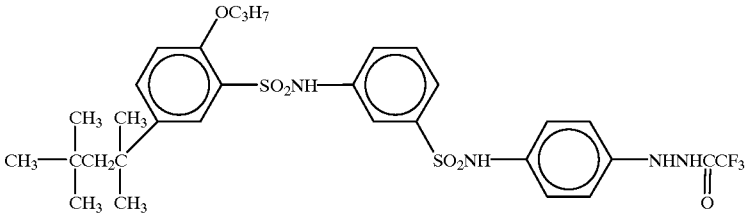
I-41
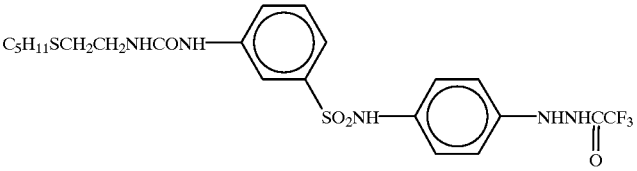

-continued
I-42
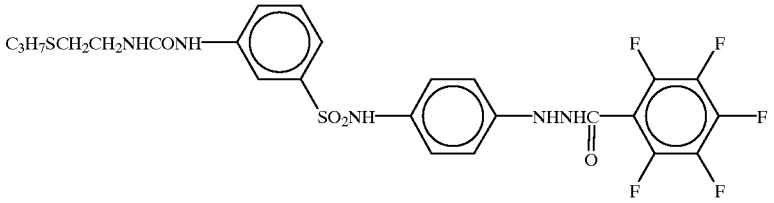
I-43
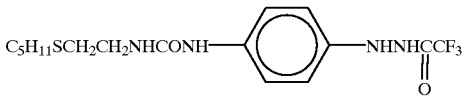
I-44
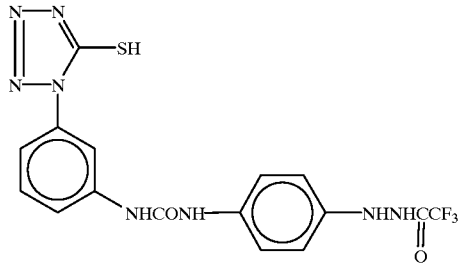
I-45
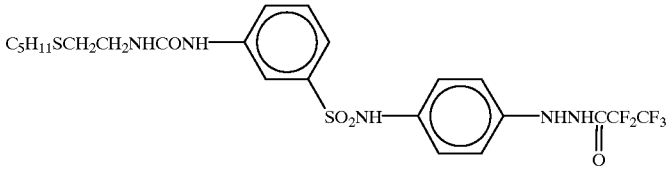
I-46
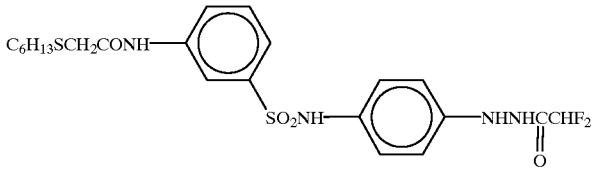
I-47
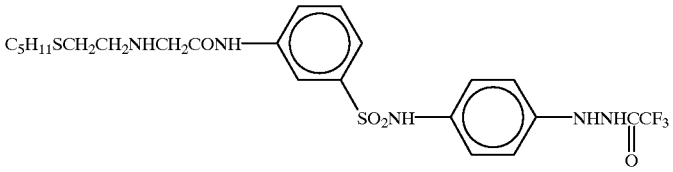
I-48
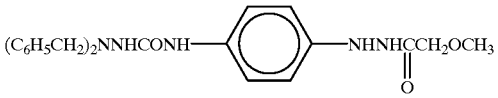
I-49
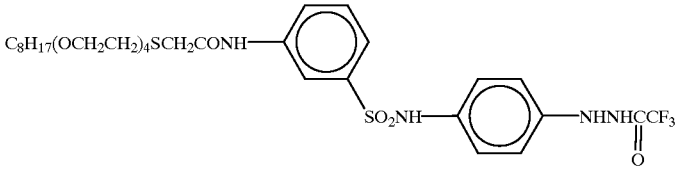

-continued

I-50

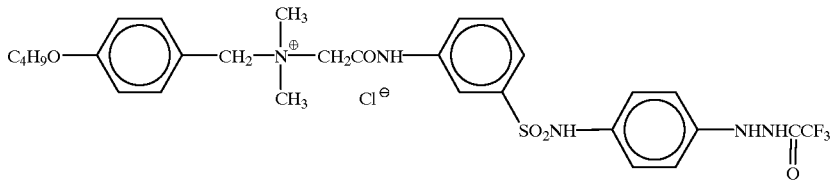

I-51

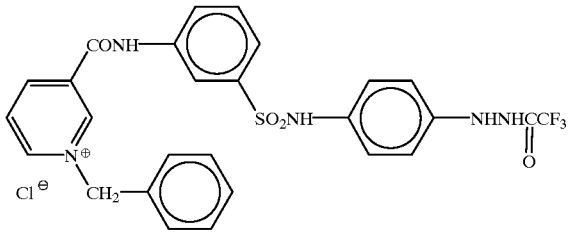

I-52

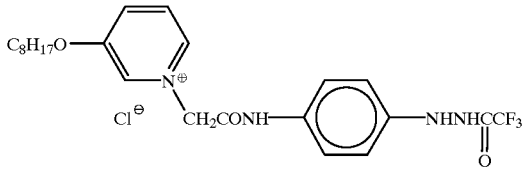

I-53

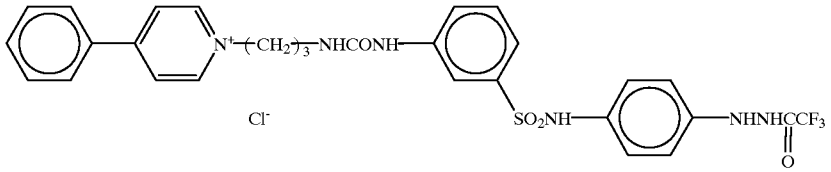

In addition to the above-illustrated ones, hydrazine derivatives which can be used in the present invention include those disclosed in *Research Disclosure,* Item 23516, page 346 (November, 1983), the references cited in ibid., U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent No. 2,011,391B, European Patent Nos. 217, 310, 301,799 and 356,898, JP-A-60-179734, JP-A-61-170733, JP-A-61-270744, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764 and JP-A-5-45765, and JP-A-6-289542.

The hydrazine derivative for use in the present invention is preferably added in an amount of from $1\times10^{-6}$ to $5\times10^{-2}$ mol, more preferably from $1\times10^{-5}$ to $2\times10^{-2}$ mol, per mol of silver halide.

In using the hydrazine derivative in the present invention, it may be dissolved in a proper water-miscible organic solvent, such as alcohol (e.g., methanol, ethanol, propanol, fluorinated alcohol), ketone (e.g., acetone, methyl ethyl ketone), dimethylformamide, dimethylsulfoxide and methyl cellosolve.

Furthermore, the hydrazine derivative can be used in the form of emulsified dispersion, which is prepared using the well-known emulsion dispersion method in which the hydrazine derivative is dissolved using an oil such as dibutyl phthalate, tricresyl phosphate, glyceryl triacetate and diethyl phthalate, together with an auxiliary solvent, such as ethyl acetate and cyclohexanone, and then dispersed mechanically in an emulsified condition. On the other hand, the so-called solid dispersion method can be adopted in using the hydrazine derivative, wherein the powdered hydrazine derivative is dispersed into water by means of a ball mill, a colloid mill or ultrasonic waves.

The hydrazine derivative may be contained in fine polymer particles as described in JP-A-2-948.

The compound represented by formula (II) will now be described in detail.

$R_4$, $R_5$ and $R_6$ are the same or different and each represents an alkyl group, a cycloalkyl group, an aryl group, an alkenyl group, a cycloalkenyl group or a heterocyclic group, which each may be substituted by one or more substituents.

$m_1$ represents an integer of from 1 to 4; L represents an $m_1$-valent organic group which bonds to the P atom in formula (II) via its carbon atom; $n_1$ represents an integer of from 1 to 3; and $X_1$ represents an $n_1$-valent anion and may be connected to L.

Examples of the groups represented by $R_4$, $R_5$ and $R_6$ include a straight-chain or branched alkyl group (e.g., methyl, ethyl, propyl, isopropyl, butyl, isobutyl, sec-butyl, tert-butyl, octyl, 2-ethylhexyl, dodecyl, hexadecyl, octadecyl), an aralkyl group (e.g., substituted or unsubstituted benzyl), a cycloalkyl group (e.g., cyclopropyl, cyclopentyl, cyclohexyl), an aryl group (e.g., phenyl, naphthyl, phenantollyl), an alkenyl group (e.g., allyl, vinyl, 5-hexenyl), a cycloalkenyl group (e.g., cyclopentenyl, cyclohexenyl), and a heterocyclic group (e.g., pyridyl, quinolyl, furyl, imidazolyl, thiazolyl, thiadiazolyl, benzotriazolyl, benzothiazolyl, morpholyl, pyrimidyl, pyrrolidnyl). These substituents may be further substituted by one or more substituents, and examples thereof include, in addition to the groups represented by $R_4$, $R_5$ and $R_6$, a halogen atom (e.g., fluorine, chlorine, bromine, iodine), a nitro group, a primary, secondary or tertiary amino group, an alkylether group, an arylether group, an alkylthioether group, an arylthioether group, a carbonamido group, a carboxyl group, a sulfonamido group, a sulfamoyl group, a hydroxyl group, a sulfoxy group, a sulfonyl group, a carboxyl group, a sulfonic acid group, a cyano group or a carbonyl group. Examples of the group represented by L include, in addition to the groups having the same meaning as the groups of $R_4$, $R_5$ and $R_6$, a polymethylene group (e.g., trimethylene, tetramethylene, hexamethylene, pentamethylene, octamethylene, dodecamethylene), a divalent aromatic group (e.g., phenylene, biphenylene, naphtylene), a polyvalent aliphatic group (e.g., trimethylenemethyl, tetramethylenemethyl), and a polyvalent aromatic group (e.g., phenylene-1,3,5-toluyl, phenylene-1,2,4,5-tetrayl).

Examples of the anion represented by $X_1$ include a halogen ion (e.g., chlorine ion, bromine ion, iodine ion), a carboxylate ion (e.g., acetate ion, oxalate ion, fumarate ion, benzoate ion), a sulfonate ion (e.g., p-toluene sulfonate ion, methane sulfonate ion, butane sulfonate ion, benzene sulfonate ion), a sulfuric acid ion, a perchloric acid ion, a carboxylic acid ion, and a nitric acid ion.

In formula (II), $R_4$, $R_5$ and $R_6$ are each preferably a group having from 1 to 20 carbon atoms, and particularly preferably an aryl group having from 6 to 15 carbon atoms. $m_1$ is preferably 1 or 2, and when $m_1$ is 1, L is preferably a group having from 1 to 20 carbon atoms, and particularly preferably an alkyl or aryl group having from 1 to 15 total carbon atoms. When $m_1$ is 2, the divalent organic group represented by L is preferably an alkylene group, an arylene group, or a divalent group formed by bonding these groups, as well as a divalent group formed by bonding these groups in combination with a group such as —CO—, —O—, —$NR_{15}$— (wherein $R_{15}$ represents a hydrogen atom, or a group having the same meaning as in $R_4$, $R_5$ and $R_6$, when $R_{15}$ groups exist plurally, they may be the same or different from each other), —S—, —SO—, and —$SO_2$—. When $m_1$ is 2, L is particularly preferably a divalent group having from 1 to 20 total carbon atoms which bonds to the P atom. When $m_1$ is an integer of 2 or more, there exist plurality of $R_4$, $R_5$ and $R_6$ in the molecule, in which case, they may be the same or different from each other.

$n_1$ is preferably 1 or 2, and $m_1$ is preferably 1 or 2. $X_1$ may be bonded to L to form an intermolecular salt.

Many of the compounds represented by formula (II) are known, and some of them are commercially available. The general processes for production include a process in which a phosphinic acid is reacted with an alkylating agent such as an alkyl halide or a sulfonic ester; or a pair anion of phosphonium salt is ion-exchanged according to a usual process.

Typical examples of the compounds represented by formula (II) are described below, but the present invention should not be restricted thereto:

A-1

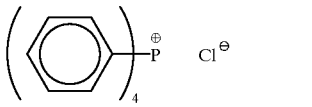

A-2

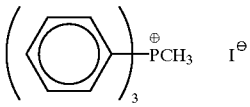

A-3

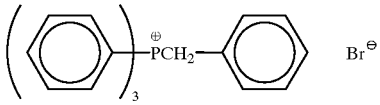

A-4

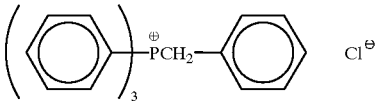

A-5

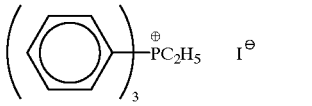

A-6

A-7

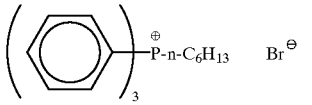

A-8

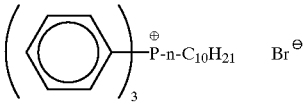

A-9

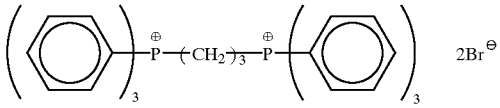

A-10

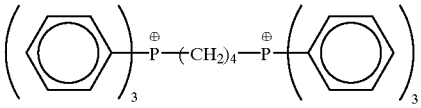

-continued
A-11
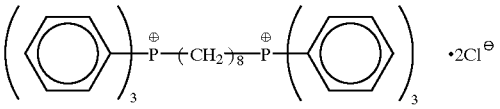
A-12
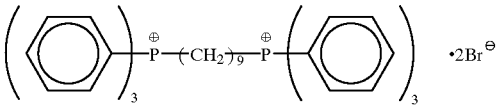
A-13
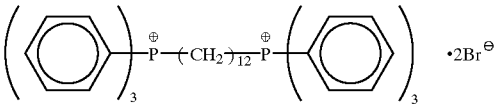
A-14
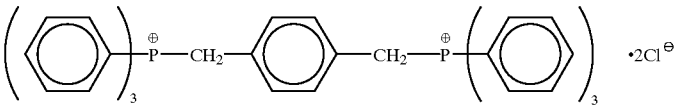
A-15
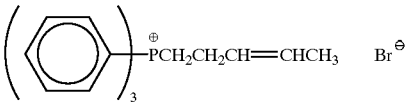
A-16
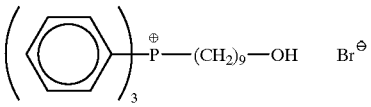
A-17
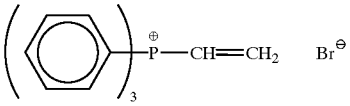
A-18
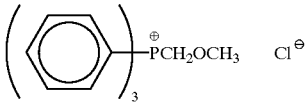
A-19
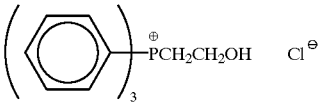
A-20
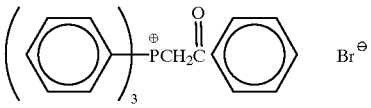
A-21
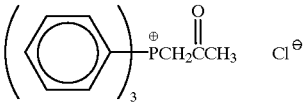
A-22
A-23
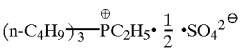
A-24
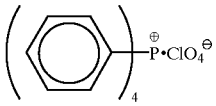
A-25
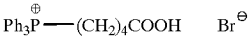
A-26
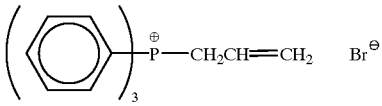
A-27
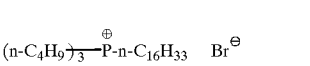
A-28
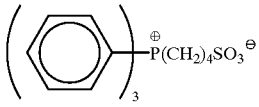
A-29
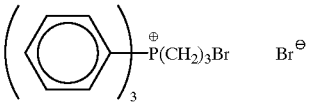
A-30
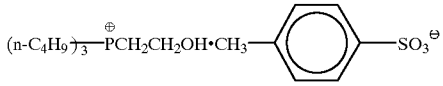
A-31
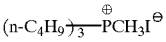
A-32
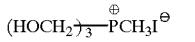
A-33
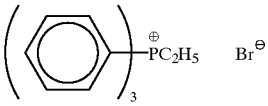
A-34
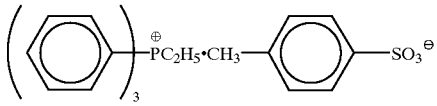

-continued
A-35
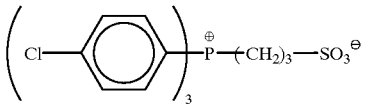
A-36
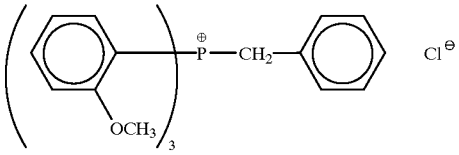
A-37
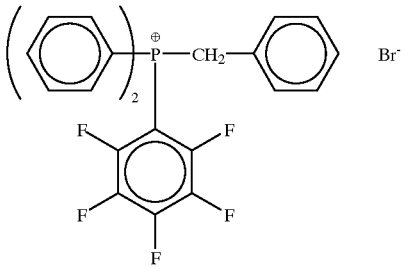
A-38
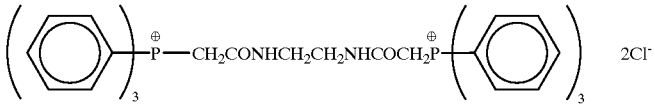
A-39
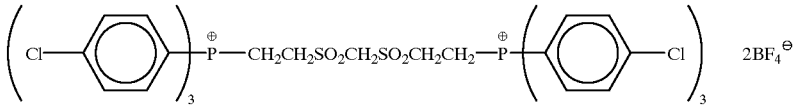
A-40
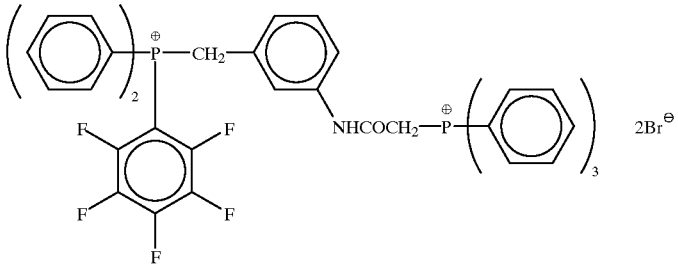
A-41
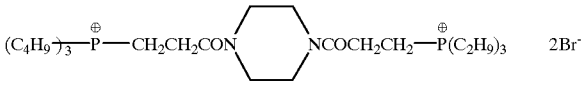
A-42
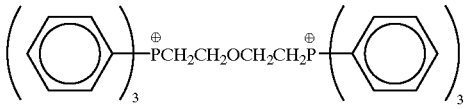
A-43
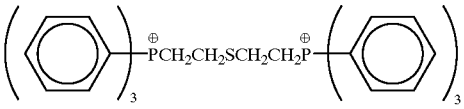
A-44
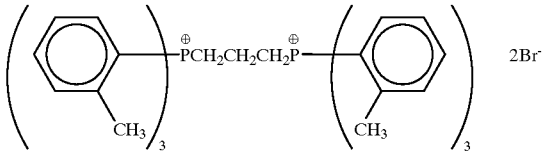
A-45
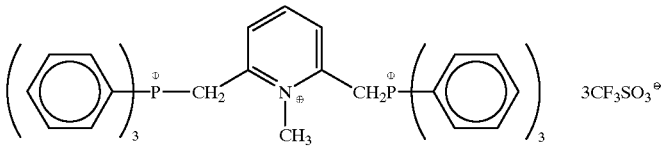

-continued

A-46

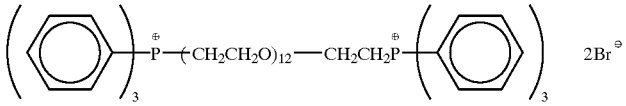

A-47

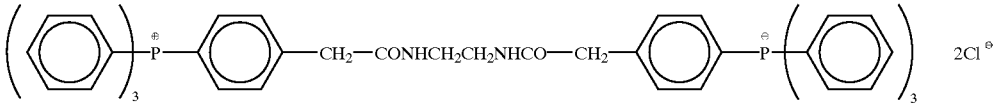

The compounds represented by formulae (III) and (IV) will now be described in detail.

In formulae (III) and (IV), $A_3$ represents an organic group for forming a heterocyclic ring, and may contain a carbon atom, a hydrogen atom, an oxygen atom, a nitrogen atom, and a sulfur atom in which the benzene ring may be condensed. $A_3$ preferably forms a 5- or 6-membered ring, and more preferably a pyridine ring.

The divalent groups represented by $B_1$ and $C_1$ are preferably an alkylene group, an arylene group, an alkenylene group, —$SO_2$—, —SO—, —O—, —S—, and —N($R_{16}$)—, and combinations thereof. $R_{16}$ represents an alkyl group, an aryl group, or a hydrogen atom. $B_1$ and $C_1$ are each particularly preferably an alkylene group, an arylene group, —O— and —S—, and combinations thereof.

$R_7$ and $R_8$ are each preferably an alkyl group having from 1 to 20 carbon atoms, which may be the same or different from each other. The alkyl group may be substituted by one or more substituents, and examples of the substituents include a halogen atom (e.g., chlorine, bromine), a substituted or unsubstituted alkyl group (e.g., methyl, hydroxyethyl), a substituted or unsubstituted aryl group (e.g., phenyl, tolyl, p-chlorophenyl), a substituted or unsubstituted acyl group (e.g., benzoyl, p-bromobenzoyl, acetyl), a sulfo group, a carboxyl group, a hydroxyl group, an alkoxy group (e.g., methoxy, ethoxy), an aryloxy group, an amido group, a sulfamoyl group, a carbamoyl group, a ureido group, an unsubstituted or alkyl-substituted amino group, a cyano group, a nitro group, an alkylthio group, and an arylthio group. $R_7$ and $R_8$ are each preferably an alkyl group having from 1 to 10 carbon atoms. The substituents are preferably an aryl group, a sulfo group, a carboxyl group and a hydroxyl group.

$R_9$ and $R_{10}$ each represents a hydrogen atom or a substituent, which is, for example, selected from the substituents exemplified as the substituents of alkyl groups represented by $R_7$ and $R_8$. $R_9$ and $R_{10}$ are each preferably a substituent having from 0 to 10 carbon atoms, and more specifically an aryl-substituted alkyl group or a substituted or unsubstituted aryl group.

$X_2$ represents an anion, but if an intermolecular salt is formed, $X_2$ does not exist. Examples of $X_2$ include a chlorine ion, a bromine ion, an iodine ion, a nitric acid ion, a sulfuric acid ion, a p-toluenesulfonic acid ion, and an oxalate ion.

Typical examples will now be described below, but the present invention is not restricted thereto. The compounds according to the present invention can easily be synthesized by the process known. Reference is made to the following literature: see *Quart. Rev.* 16, 163 (1962).

Specific examples of the compounds represented by formulae (III) and (IV) will now be described, but the present invention should not be restricted thereto.

B-1

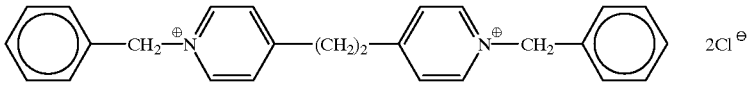

B-2

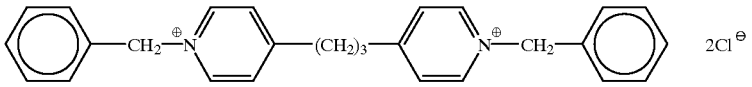

B-3

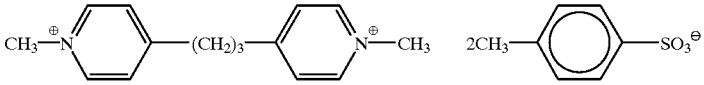

B-4

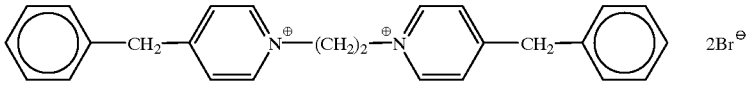

B-5

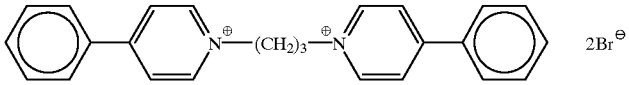

-continued
B-6
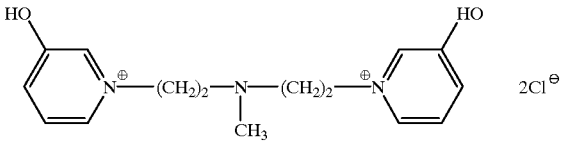
B-7
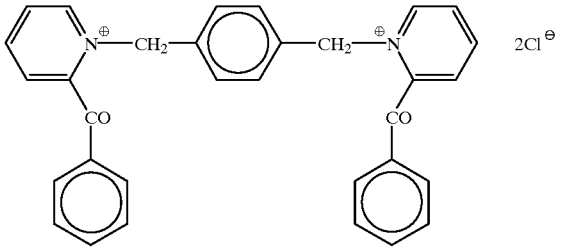
B-8
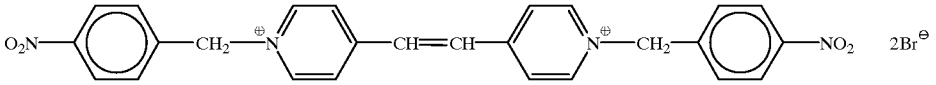
B-9
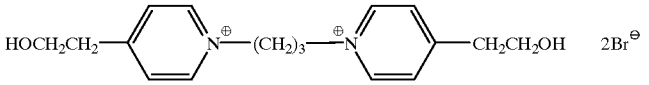
B-10
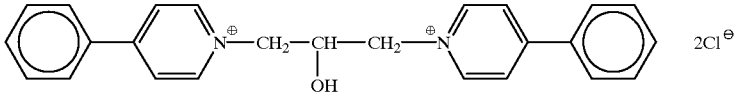
B-11
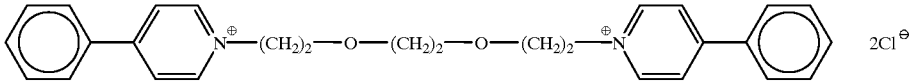
B-12
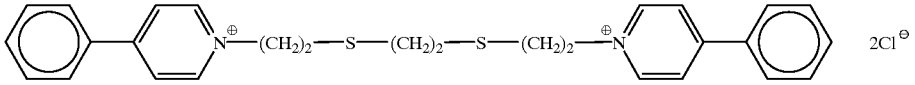
B-13
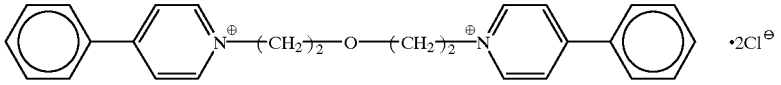
B-14
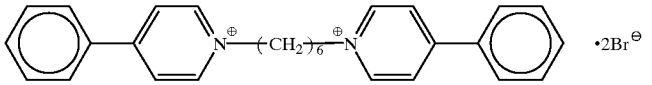
B-15
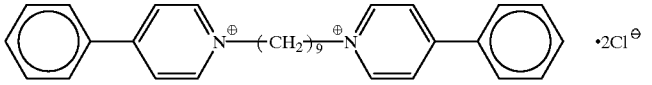
B-16
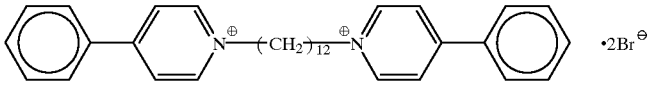
B-17
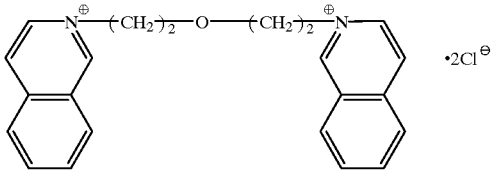

-continued

B-18

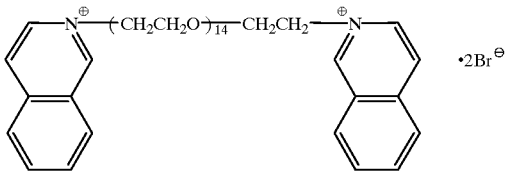

B-19

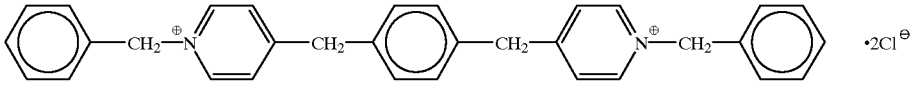

B-20

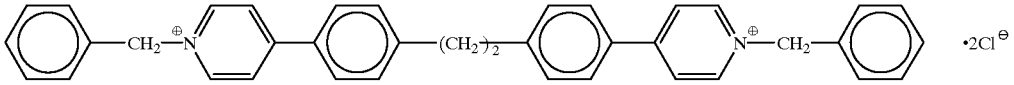

B-21

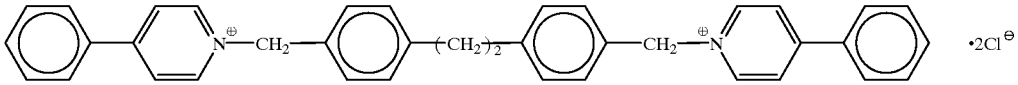

The compound represented by formula (V) will now be described in detail.

The nitrogen-containing heterocyclic aromatic ring represented by $Z_1$ may contain a carbon atom, a hydrogen atom, an oxygen atom, and a sulfur atom in addition to the nitrogen atom, and a benzene ring may be condensed therewith. The heterocyclic ring formed is preferably a 5- or 6-membered ring, more preferably a pyridine ring, a quinoline ring, or an isoquinoline ring.

$R_{11}$ is preferably an alkyl group having from 1 to 20 carbon atoms, and may be a straight-chain, branched, or cyclic alkyl group. The alkyl group preferably has from 1 to 12 carbon atoms and more preferably from 1 to 8 carbon atoms.

$X_3^-$ represents an anion, but $X_3^-$ does not exist if a intermolecular salt is formed. Examples of $X_3^-$ include a chlorine ion, a bromine ion, an iodine ion, a nitric acid ion, a sulfuric acid ion, a p-toluenesulfonic acid ion, and an oxalate ion.

The groups represented by $Z_1$ and $R_{11}$ may be substituted with one or more substituents. Examples of preferable substituents include a halogen atom (e.g., chlorine, bromine), a substituted or unsubstituted aryl group (e.g., phenyl, tolyl, p-chlorophenyl), a substituted or unsubstituted acyl group (e.g., benzoyl, p-bromobenzoyl, acetyl), a sulfo group, a carboxyl group, a hydroxyl group, an alkoxy group (e.g., methoxy, ethoxy), an aryloxy group, an amido group, a sulfamoyl group, a carbamoyl group, a ureido group, an unsubstituted or alkyl-substituted amino group, a cyano group, a nitro group, an alkylthio group, and an arylthio group. The substituents are preferably an aryl group, a sulfo group, a carboxyl group or a hydroxyl group.

In addition, as the substituents of $Z_1$, a substituted or unsubstituted alkyl group (e.g., methyl, hydroxyethyl), a substituted or unsubstituted aralkyl group (e.g., benzyl, p-methoxyphenethyl) are also preferred.

Typical examples will now be described below, but the present invention is not restricted thereto. The compounds according to the present invention can easily be synthesized by the process known. Reference is made to the following literature: see *Quart. Rev.* 16, 163 (1962).

Specific examples of the compounds represented by formula (V) will now be described, but the present invention should not be restricted thereto.

C-1

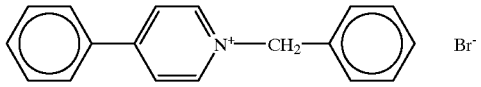

C-2

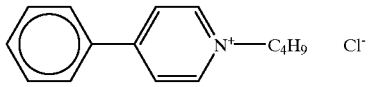

C-3

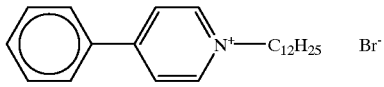

C-4

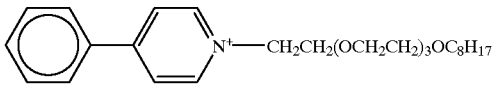

C-5

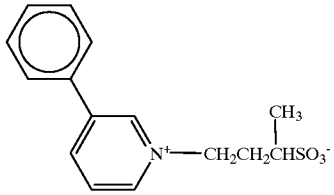

-continued

C-6

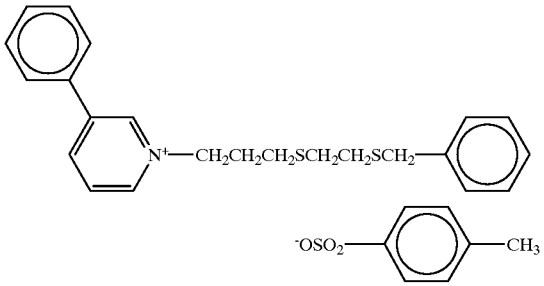

C-7

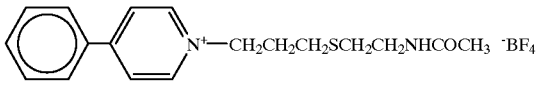

C-8

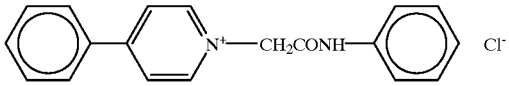

C-9

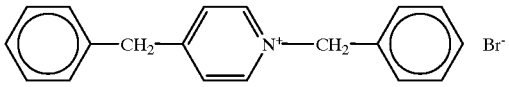

C-10

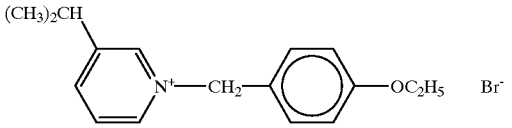

C-11

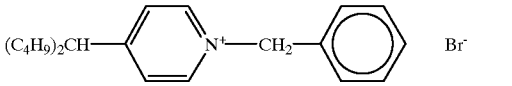

C-12

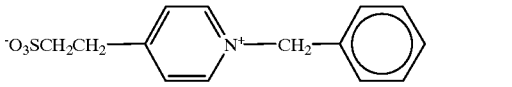

C-13

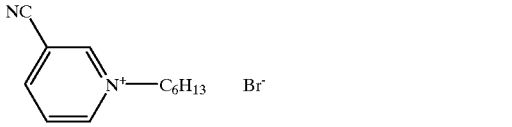

C-14

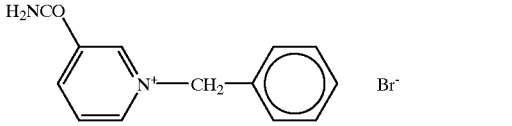

C-15

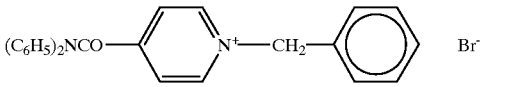

-continued

C-16

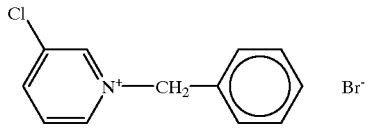

C-17

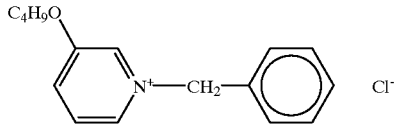

C-18

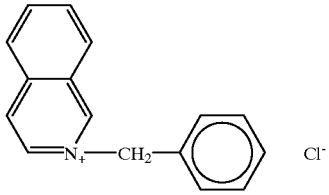

C-19

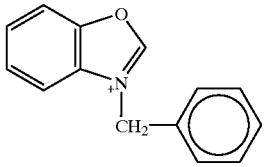

C-20

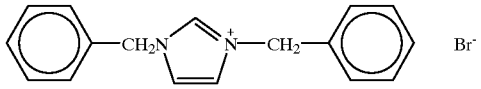

The amino compound acting as an internal nucleating accelerator will now be described in detail.

Available amino compounds are described in U.S. Pat. No. 4,975,354, and are amino compounds (1) having at least one secondary amino or tertiary amino group, (2) containing at least three repeating ethylene oxy units in the structure thereof and (3) exhibiting at least one, preferably at least three, and more preferably at least four, partition coefficients.

Examples of the amino compound acting as an internal nucleating accelerator include monoamines, diamines, and polyamines. These amines may be aliphatic amines or may contain an aromatic moiety or a heterocyclic moiety. The aliphatic, aromatic, and heterocyclic groups existing in the amine may be substituted or unsubstituted. The amine compound according to the present invention is a compound having at least 20 carbon atoms.

The amino compound which can be used as an internal nucleating accelerator is a bis type tertiary amine possessing at least three partition coefficients and having a construction represented by the following formula:

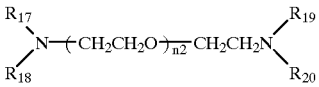

wherein $n_2$ represents an integer of from 3 to 50, preferably from 10 to 50; $R_{17}$, $R_{18}$, $R_{19}$ and $R_{20}$ each independently represents an alkyl group having from 1 to 8 carbon atoms, or $R_{17}$ and $R_{18}$ each represents an atomic group necessary for forming a heterocyclic ring with each other, or $R_{19}$ and $R_{20}$ each represents an atomic group necessary for forming a heterocyclic ring with each other.

The amino compound which can be used as an internal nucleating accelerator is a bis type secondary amine possessing at least three partition coefficients and having a construction represented by the following formula:

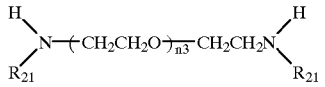

wherein $n_3$ represents an integer of from 3 to 50, preferably from 10 to 50, two $R_{21}$ groups each independently represents a straight-chain or branched, substituted or unsubstituted alkyl group having at least 4 carbon atoms. Preferably, a group comprising at least three repeating ethyleneoxy units is directly bonded to the tertiary amino nitrogen atom, and most preferably, a group comprising at least three repeating ethyleneoxy units is bonded to the tertiary amino nitrogen atom of the bis type tertiary amino compound.

The most preferable amino compound is a compound represented by the following formula, wherein Pr represents an n-propyl group.

(D-1)

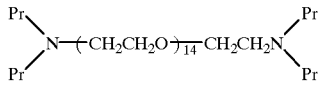

Another amino compound useful as an internal nucleating accelerator is described in U.S. Pat. No. 4,914,003, and represented by the following formula:

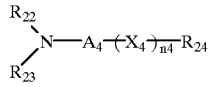

wherein $R_{22}$ and $R_{23}$ each independently represents a substituted or unsubstituted alkyl group, or they may be connected to each other to form a ring; $R_{24}$ represents a substituted or unsubstituted alkyl group, an aryl group or a heterocyclic group; $A_4$ represents a divalent linking group; $X_4$ represents —$CONR_{25}$—, —O—$CONR_{25}$—, —$NR_{25}CO$—$CONR_{25}'$—, —$NR_{25}$—COO—, —COO—, —OC—O—, —CO—, —$NR_{25}CO$—, —$SO_2NR_{25}$—, —$NR_{25}SO_2$—, —$SO_2$—, —S— or —O—, wherein $R_{25}$ and $R_{25}'$ each represents a hydrogen atom or a lower alkyl group; and $n_4$ represents 0 or 1, provided that total carbon number contained in $R_{22}$, $R_{23}$, $R_{24}$ and $A_4$ are 20 or more.

Still another amino compound useful as an internal nucleating accelerator is an amino compound described in U.S. Pat. No. 5,030,547, and represented by the following formula:

$$Y_0[(A_0)_{n0}B_0]m_0$$

wherein $Y_0$ represents a group which accelerates the adsorption onto the silver halide; $A_0$ represents a divalent linking group; $B_0$ represents an amino group, an ammonium group or a nitrogen-containing heterocyclic group; $m_0$ represents 1, 2 or 3; and $n_0$ represents 1 or 2.

The amount of the compounds represented by formulae (II), (III), (IV) or (V) and the amino compound acting as an internal nucleating accelerator are not specifically restricted as long as they are added in an required amount depending upon the characteristics of the light-sensitive material. The amount used in the present invention is preferably from $1\times10^{-5}$ to $2\times10^{-2}$ mol/mol Ag, more preferably from $2\times10^{-5}$ to $1\times10^{-2}$ mol/mol Ag.

The compounds represented by formulae (II), (III), (IV) and (V), and the amino compound acting as an internal nucleating accelerator can be dissolved in an adequate organic solvent such as alcohol (e.g., methanol, ethanol, propanol, fluorinated alcohol), ketone (e.g., acetone, methyl ethyl ketone), diformamide, dimethylsulfoxide, and methylcellosolve.

They may also be dissolved in an oil such as dibutyl phthalate, tricresyl phosphate, glyceryl triacetate or diethyl phthalate by the emulsion dispersion method, which has already been well-known or dissolved with a co-solvent such as ethyl acetate or cyclohexanone and mechanically prepared into an emulsion dispersion. Otherwise, they can be made into a fine dispersion by the method known as a solid dispersing.

The compound represented by formula (N-1) will now be described in detail.

$Z^1$ represents a nonmetal atomic group necessary for forming a 6-membered nitrogen containing-aromatic heterocyclic ring together with N and $X^1$; $X^1$ represents N or $CR^{12}$, in which $R^{12}$ has the same meaning as $R^{11}$. Examples of the 6-membered nitrogen containing-heterocyclic ring formed by $Z^1$, N and $X^1$ include pyridine, pyradine, pyrimidine, pyridadine and triazine. Examples of condensed aromatic ring formed by bonding $R^{11}$ or $R^{12}$ include quinoline, isoquinoline, naphthylidine, phthaladine, quinoxaline, quinazoline, sinonine, puteridine, purine, acridine, phenanthridine, phenadine, and phenanthroline. The 6-membered nitrogen containing-heterocyclic ring formed by $Z^1$ is preferably pyridine, quinoline, isoquinoline or phenanthridine, more preferably pyridine, quinoline or isoquinoline, and most preferably pyridine.

$R^1$ represents an alkyl group, an alkenyl group, an alkynyl group, an aryl group, or a heterocyclic group, which each may be substituted by one or more substituents. Examples of the substituents include an alkyl group, an alkenyl group, an alkynyl group, a hydroxyl group, a mercapto group, a nitro group, a carboxyl group, a cyano group, a halogen atom, an aryl group, a heterocyclic group, a mercapto-substituted heterocyclic group, an alkoxy group, an aryloxy group, an acylamino group, a thioamido group, an alkylamino group, an anilino group, a ureido group, a thioureido group, a sulfamoylamido group, an alkylthio group, an arylthio group, an alkoxycarbonylamino group, a sulfonamido group, a carbamoyl group, a thiocarbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imido group, a heterocyclic thio group, a sulfinyl group, a phosphonyl group, an aryloxycarbonyl group, an acyl group, and a thiocarbonyl group. These substituents may be further substituted by one or more substituents.

More specific examples of $R^1$ will be demonstrated. Examples of the alkyl group represented by $R^1$ include a straight-chain, branched, or cyclic alkyl groups having from 1 to 16, preferably from 1 to 10 carbon atoms, such as methyl, ethyl, propyl, isopropyl, t-butyl, allyl, propargyl, 2-butenyl, 2-hydroxyethyl, benzyl, 4-methylbenzyl, 2-methanesulfonamidoethyl, 2-methanesulfonylethyl, 2-methoxyethyl, cyclopentyl, and 2-acetamidoethyl.

Examples of the alkenyl group represented by $R^1$ include an alkenyl group having from 2 to 18 carbon atoms, preferably from 2 to 10 carbon atoms, such as vinyl and 2-styryl. Examples of the alkynyl group represented by $R^1$ include an alkenyl group having from 2 to 18 carbon atoms, preferably from 2 to 10 carbon atoms, such as ethynyl and phenylethynyl.

Examples of the aryl group represented by $R^1$ include an aryl group having from 6 to 24 carbon atoms, preferably from 6 to 12 carbon atoms, such as phenyl, naphthyl, and p-methoxyphenyl. The heterocyclic group represented by $R^1$ is a saturated or unsaturated 5- or 6-member heterocyclic ring having from 1 to 5 carbon atoms and containing at least one oxygen atom, nitrogen atom or sulfur atom, in which the number and type of the hetero atom forming the ring may be one or more, and examples thereof include 2-furyl, 2-thienyl, and 4-pyridyl.

$R^1$ is preferably an alkyl group, an alkenyl group, or an alkynyl group, more preferably an alkyl group or an alkenyl group, and most preferably an alkyl group.

$R^{11}$ and $R^{12}$ each represents a hydrogen atom, a halogen atom, or a substituent which is bonded to a heterocyclic ring via a carbon atom, an oxygen atom, a nitrogen atom or a sulfur atom. Examples of the substituent bonded to a heterocyclic ring via a carbon atom of $R^{11}$ and $R^{12}$ include an alkyl group, an alkenyl group, an alkynyl group, an aryl group, a carbamoyl group, an alkoxycarbonyl group, an aryloxycarbonyl group, an acyl group, a carboxyl group, and a cyano group; examples of the substituent bonded to a heterocyclic ring via an oxygen atom $R^{11}$ and $R^{12}$ include a hydroxyl group, an alkoxy group, an aryloxy group, a heterocyclic oxy group, an acyloxy group, a carbamoyloxy group, and a sulfonyloxy group; examples of the substituent bonded to a heterocyclic ring via a nitrogen atom of $R^{11}$ and $R^{12}$ include an acylamino group, an amino group, an alkylamino group, an arylamino group, a heterocyclic amino group, a ureido group, a sulfamoylamino group, an alkoxycarbonylamino group, an aryloxycarbonylamino group, a sulfonamido group, and an imido group; and examples of the substituent bonded to a heterocyclic group via a sulfur atom of $R^{11}$ and $R^{12}$ include an alkylthio group, an arylthio group, a heterocyclic thio group, a sulfamoyl group, an alkoxysulfonyl group, an aryloxysulfonyl group, a sulfonyl group, a sulfo group, and a sulfinyl group. They may be further substituted by one or more substituents defined for the substituents of $R^1$.

$R^{11}$ and $R^{12}$ will be described in more detail. Examples of the halogen atom include a fluorine atom, a chlorine atom, and a bromine atom. Examples of the alkyl group include a straight chain, branched or cyclic alkyl group having from 1 to 16 carbon atoms, preferably from 1 to 10 carbon atoms, such as methyl, ethyl, isopropyl, t-butyl, benzyl, and cyclopentyl. Examples of the alkenyl group include an alkenyl group having from 2 to 16 carbon atoms such as vinyl, 1-propenyl, 1-hexenyl, and styryl. Examples of the alkynyl group include an alkynyl group having from 2 to 16 carbon atoms such as ethynyl, 1-butynyl, 1-dodecenyl, and phenylethynyl. Examples of the aryl group include an aryl group having from 6 to 24 carbon atoms such as phenyl, naphthyl, and p-methoxyphenyl.

Examples of the carbamoyl group include a carbamoyl group having from 1 to 18 carbon atoms such as carbamoyl, N-ethylcarbamoyl, N-octylcarbamoyl, and N-phenylcarbamoyl. Examples of the alkoxycarbonyl group include an alkoxycarbonyl group having from 2 to 18 carbon atoms such as methoxycarbonyl and benzyloxycarbonyl. Examples of the aryloxycarbonyl group include an aryloxycarbonyl group having from 7 to 18 carbon atoms such as phenoxycarbonyl. Examples of the acyl group include an acyl group having from 1 to 18 carbon atoms such as acetyl and benzoyl. Examples of the heterocyclic group connected via the carbon atom on the ring include a 5- or 6-membered, saturated or unsaturated heterocyclic ring having from 1 to 5 carbon atoms and one or more oxygen atoms, nitrogen atoms, or sulfur atoms, in which the number and type of the hetero atom forming the ring may be one or more, such as 2-furyl, 2-thienyl, 2-pyridyl, and 2-imidazolyl.

Examples of the alkoxy group include an alkoxy group having from 1 to 16 carbon atoms, preferably from 1 to 10 carbon atoms, such as methoxy, 2-methoxyethoxy, and 2-methanesulfonylethoxy. Examples of the aryloxy group include an aryloxy group having from 6 to 24 carbon atoms, such as phenoxy, p-methoxyphenoxy, and m-(3-hydroxypropioneamido)phenoxy. Examples of the heterocyclic oxy group include a 5- or 6-membered, saturated or unsaturated heterocyclic oxy group having from 1 to 5 carbon atoms and one or more oxygen atoms, nitrogen atom, or sulfur atom, in which the number and type of the hetero atom forming the ring may be one or more, such as 1-phenyltetrazolyl-5-oxy, 2-tetrahydropyranyloxy, and 2-pyridyloxy. Examples of the acyloxy group include an acyloxy group having from 1 to 16 carbon atoms, preferably from 1 to 10 carbon atoms, such as acetoxy, benzoyloxy, and 4-hydroxybutanoyloxy. Examples of the carbamoyloxy group include a carbamoyloxy group having from 1 to 16 carbon atoms, preferably from 1 to 10 carbon atoms, such as N,N-dimethylcarbamoyloxy, N-hexylcarbamoyloxy, and N-phenylcarbamoyloxy. Examples of the sulfonyloxy group include a sulfonyloxy group having from 1 to 16 carbon atoms, such as methanesulfonyloxy and benzenesulfonyloxy.

Examples of the acylamino group include an acylamino group having from 1 to 16 carbon atoms, preferably from 1 to 10 carbon atoms, such as acetamido and p-chlorobenzoylamido. Examples of the alkylamino group include an alkylamino group having from 1 to 16 carbon atoms, preferably from 1 to 10 carbon atoms, such as N,N-dimethylamino and N-(2-hydroxyethyl)amino. Examples of the arylamino group include an arylamino group having from 6 to 24 carbon atoms such as anilino and N-methylanilino. Examples of the heterocyclic amino group include a 5- or 6-membered, saturated or unsaturated heterocyclic amino group having from 1 to 5 carbon atoms and one or more oxygen atoms, nitrogen atoms or sulfur atoms, in which the number and type of the hetero atom forming the ring may be one or more, such as 2-oxazolylamino, 2-tetrahydropyranylamino, and 4-pyridylamino. Examples of the ureido group include a ureido group having from 1 to 16 carbon atoms, preferably from 1 to 10 carbon atoms, such as ureido, methylureido, N,N-diethylureido, and 2-methanesulfonamidoethylureido.

Examples of the sulfamoylamino group include a sulfamoylamino group having from 0 to 16 carbon atoms, preferably from 0 to 10 carbon atoms, such as methylsulfamoylamino and 2-methoxyethylulfamoylamino. Examples of the alkoxycarbonylamino group include an alkoxycarbonylamino group having from 2 to 16 carbon atoms, preferably from 2 to 10 carbon atoms, such as methoxycarbonylamino. Examples of the aryloxycarbonylamino group include an aryloxycarbonylamino group having from 7 to 24 carbon atoms such as phenoxycarbonylamino and 2,6-dimethoxyphenoxycarbonylamino. Examples of the sulfonamido group include a sulfonamido group having from 1 to 16 carbon atoms, preferably from 1 to 10 carbon atoms, such as methanesulfonamido and p-toluenesulfonamido. Examples of the imido group include an imido group having from 4 to 16 carbon atoms, such as N-succinimido and N-phthalimido. Examples of the heterocyclic group connected via the nitrogen atom of the ring include a 5- or 6-membered, saturated or unsaturated heterocyclic amino group having from 1 to 5 carbon atoms and one or more oxygen atoms, nitrogen atoms or sulfur atoms such as pyrrolidino, morpholino and imidazolino.

Examples of the alkylthio group include an alkylthio group having from 1 to 16 carbon atoms, preferably from 1 to 10 carbon atoms, such as methylthio and 2-phenoxyethylthio. Examples of the arylthio group include an arylthio group having from 6 to 24 carbon atoms such as phenylthio and 2-carboxyphenyltio. Examples of the heterocyclic thio group include a 5- or 6-membered, saturated or unsaturated heterocyclic thio groups having from 1 to 5 carbon atoms and one more oxygen atoms, nitrogen atoms or sulfur atoms, in which the number and type of the hetero atom forming the ring may be one or more, such as 2-benzothiazolylthio and 2-pyridylthio.

Examples of the sulfamoyl group include a sulfamoyl group having from 0 to 16 carbon atoms, preferably from 0 to 10 carbon atoms, such as sulfamoyl, methylsulfamoyl, and phenylsulfamoyl. Examples of the alkoxysulfonyl group include an alkoxysulfonyl group having from 1 to 16 carbon atoms, preferably from 1 to 10 carbon atoms, such as methoxysulfonyl. Examples of the aryloxysulfonyl group include an aryloxysulfonyl group having from 6 to 24 carbon atoms, preferably from 6 to 12 carbon atoms, such as phenoxysulfonyl. Examples of the sulfonyl group include a sulfonyl group having from 1 to 16 carbon atoms, preferably from 1 to 10 carbon atoms, such as methanesulfonyl and benzenesulfonyl. Examples of the sulfinyl group include a sulfinyl group having from 1 to 16 carbon atoms, preferably from 1 to 10 carbon atoms, such as methanesulfinyl and benzenesulfinyl.

$R^{11}$ and $R^{12}$ are each preferably an alkyl group, an aryl group, a carbamoyl group, an alkoxycarbonyl group, an aryloxycarbonyl group, an acyl group, a cyano group, an alkoxy group, an aryloxy group, a carbamoyloxy group, an acylamino group, a ureido group, a sulfamoylamino group, an alkoxycarbonylamino group, a sulfonamido group, a sulfamoyl group or a sulfonyl group, more preferably an alkyl group, an aryl group, a carbamoyl group, an alkoxy group, an acylamino group, a ureido group, a sulfonamido group or a sulfamoyl group, and most preferably an aryl group, a carbamoyl group or a sulfamoyl group.

$Y^1$ represents a counter ion for balance of electric charge such as an anion and a cation. If two or more anionic groups are contained in the molecule, $Y^1$ is a cation. Examples of the anion include a chlorine ion, a bromine ion, an iodine ion, a p-toluenesufonic acid ion, a sulfuric acid ion, a perchloric acid ion, a trifluoromethane sulfonic acid ion, a boron tetrafluoride ion, and a phosphor hexafluoride ion. Examples of the cation include a sodium ion, a potassium ion, a lithium ion, a calcium ion, an ammonium ion, a tetrabutylammonium ion, and a triethylammonium ion. $n^1$ represents a number necessary for balance of the electric charge, and $n^1$ is 0 when an internal salt is formed.

In the case where two $R^{11}$ groups are bonded to form a ring when $m^1$ is two or more, examples of the ring include a 5 to 7-membered aromatic, non-aromatic or heterocyclic ring.

The compound represented by formula (N-1) according to the present invention preferably contains a ballast group or a group which accelerates adsorption onto a silver halide in order to add it to a specific layer of the silver halide light-sensitive layer. The ballast group preferably has total carbon number of 15 or more and can be used in a coupler for a silver halide photograph. As the group which accelerates adsorption onto a silver halide, although part of them are mentioned as the substituent of $R^1$, thioamides (e.g., thiourethane, thioureido, thioamide), mercaptos (e.g., heterocyclic mercapto, alkylmercapto, arylmercapto, such as 5-mercaptotetrazole, 3-mercapto-1,2,4-triazole, 2-mercapto-1,3,4-thiadiazole, and 2-mercapto-1,3,4-oxadiazole), and 5- or 6-member nitrogen-containing heterocyclic ring forming iminosilver (e.g., benzotriazole) are preferred.

Examples of the bis type construction formed by bonding two radicals of the compounds represented by formula (N-1) from which a given hydrogen atom is removed are preferably those represented by the following formulae (N-2) and (N-3):

(N-2)

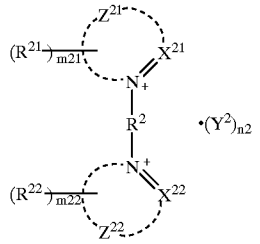

wherein $Z^{21}$ and $Z^{22}$ each has the same meanings as $z^1$; $X^{21}$ and $X^{22}$ each has the same meanings as $X^1$; $R^{21}$ and $R^{22}$ each has the same meanings as $R^{11}$; $Y^2$ has the same meanings as $Y^1$; $m^{21}$ and $m^{22}$ each has the same meanings as $m^1$; and $n^2$ has the same meanings as $n^1$. $R^2$ represents a divalent linking group in which a hydrogen atom is removed from the group $R^1$ (e.g., an alkylene group, an alkenylene group, an alkynylene group, an arylene group, a divalent heterocyclic group, —O—, —S—, —NH—, —CO—, and —$SO_2$—, and combinations thereof). Among them, preferred groups are the same as those defined in formula (N-1).

Examples of the alkylene group represented by $R^2$ include ethylene, trimethylene, pentamethylene, octamethylene, propylene, 2-buten-1,4-yl, 2-butyn-1,4-yl, and p-xylylene. Examples of the alkenylene group include ethen-1,2-yl. Examples of the arylene group include phenylene. Examples of the divalent heterocyclic group include furan-1,4-diyl. $R^2$ is preferably an alkylene group or an alkenylene group, and more preferably an alkylene group.

(N-3)

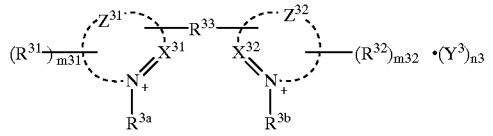

wherein $Z^{31}$ and $Z^{32}$ each has the same meanings as $Z^1$; $X^{31}$ and $X^{31}$ each has the same meanings as $X^1$; $R^{3a}$ and $R^{3b}$ each has the same meanings as $R^1$; $R^{31}$ and $R^{32}$ each has the same meanings as $R^{11}$; $Y^3$ has the same meanings as $Y^1$; $m^{31}$ and $m^{32}$ each has the same meanings as $m^1$; and $n^3$ has the same meanings as $m^1$. $R^{33}$ is a divalent linking group in which a hydrogen atom is removed from the group $R^{11}$. Among them, preferred groups are the same as those defined in formula (N-1).

Of the compounds represented by formula (N-1) according to the present invention, preferred compounds are represented by the following formulae (N-4) to (N-6).

(N-4)

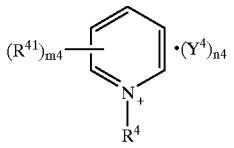

wherein $R^4$, $R^{41}$, $m^4$, $Y^4$, and $n^4$ have the same meanings as $R^1$, $R^{11}$, $m^1$, $Y^1$, and $n^1$ in formula (N-1), respectively. Among them, preferred groups are the same as those defined in formula (N-1).

(N-5)

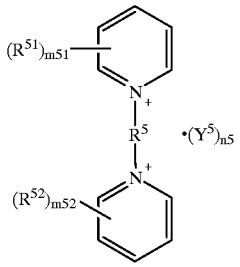

wherein $R^5$, $R^{51}$, $R^{52}$, $m^{51}$, $m^{52}$, $Y^5$, and $n^5$ have the same meanings as $R^2$, $R^{21}$, $R^{22}$, $m^{21}$, $m^{22}$, $Y^2$, and $n^2$ in formula (N-2), respectively. Among them, preferred groups are the same as those defined in formula (N-2).

(N-6)

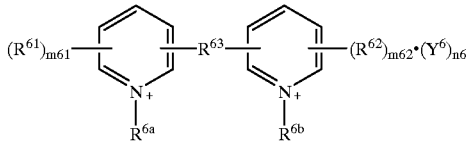

wherein $R^{6a}$, $R^{6b}$, $R^{61}$, $R^{62}$, $m^{61}$, $m^{62}$, $R^{63}$, $Y^6$, and $n^6$ have the same meanings as $R^{3a}$, $R^{3b}$, $R^{31}$, $R^{32}$, $m^{31}$, $m^{32}$, $R^{33}$, $Y^3$, and $n^3$ in formula (N-3), respectively. Among them, preferred groups are the same as those defined in formula (N-3).

Specific examples of the compounds represented by the formula (N-1) will be described, but the present invention should not be restricted thereto.

N-1

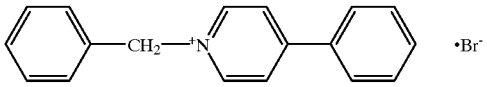

N-2

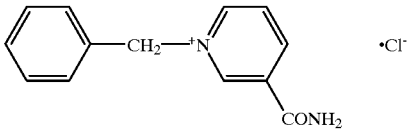

N-3

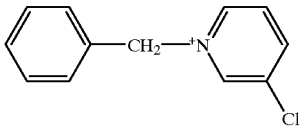

N-4

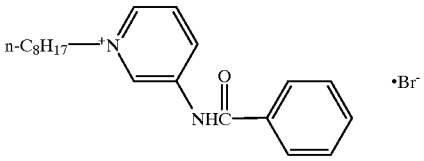

N-5

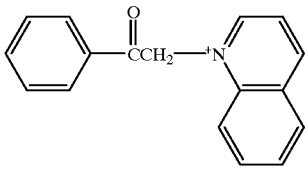

N-6

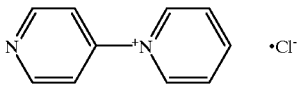

N-7

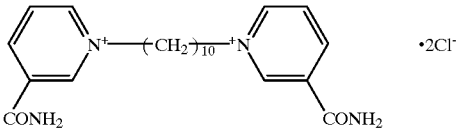

N-8

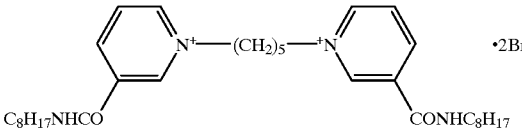

N-9

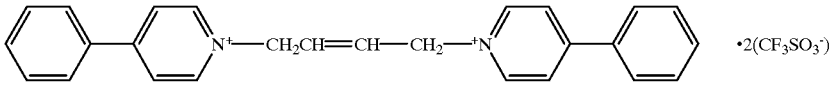

-continued
N-10
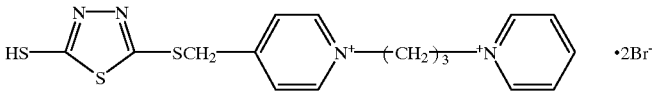
N-11
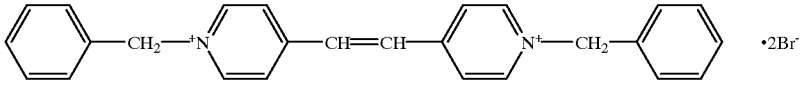
N-12
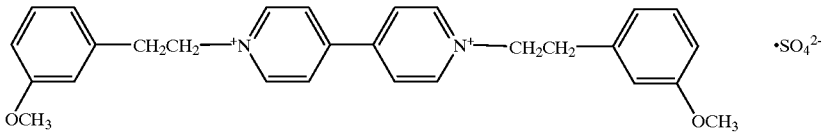
N-13
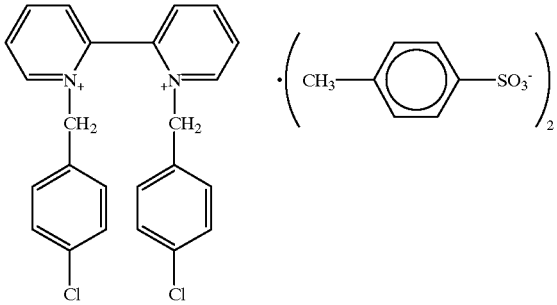
N-14
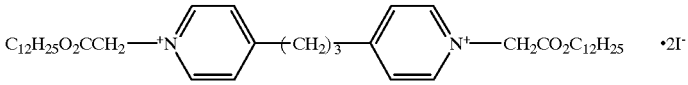
N-15
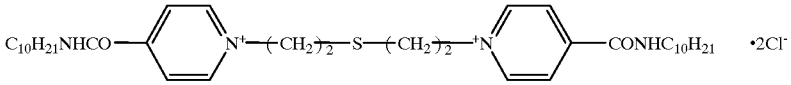
N-16
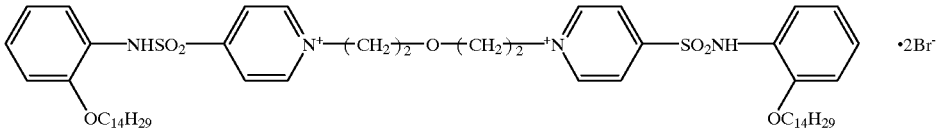
N-17
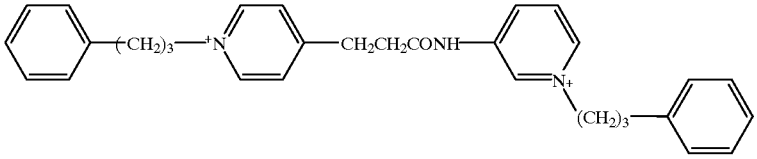
N-18
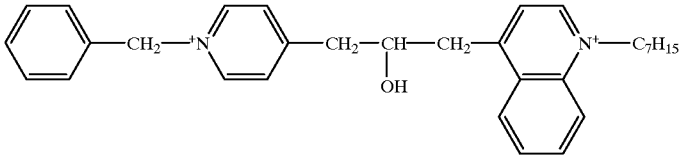

-continued
N-19
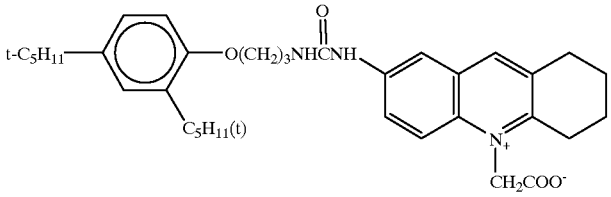
N-20
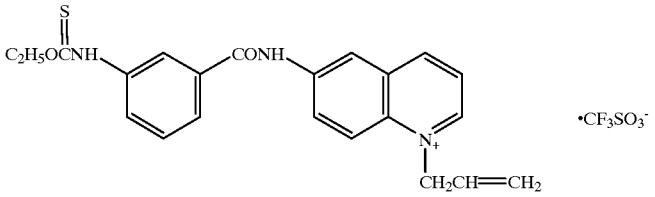
N-21
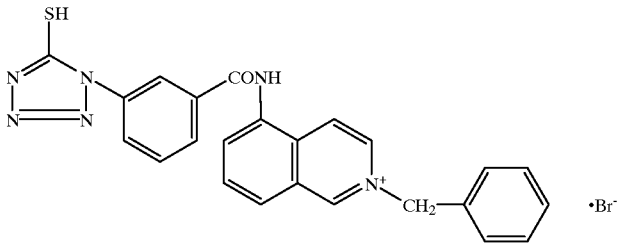
N-22
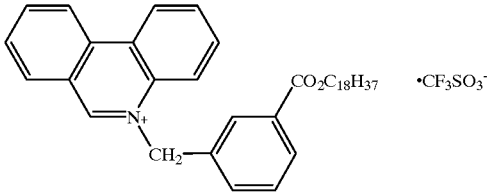
N-23
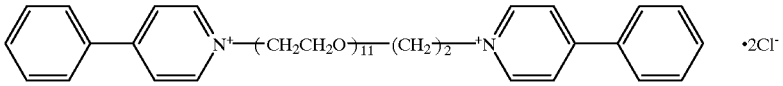
N-24
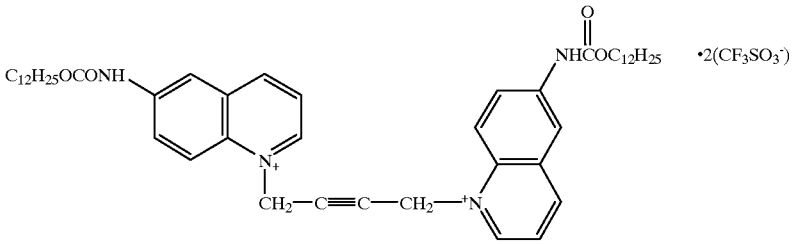
N-25
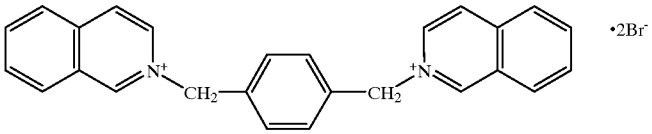

-continued

N-26

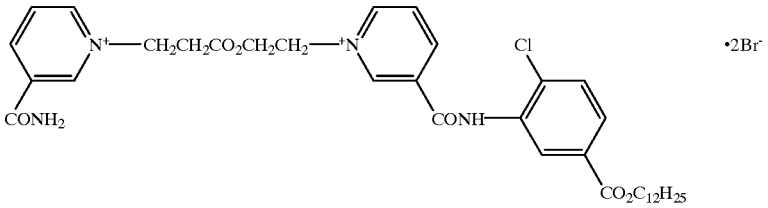

N-27

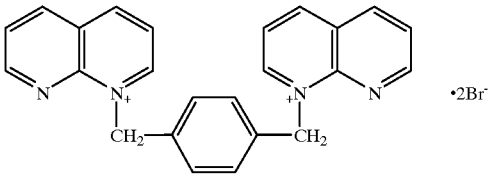

N-28

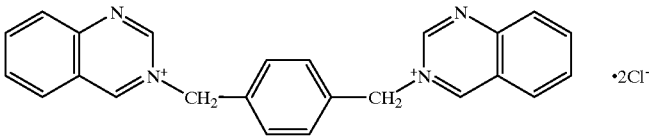

N-29

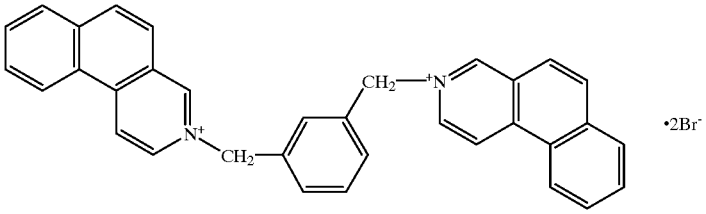

N-30

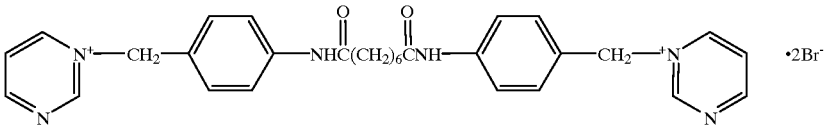

N-31

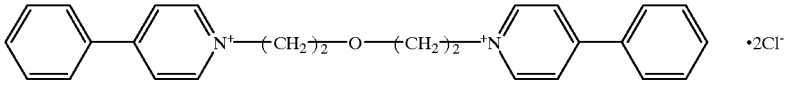

N-32

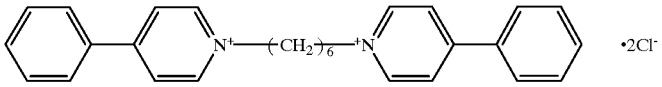

The compounds represented by formula (N-1) of the present invention are disclosed in JP-A-5-53231 and JP-A-6-161009.

When the compounds represented by formula (N-1) are added to the silver halide light-sensitive material of the present invention, they are added to a silver halide emulsion layer or other hydrophilic colloid layer(s). They may be added at any step, but are preferably added just before a coating step. The amount added of the compound represented by formula (N-1) depends on compositions and grain diameters of silver halide grains and kinds of the used compound, but is generally from $1\times10^{-6}$ to $1\times10^{-1}$ mol, preferably from $1\times10^{-4}$ to $5\times10^{-2}$ mol, and more preferably from $1\times10^{-3}$ to $1\times10^{-2}$ mol.

The silver halide of the silver halide emulsion for use in the present invention is preferably silver chloride, or silver bromochloride or silver bromoiodochloride having a sliver chloride content of 50 mol % or more. The content of silver iodide is preferably less than 5 mol %, more preferably less than 2 mol %.

In the present invention, the light-sensitive material suitable for high illumination exposure such as scanner exposure and the light-sensitive material suitable for line drawing photographing preferably may contain a rhodium compound to obtain a high contrast or a low fog.

The rhodium compounds for use in the present invention include water-soluble ones. Suitable examples thereof include a rhodium(III) halide compound and a rhodium complex salt containing as a ligand halogen, amine, oxalate, such as a hexachlororhodium(III) complex salt, a hexabromorhodium(III) complex salt, a hexaamminerhodium(III) complex salt and a trioxalatorhodium(III) complex salt. In using these rhodium compounds, they are dissolved in water or an appropriate solvent. In order to stabilize the solution of a rhodium compound, a conventional method, that is, a method of adding an aqueous solution of halogenated acid (e.g., hydrochloric acid, hydrobromic acid, hydrofluoric acid) or an alkali halide (e.g., KCl, NaCl, KBr, NaBr), can be adopted. Instead of using a water-soluble rhodium compound, it is possible to incorporate rhodium into emulsion grains by adding rhodium-doped silver halide grains to the silver halide preparation system and dissolving the grains therein.

The amount added of the rhodium compound is from $1\times10^{-8}$ to $5\times10^{-6}$ mol, preferably from $5\times10^{-8}$ to $1\times10^{-6}$, per mol of silver of silver halide emulsion.

In the present invention, the light-sensitive material suitable for high illumination exposure such as scanner exposure and the light-sensitive material sitable for line drawing photographing preferably may contain an iridium compound, an iridium salt or an iridium complex salt to obtain a high contrast or a low fog.

The iridium compounds for use in the present invention include various ones, e.g., hexachloroiridium, hexaammineiridium, trioxalatoiridium, hexacyanoiridium, iridium trichoride, iridium tetrachloride, potassium hexachloroiridium(III) acid, potassium hexachloroiridium (IV) acid, and ammonium hexachloroiridium(III) acid. In using these iridium compounds, they are dissolved in water or an appropriate solvent. In order to stabilize the solution of an iridium compound, a conventional method, that is, a method of adding an aqueous solution of halogenated acid (e.g., hydrochloric acid, hydrobromic acid, hydrofluoric acid) or an alkali halide (e.g., KCl, NaCl, KBr, NaBr), can be adopted. Instead of using a water-soluble iridium compound, it is possible to incorporate iridium into emulsion grains by adding iridium-doped silver halide grains to the silver halide preparation system and dissolving the grains therein.

The total amount added of the iridium compound is from $1\times10^{-8}$ to $1\times10^{-5}$ mol, preferably from $5\times10^{-8}$ to $1\times10^{-6}$ mol, per mol of silver halide which is finally formed.

These compounds can be properly added at the time silver halide emulsion grains are formed, or at any stage prior to the emulsion coating. In particular, they are preferably added before physical ripening of the silver halide forming step, more preferably at the time the emulsion is formed, and thereby to be incorporated into silver halide grains.

Photographic emulsions for use in the present invention can be prepared using methods described in, e.g., P. Glafkides, *Chemie et Physique Photographique,* Paul Montel, Paris (1967), G. F. Duffin, *Photographic Emulsion Chemistry,* The Focal Press, London (1966), V. L. Zelikman et al, *Making and Coating Photographic Emulsion,* The Focal Press, London (1964).

Suitable methods for reacting a water-soluble silver salt with a water-soluble halide include, e.g., a single jet method, a double jet method, or a combination thereof.

A method in which silver halide grains are produced in the presence of excess silver ion (what is called reverse mixing method) can be employed. On the other hand, the controlled double jet method, in which the pAg of the liquid phase wherein silver halide grains are to be precipitated is maintained constant, may be employed. Further, it is preferable to carry out the grain formation using the so-called silver halide solvent, such as ammonia, thioethers and tetrasubstituted thioureas. Preferably, tetrasubstituted thioureas are used as the silver halide solvent, which are disclosed in JP-A-53-82408 and JP-A-55-77737. As for the thioureas, tetramethylthiourea and 1,3-dimethyl-2-imidazolinethione are preferably used.

According to the controlled double jet method and the grain formation method using a silver halide solvent, a silver halide emulsion having a regular crystal shape and a narrow distribution of grain sizes can be obtained with ease, and so these methods are useful for making the silver halide emulsions used in the present invention.

For the purpose of rendering the grain sizes uniform, it is also preferable that the grain growth is accelerated within the limits of critical saturation degree by using a method of changing the addition speed of silver nitrate or an alkali halide depending on the speed of grain growth, as described in British Patent No. 1,535,016, JP-B-48-36890 and JP-B-52-16364, or a method of changing the concentrations of the aqueous solutions, as described in British Patent No. 4,242,445 and JP-A-55-158124.

The emulsion for use in the present invention is preferably a monodispersion, and the variation coefficient thereof is 20% or less, preferably 15% or less.

The average grain size of the monodispersion silver halide emulsion is preferably from 0.5 $\mu$m or less, and more preferably from 0.1 to 0.4 $\mu$m.

The silver halide emulsions for use in the present invention may be preferably chemically sensitized. Examples of the chemical sensitization include known methods, such as a sulfur sensitization method, a selenium sensitization method, a tellurium sensitization method, a noble metal sensitization method, and a reduction sensitization method. These methods can be used alone or in combination. In the combined use, it is preferable to combine, e.g., a sulfur sensitization method and a gold sensitization method, a sulfur sensitization method, a selenium sensitization and a gold sensitization method, or a sulfur sensitization method, a tellurium sensitization method and a gold sensitization method.

In the sulfur sensitization method in the present invention, the sensitization can be generally effected by adding a sulfur sensitizer to an emulsion and stirring the emulsion for a prescribed time under a temperature of 40° C. or higher. As for the sulfur sensitizer, known compounds including not only sulfur compounds contained in gelatin but also thiosulfates, thioureas, thiazoles, and rhodanines can be used. Specific examples thereof are disclosed in U.S. Pat. Nos. 1,574,944, 2,278,947, 2,410,689, 2,728,668, 3,501,313 and 3,656,955. of these sulfur sensitizers, thiosulfates and thiourea compounds are preferred. The pAg of the chemical sensitization is preferably 8.3 or less, and more preferably from 7.3 to 8.0. Furthermore, polyvinylpyroridone and thiosulfate may be used in combination as disclosed by Moisar, *Klein Gelatine. Proc. Syme.,* 2nd, p.301–309 (1976).

The amount of a sulfur sensitizer added, though it is changed depending on various conditions, such as the pH and the temperature at the time of chemical sensitization and the size of silver halide grains, is in the range of $10^{-7}$ to $10^{-2}$ mol, preferably $10^{-5}$ to $10^{-3}$ mol, per mol of silver halide.

The noble metal sensitization method includes a gold sensitization method, and the method uses a gold compound and particularly a gold complex salt. Complex salts of noble metals other than gold, such as platinum, palladium, and iridium, may be added as disclosed in, e.g., U.S. Pat. No. 2,448,060 and British Patent No. 618,061.

Selenium sensitizers for use in the present invention include known selenium compounds. In general, selenium sensitization can be effected by adding an unstable selenium compound and/or a nonunstable selenium compound to the silver halide emulsion and agitating the resulting emulsion at a high temperature, preferably 40° C. or more, for a definite time. Suitable examples of the unstable selenium compounds include those disclosed in JP-B-44-15748, JP-B-43-13489, JP-A-4-25832, JP-A-4-107442 and JP-A-4-324855. The compounds represented by formula (VIII) or (IX) described in JP-A-4-324855 are preferably used. On the other hand, examples of the nonunstable selenium compounds which can be used in the present invention include those disclosed in JP-B-46-4553, JP-B-52-34492 and JP-B-52-34491.

Tellurium sensitizers for use in the present invention are compounds capable of producing silver telluride, which is presumed to act as a sensitization nucleus, at the surface or the inside of silver halide grains. The production rate of silver telluride in a silver halide emulsion can be examined by the method disclosed in JP-A-5-313284.

Specific examples of the tellurium sensitizers include the compounds disclosed in U.S. Pat. Nos. 1,623,499, 3,320,069 and 3,772,031; British Patent Nos. 235,211, 1,121,496, 1,295,462 and 1,396,696; Canadian Patent No. 800,958, JP-A-4 -204640, JP-A-4-271341, JP-A-4-333043 and JP-A-5-303157; *J. Chem. Soc. Commun.,* 635 (1980); ibid. 1102 (1979); ibid. 645 (1979); *J. Chem. Soc. Perkin. Trans.,* 1,2191 (1980); S. Patai (compiler), *The Chemistry of Organic Selenium and Tellurium Compounds,* Vol. 1 (1986); and ibid. Vol. 2 (1987). In particular, the compounds represented by formulae (II), (III) and (IV) in JP-A-5-323284 are preferred.

The amounts of selenium and tellurium sensitizers used in the present invention, though they depend on the conditions under which the silver halide grains are ripened chemically, are generally from $10^{-8}$ to $10^{-2}$ mol, preferably from $10^{-7}$ to $\times 10^{-3}$ mol, per mol of silver halide. The chemical sensitization, although the present invention does not impose any particular restriction thereon, is generally carried out under a condition such that the pH is from 6 to 11, the pAg is from 6 to 11, preferably from 7 to 10, and the temperature is from 40 to 95° C., preferably from 45 to 85° C.

Examples of noble metal sensitizers for use in the present invention include gold, platinum, palladium and iridium. In particular, gold sensitizers are preferred. Suitable examples of such gold sensitizers include chloroauric acid, potassium chloroaurate, potassium aurithiocyanate and auric sulfide. These gold sensitizers can be used in an amount of $10^{-7}$ to $10^{-2}$ mol per mol of silver halide.

In a process of producing silver halide emulsion grains used in the present invention or allowing the produced grains to ripen physically, a cadmium salt, a zinc salt, a lead salt, and a thallium salt may be present.

Further, reduction sensitization can be adopted in the present invention. Examples of such reduction sensitizer include stannous salts, amines, formamidinesulfinic acid and silane compounds.

To the silver halide emulsions used in the present invention, thiosulfonate compounds may be added according to the method described in European Patent (EP) No. 293,917.

The present photographic material may contain only one kind of silver halide emulsion or not less than two kinds of silver halide emulsions (differing in average grain size, halide composition, crystal habit or chemical sensitization condition).

In the present invention, the silver halide emulsion particularly suitable for a light-sensitive material for dot-to-dot working contains silver halide comprising silver chloride of 90 mol %, preferably 95 mol %, or silver bromochloride or silver bromoiodochloride containing silver bromide of from 0 to 10 mol %.

If the proportion of silver bromide or silver iodide increases, it is not preferred because the safe light safety in an illuminated room is deteriorated, or the γ value is lowered.

Furthermore, the silver halide emulsion used for a light-sensitive material for dot-to-dot working preferably contains a transition metal complex. Examples of the transition metal include Rh, Ru, Re, Os, Ir and Cr.

Examples of the ligand include a nitrosyl ligand or thionitrosyl ligand, a halogenated ligand (e.g., fluoride, chloride, bromide, iodide), a cyanine ligan, a cyanate ligand, a thiocyanate ligand, a selenocyanate ligand, a tellurocyanate ligand, an acid ligand and an aquo ligand. When the aquo ligand exists, the number of the aquo ligand(s) is preferably one or two.

When the rhodium atom is incorporated, it is added in any form such as a monosalt or a complex salt during the grain formation.

Examples of the rhodium salt include rhodium chloride, rhodium dichloride, rhodium trichloride, and ammonium hexachlororhodium acid. Preferred are a water-soluble halide complex compound of tertiary rhodium such as hexachlororhodium (III) acid and salts thereof (e.g., ammonium salt, sodium salt, potassium salt).

The added amount of the water-soluble rhodium salt is from $1.0\times10^{-6}$ to $1\times10^{-3}$ mol, preferably from $1.0\times10^{-5}$ to $1.0\times10^{-3}$ mol, and preferably from $5.0\times10^{-5}$ to $5.0\times10^{-4}$ mol, per mol of silver halide.

The following transition metal complexes are also preferably used.

1. $[Ru(NO)Cl_5]^{-2}$
2. $[Ru(NO)_2Cl_4]^{-1}$
3. $[Ru(NO)(H_2O)Cl_4]^{-1}$
4. $[Ru(NO)Cl_5]^{-2}$
5. $[Rh(NO)Cl_5]^{-2}$
6. $[Re(NO)CN_5]^{-2}$
7. $[Re(NO)ClCN_4]^{-2}$
8. $[Rh(NO)_2Cl_4]^{-1}$
9. $[Rh(NO)\ (H_2O)Cl_4]^{-1}$
10. $[Ru(NO)CN_5]^{-2}$
11. $[Ru(NO)Br_5]^{-2}$
12. $[Rh(NS)Cl_5]^{-2}$
13. $[Os(NO)Cl_5]^{-2}$
14. $[Cr(NO)Cl_5]^{-3}$
15. $[Re(NO)Cl_5]^{-1}$
16. $[Os(NS)Cl_4(TeCN)]^{-2}$
17. $[Ru(NS)I_5]^{-2}$
18. $[Re(NS)_2Cl_4(SeCN)]^{-2}$
19. $[Os(NS)Cl(SCN)_4]^{-2}$
20. $[Ir(NO)Cl_5]^{-2}$

Spectral sensitizing dyes used in the present invention are not particularly limited.

The amount of sensitizing dyes added is, though depending on the shape and the size of silver halide grains, from $1\times10^{-7}$ to $1\times10^{-2}$ mol, preferably from $5\times10^{-6}$ to $5\times10^{-3}$ mol, per mol of silver halide. In cases where the size of silver halide grains ranges, e.g., from 0.2 to 1.3 μm, it is preferable that the amount of sensitizing dyes added is from $2\times10^{-7}$ to $3.5\times10^{-6}$ mol, particularly preferably from $6.5\times10^{-7}$ to $2.0\times10^{-6}$ mol, per $m^2$ of surface area of silver halide grains.

The light-sensitive silver halide emulsions used in the present invention may be spectrally sensitized by sensitizing dyes to extend their sensitivities to blue rays of relatively long wavelengths, green rays, red rays or infrared rays. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

The sensitizing dyes useful in the present invention include those described in *Research Disclosure,* Item 17643, Section IV-A (Dec. 1978, p. 23); ibid., Item 1831, Section X (August 1978, p. 437) and the references cited in these literatures.

In special cases where various type of scanners are used for exposure, it is advantageous to choose sensitizing dyes which can impart spectral sensitivities suited for spectral characteristics of the light source of the scanner used.

For instance, it is advantageous to choose (A) the simple merocyanines disclosed in JP-A-60-162247, JP-A-2-48653, U.S. Pat. No. 2,161,331, West German Patent No. 936,071 and JP-A-5-11382 when an argon laser is used as a light source, (B) the trinuclear cyanine dyes disclosed in JP-A-50-62425, JP-A-54 -18726 and JP-A-59-102229 when an He—Ne laser is used as a light source, (C) the thiacarbocyanines disclosed in JP-B-48-42172, JP-B-51-9609, JP-B-55-39818, JP-A-62-284343 and JP-A-2-105135 when an LED or red semiconductor laser is used as a light source, and (D) the tricarbocyanines disclosed in JP-A-59-191032 and JP-A-60-80841 and the 4-quinoline nucleus-containing dicarbocyanines represented by formula (IIIa) or (IIIb) in JP-A-59-192242 and JP-A-3-67242 when an infrared semiconductor layer is used as a light source.

Those sensitizing dyes may be used individually or in combination. Combinations of sensitizing dyes are often used for the purpose of supersensitization. Materials which can exhibit a supersensitizing effect in combination with sensitizing dyes although they themselves do not spectrally sensitize silver halide emulsions or do not absorb light in the visible region may be incorporated in the emulsions.

Useful sensitizing dyes, supersensitizing combinations of dyes, and materials capable of exhibiting a supersensitizing effect are described in, e.g., *Research Disclosure,* Vol. 176, Item 17643, Section IV-J (December 1978, p. 23).

In particular, the dyes cited below are preferably used for an argon laser light source:

S1-1

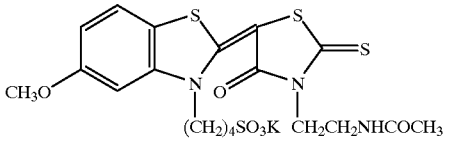

S1-2

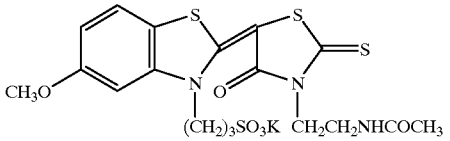

S1-3

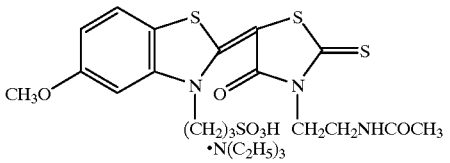

-continued

S1-4

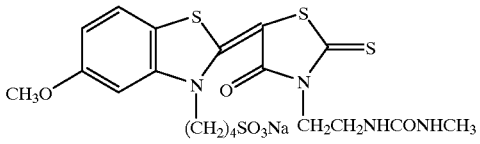

S1-5

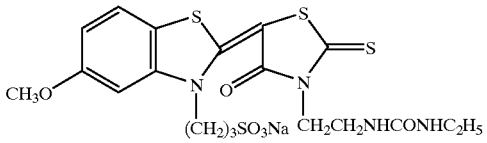

S1-6

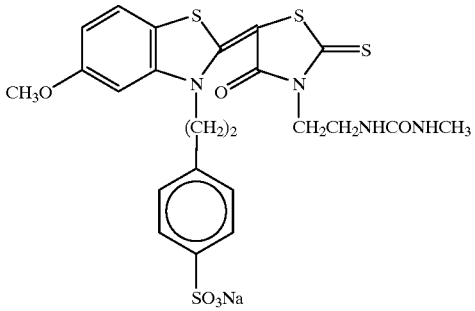

S1-7

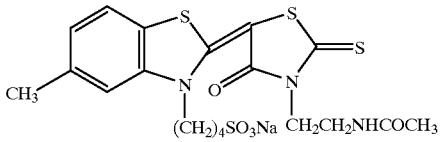

S1-8

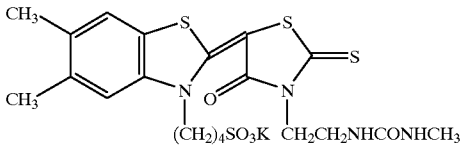

S1-9

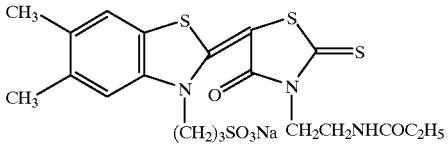

S1-10

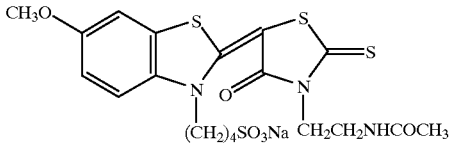

S1-11

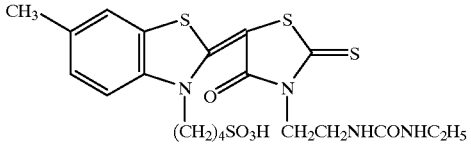

-continued

S1-12

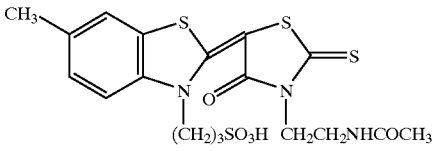

S1-13

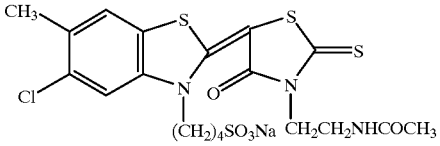

In addition to the dyes illustrated above, the sensitizing dyes represented by formula (I) in JP-A-6-75322 (from page 8, the end line, to page 13, 4th line) are particularly suitable for a helium-neon laser light source. Typical representatives of such sensitizing dyes are illustrated below. In addition, the sensitizing dyes represented by formula (I) of JP-A-6-75322 can be preferably used.

S2-1

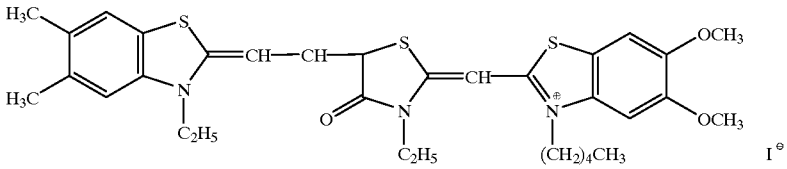

S2-2

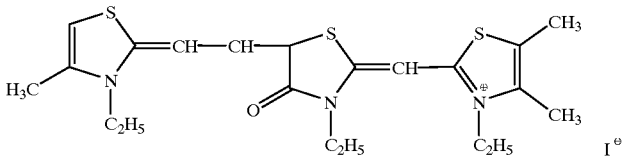

S2-3

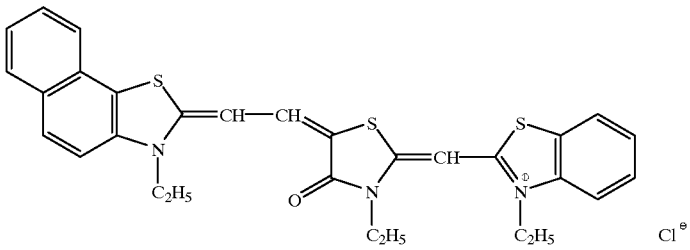

S2-4

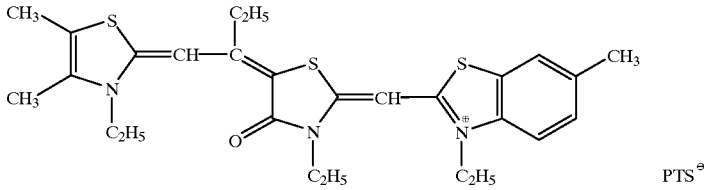

S2-5

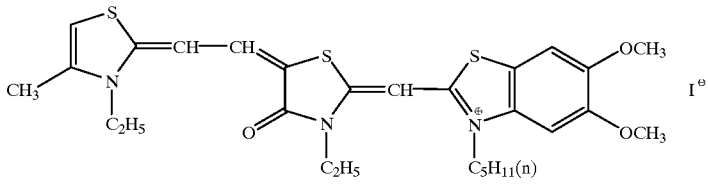

-continued
S2-6
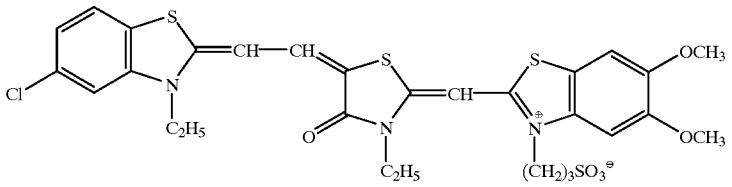
S2-7
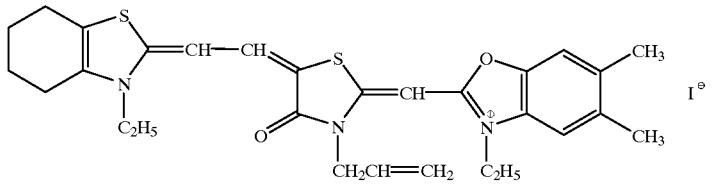
S2-8
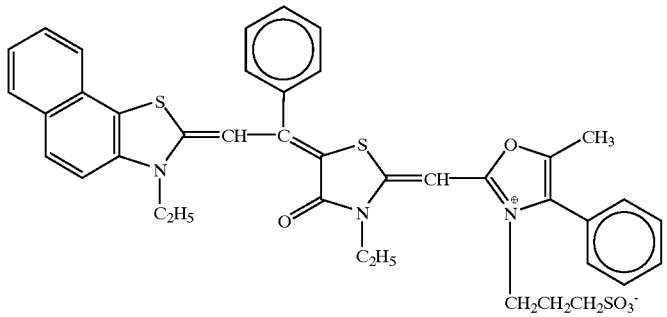
For LED and red semiconductor laser light sources, the dyes illustrated below are particularly suitable.
S3-1
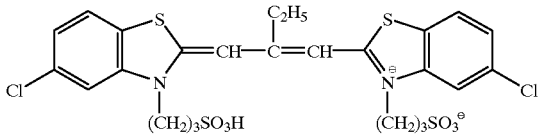
S3-2
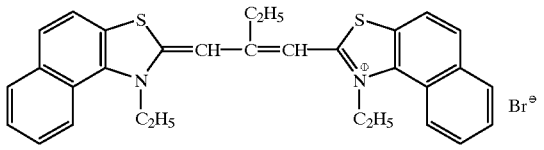
S3-3
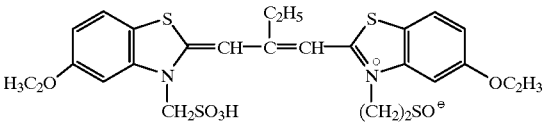
S3-4
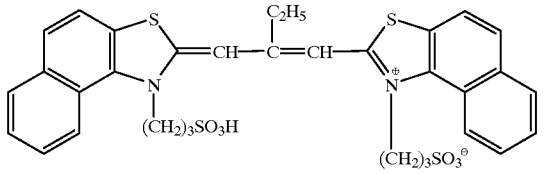
-continued
S3-5
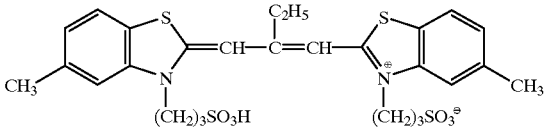
S3-6
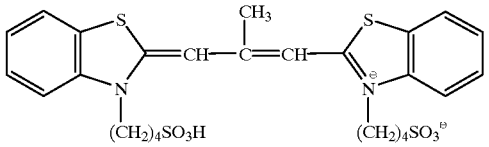
S3-7
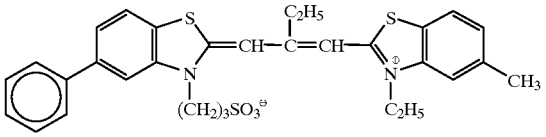
S3-8
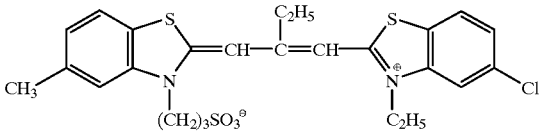
For an infrared semiconductor laser light source, the dyes illustrated below are particularly suitable.

S4-1
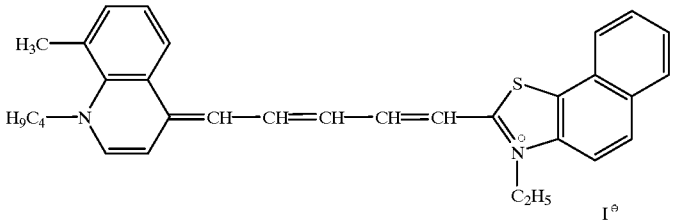
S4-2
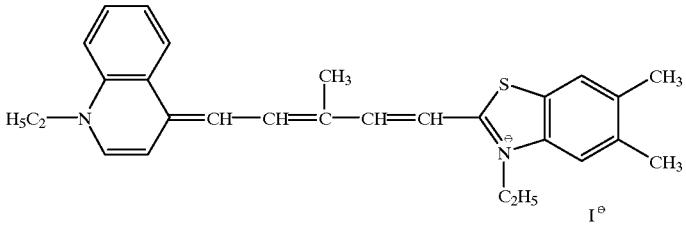
S4-3
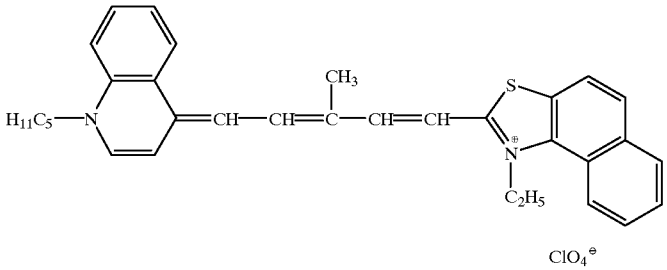
S4-4
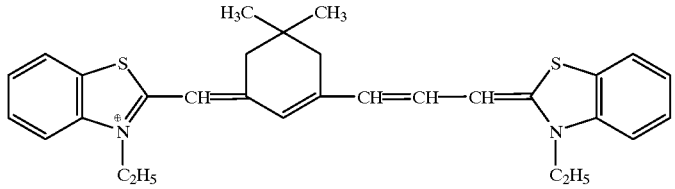
S4-5
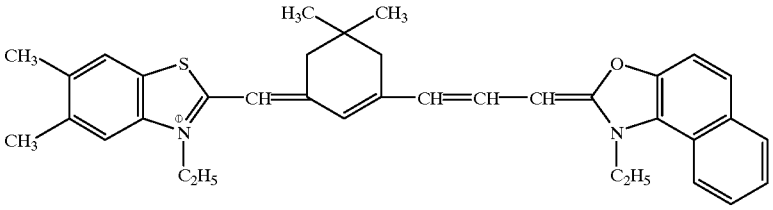
S4-6
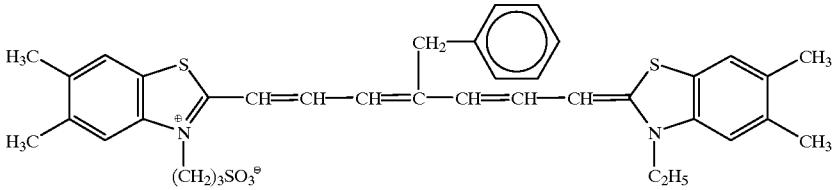

-continued
S4-7
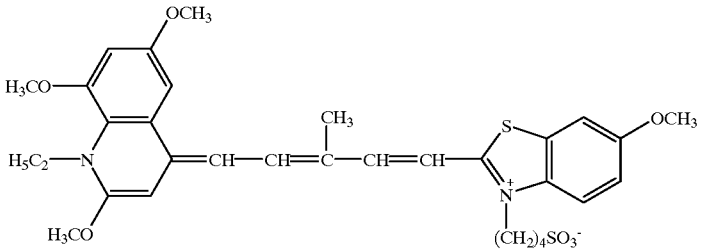
S4-8
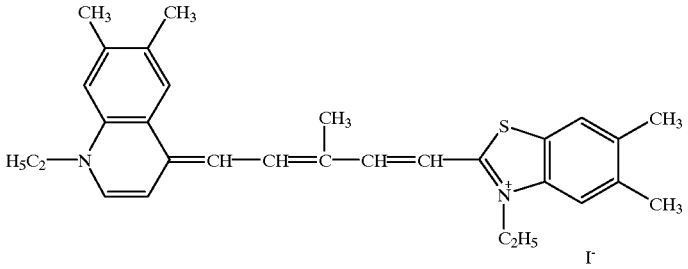
S4-9
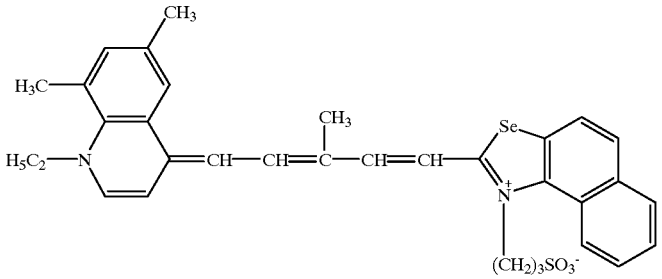
For a white light under which photographs are taken with a camera, the sensitizing dyes represented by general formula (IV) in Japanese Patent Application No. 5-201254 (from page 20, 14th line, to page 22, 23rd line) are suitable. Specific examples thereof are illustrated below.
S5-1
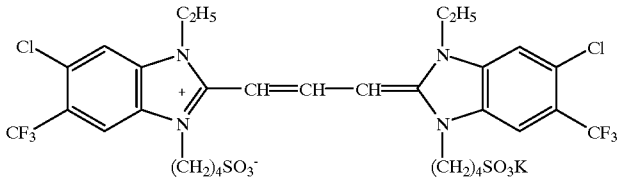
S5-2
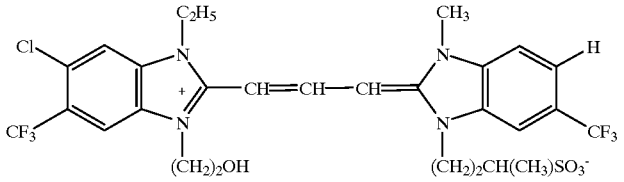
S5-3
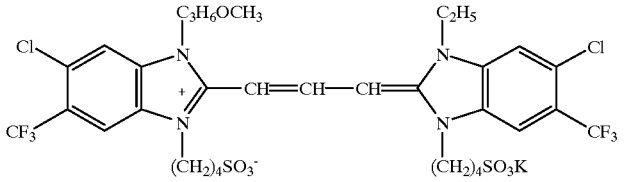

-continued
S5-4
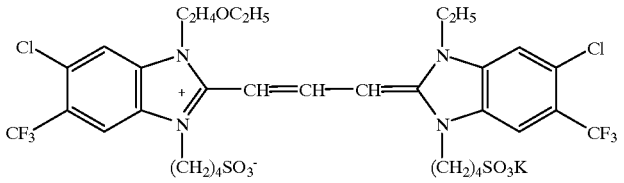
S5-5
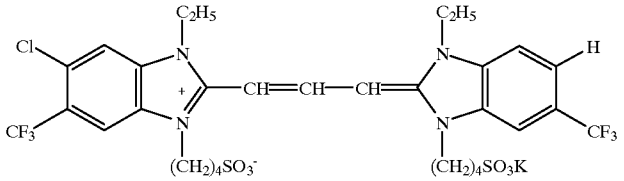
S5-6
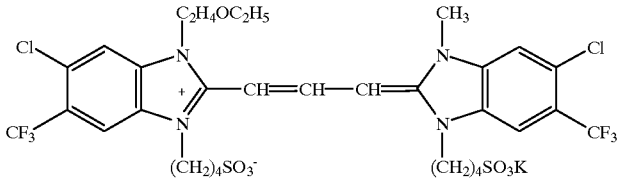
S5-7
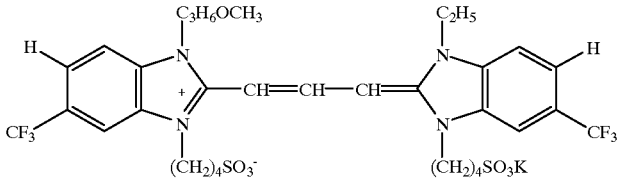
S5-8
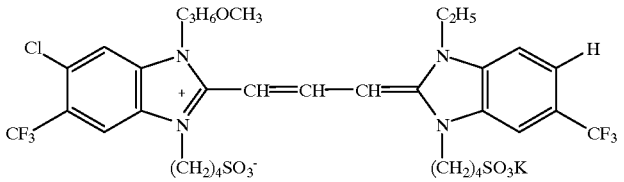
S5-9
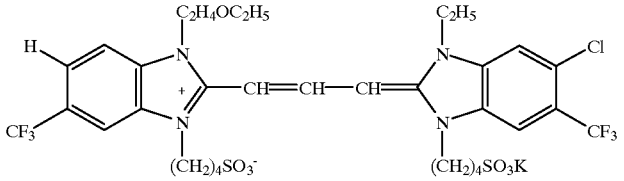
S5-10
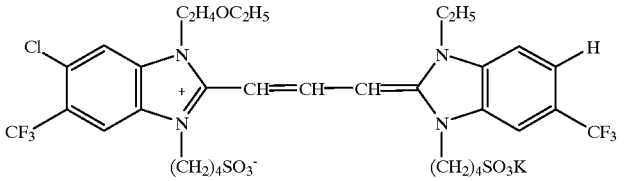
S5-11
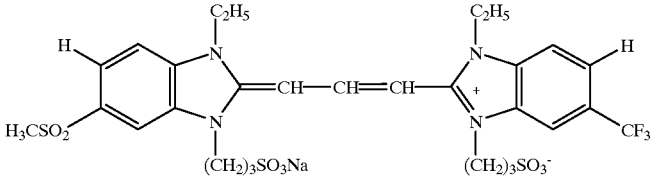

-continued
S5-12
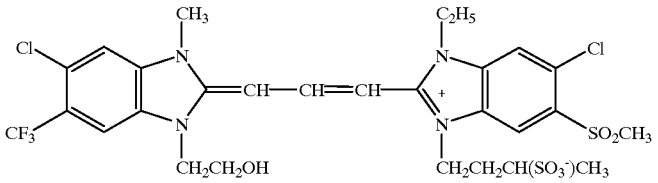
S5-13
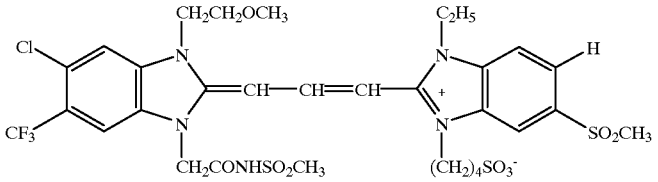
S5-14
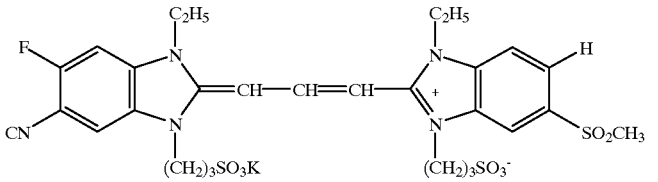
S5-15
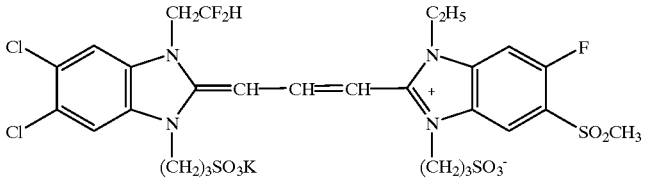
S5-16
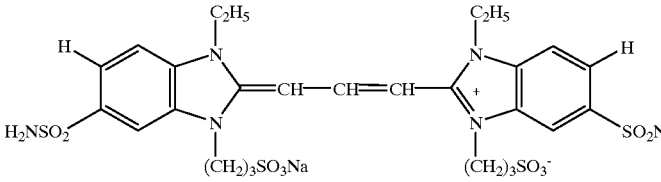
S5-17
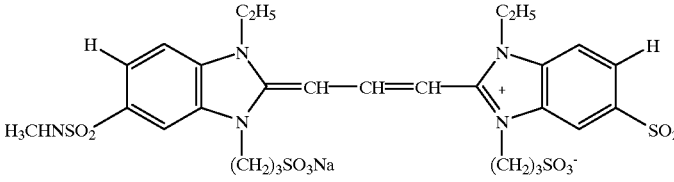
S5-18
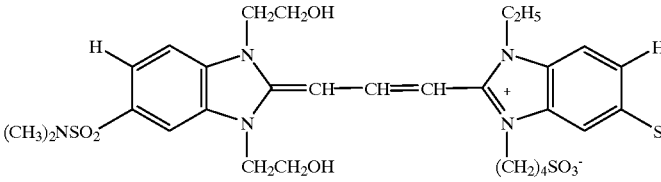
S5-19
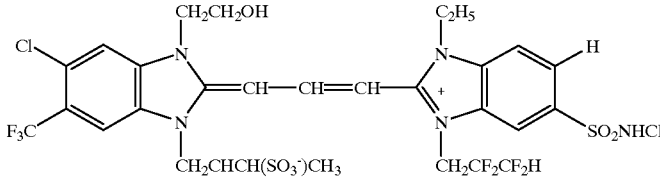

-continued

S5-20

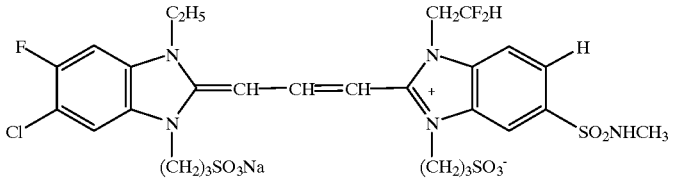

Detailed description of the developer for use in the present invention is given below.

The developer for use in the present invention may contain additives which are generally used in developing a light-sensitive method. The development processing in the present invention may be carried out according to any of known methods.

The developer for use in the present invention, as stated above, does not contain, in a substantial sense, dihydroxybenzenes as a developing agent, but contains the compound represented by formula (VI) as a main developing agent. In addition, it is preferable that the developer of the present invention contain 1-phenyl-3-pyrazolidones and/or p-aminophenols as auxiliary developing agents.

The compound represented by formula (VI) which is used as a developing agent in the present invention is illustrated below in detail.

In formula (VI), $R_{12}$ and $R_{13}$ are the same or different and each represents a hydroxyl group, an amino group (which may be substituted by one or more alkyl groups having from 1 to 10 carbon atoms, such as methyl, ethyl, n-butyl and hydroxyethyl), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), an alkoxysulfonylamino group (e.g., methoxysulfonylamino), an alkocycarbonylamino group (e.g., methoxycarbonylamino), a mercapto group, or an alkylthio group (e.g., methylthio, ethylthio). Of these groups, a hydroxyl group, an amino group, an alkylsulfonylamino group and an arylsulfonylamino group are preferred as $R_{12}$ and $R_{13}$.

P and Q are the same or different and each represents a hydroxyl group, a hydroxyalkyl group, a carboxyl group, a carboxyalkyl group, a sulfo group, a sulfoalkyl group, an amino group, an aminoalkyl group, an alkyl group, an alkoxy group, an aryl group or a mercapto group, or P and Q represent atoms capable of forming a 5- to 7-membered ring by combined with each other and further by associating with two vinyl carbons to which $R_{12}$ and $R_{13}$ are attached respectively and one carbon atom to which Y is attached. Examples of the ring formed include those completed by combining moieties chosen from —O—, —C($R_{26}$)($R_{27}$)—, —C($R_{28}$)═, —C(═O)—, —N($R_{29}$)— and —N═. $R_{26}$, $R_{27}$, $R_{28}$ and $R_{29}$ each represents a hydrogen atom, an alkyl group having from 1 to 10 carbon atoms, which may have a substituent (e.g., hydroxyl, carboxyl, sulfo), a hydroxyl group or a carboxyl group. Further, the 5- to 7-membered ring may be fused together with a saturated or unsaturated ring to form a condensed ring.

Specific examples of the 5- to 7-membered ring include a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring and a uracil ring. Preferred examples of the 5- to 7 -membered rings include a dihydrofuranone ring, a cyclopentenone ring, a cyclohexenone ring, a pyrazolinone ring, an azacyclohexenone ring and a uracil ring.

Y represents ═O or ═N—$R_{30}$, wherein $R_{30}$ represents a hydrogen atom, a hydroxyl group, an alkyl group (e.g., methyl, ethyl), an acyl group (e.g., acetyl), a hydroxyalkyl group (e.g., hydroxymethyl, hydroxyethyl), a sulfoalkyl group (e.g., sulfomethyl, sulfoethyl) or a carboxyalkyl group (e.g., carboxymethyl, carboxyethyl).

Specific examples of the compounds represented by formula (VI) are illustrated below. However, the invention should not be construed as being limited to these examples.

VI-1

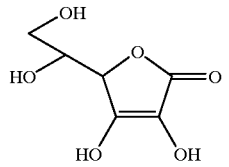

VI-2

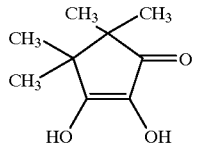

VI-3

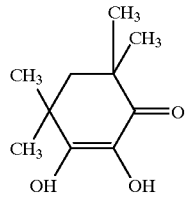

VI-4

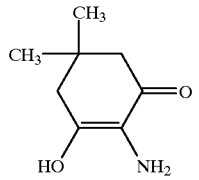

VI-5

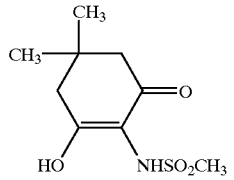

VI-6

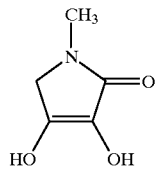

-continued
VI-7
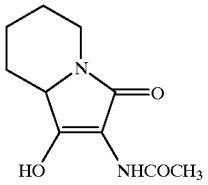
VI-8
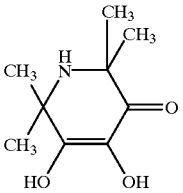
VI-9
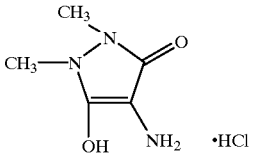
VI-10
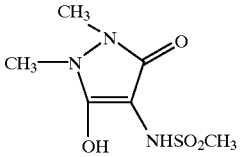
VI-11
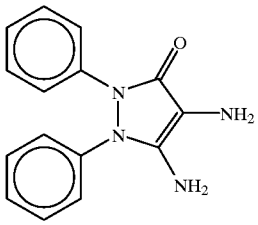
VI-12
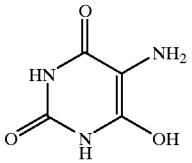
VI-13
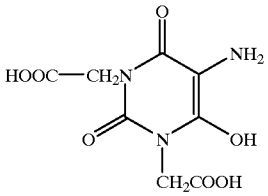
VI-14
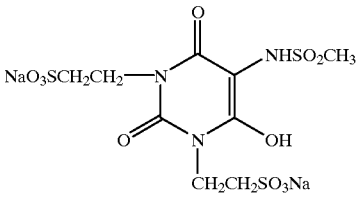
-continued
VI-15
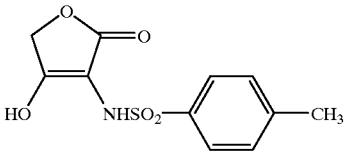
VI-16
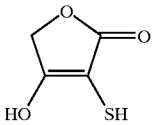
VI-17
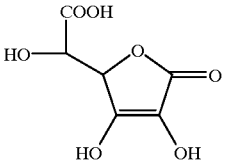
VI-18
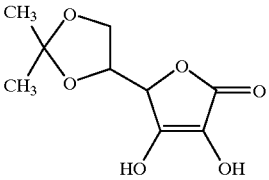
VI-19
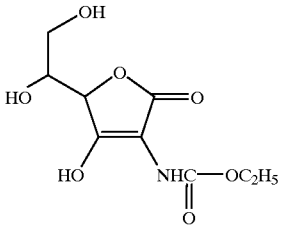
VI-20
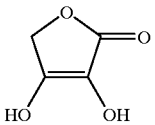
VI-21
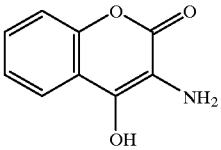
VI-22
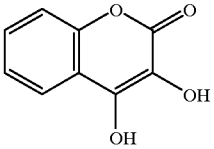
VI-23
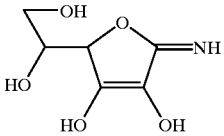

-continued

VI-24

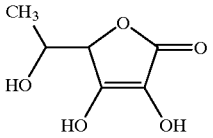

VI-25

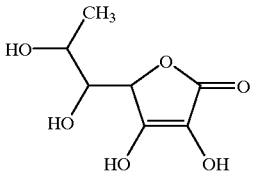

VI-26

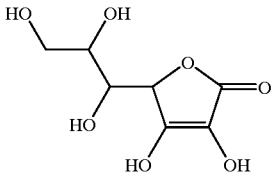

VI-27

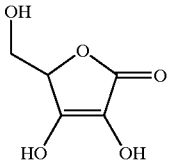

VI-28

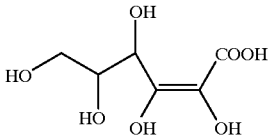

VI-29

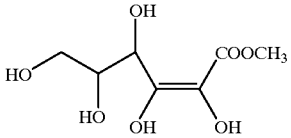

VI-30

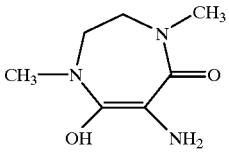

VI-31

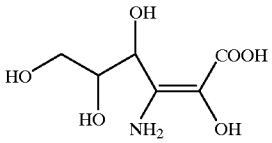

Of these compounds, ascorbic acid and erythrorbic acid (its stereoisomer) are preferred.

The compound represented by formula (VI) is generally used in an amount of from $5\times10^{-3}$ to 1 mol, more preferably from $10^{-2}$ to 0.5 mol, per liter of developer.

Auxiliary developing agents may be added to the developer for use in the present invention. Examples thereof include 3-pyrazolidones (e.g., 1-phenyl-3-pyrazolidone, 1-phenyl-4-methyl-3-pyrazolidone, 1-phenyl-5-methyl-3-pyrazolidone, 1-phenyl-4-ethyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone, 3-acetoxy-1-phenyl-3-pyrazolidone, 1-p-aminophenyl-4,4-dimethyl-3-pyrazolidone,1-p-tolyl-4-methyl-4-hydroxydimethyl-3-pyrazolidone), 3-aminopyrazolines (e.g., 1-(p-hydroxyphenyl)-3-aminopyrazoline, 1-(p-methylaminophenyl)-3-aminopyrazoline, 1-(p-amino-m-methylphenyl)-3-aminopyrazoline), and phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline).

Furthermore, aminophenols can be used as an auxiliary agent to obtain a high-contrast image. Examples thereof include 4-aminophenol, 4-amino-3-methylphenol, 4-(N-methyl)aminophenol, 2,4-diaminophenol, N-(4-hydroxyphenyl)glycine, N-(2'-hydroxyethyl)-2-aminophenol, 2-hydroxymethyl-4-aminophenol, 2-hydroxymethyl-4-(N-methyl)aminophenol, 2-methyl-p-aminophenol, and p-benzylaminophenol; hydrochlorides thereof; and sulfates thereof.

When the compound represented by formula (VI) and an auxiliary developing agent are used in combination, the auxiliary developing agent is used in an amount of from $5\times10^{-4}$ to 0.5 mol, preferably from $10^{-3}$ to 0.1 mol, per liter of a developer.

The expression "containing no dihydroxybenzenes developing agent" as used in the present invention means that the concentration of dihydroxybenzenes in the developer is negligible, compared with those of the compound represented by formula (VI) and the foregoing auxiliary developing agents (for example, $5\times10^{-4}$ mol/l or less). It is preferable for the developer of the present invention to be completely free from dihydroxybenzenes.

To the developer of the present invention, there may be added sulfites as preservatives, such as sodium sulfite, potassium sulfite, lithium sulfite, sodium hydrogen sulfite, potassium hydrogen sulfite, potassium metabisulfite and formaldehyde sodium bisulfite. Such sulfites are used in an amount of from 0.01 to 0.5 mol per liter of a developer. However, the addition amount thereof should be minimized so far as it can satisfy the need. This is because the addition thereof in a large amount causes the dissolution of silver halide emulsion grains to generate silver stain, and further it is responsible for raising COD (chemical oxygen demand).

The quaternary onium salts used in the developer of the present invention will be described in detail.

The quaternary onium salts for use in the present invention are preferably represented by the following formulae (VII), (VIII) and (IX).

(VII)

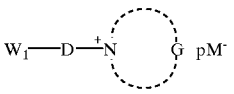

-continued (VIII)

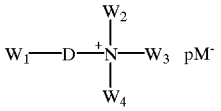

(IX)

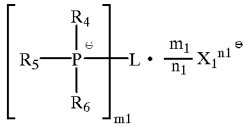

In formulae (VII) and (VIII), G represents an atomic group necessary for forming a heterocyclic ring; D represents a single bond or a divalent linkage group; $W_1$ represents an alkyl group having from 1 to 10 carbon atoms or the following formula (X) or (XI);

(X)

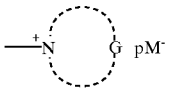

(XI)

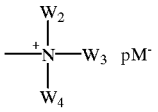

$W_2$, $W_3$ and $W_4$ each represents an alkyl group having from 1 to 8 carbon atoms; M represents an anion; and p represents 1 or 2.

Examples of the heterocyclic ring formed by G include pyridine, pyrimidine, pyrazone, quinoline, pyrazole, imidazole, 1,2,4-triazole, benzimidazole, indole, imidazoline, pyperadine, morpholine and

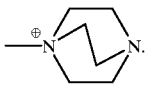

The heterocyclic ring may have a substituent other than $W_1$ or —D—, and examples thereof include an alkyl group, an aryl group or the following group (VII'):

(VII')

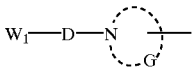

In particularly, the heterocyclic group have group (VII') as a substituent, two $W_1$ groups may be combined with each other, or other substituents may be combined with each other. The alkyl group represented by $W_1$ may have a substituent, and examples thereof include a methyl group, an ethyl group, a propyl group, an isopropyl group, a decyl group, a dodecyl group, a hexadecyl group, a hydroxyethyl group, a benzyl group, a p-nitrobenzyl group and an allylmethyl group. The alkyl group represented by $W_2$ to $W_4$ may have a substituent, and examples thereof include a methyl group, an ethyl group, a propyl group and an octyl group. The divalent group represented by D include a methylene group, an ethylene group, a propylene group, and the following groups.

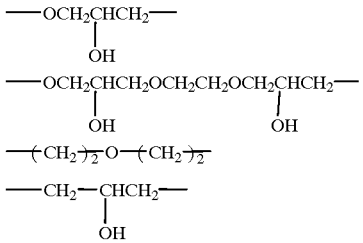

Examples of the anion represented by M include a chlorine ion, a bromine ion, an inodine ion and a p-toluenesulfonate ion. Particularly preferred is a bis type quaternary salt compound.

The compound represented by formula (IX) has the same structure as the compound represented by formula (II), with the proviso that they may be the same or different. Specific examples of the compound represented by formula (IX) are the same as those recited for formula (II).

Specific examples of the compounds represented by formulae (VII) and (VIII) are illustrated below, but the present invention is not limited thereto.

(1)

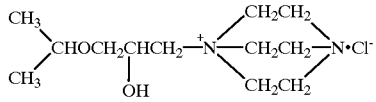

(2)

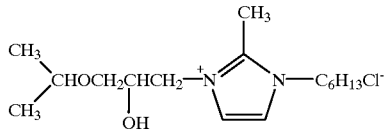

(3)

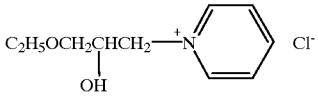

(4)

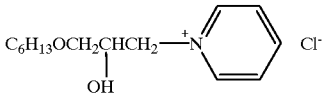

(5)

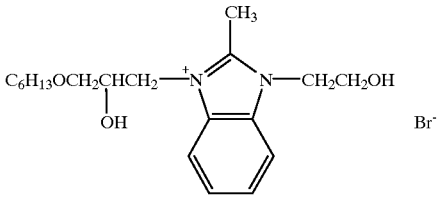

(6)

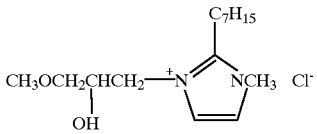

-continued
(7)
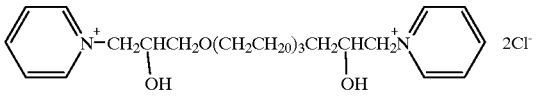
(8)
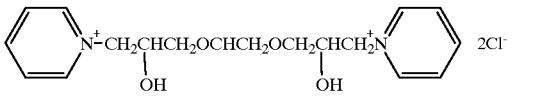
(9)
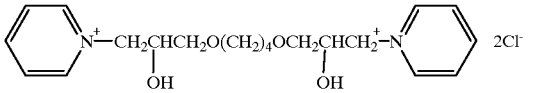
(10)
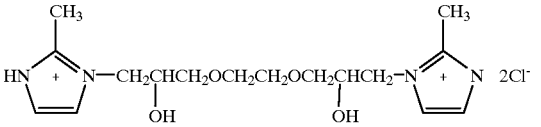
(11)
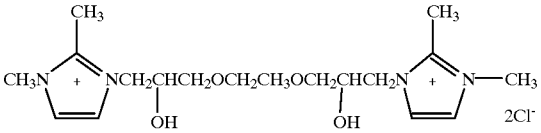
(12)
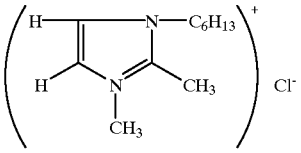
(13)
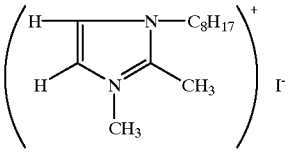
(14)
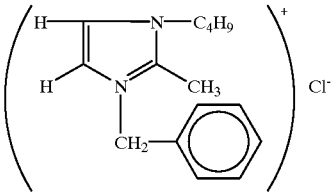
(15)
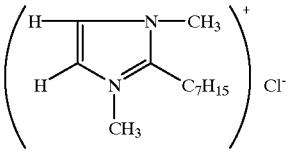
-continued
(16)
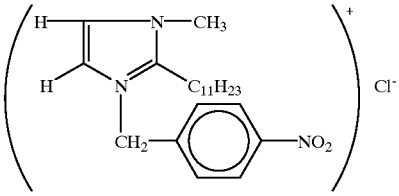
(17)
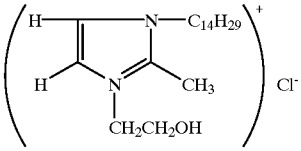
(18)
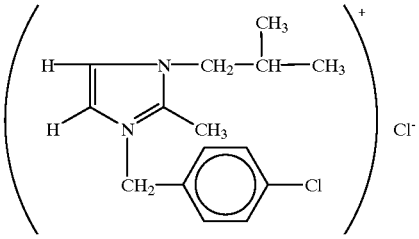
(19)
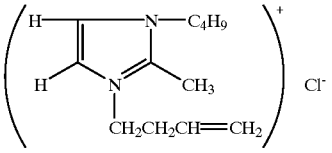
(20)
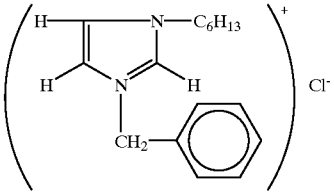
(21)
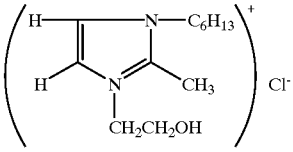
(22)
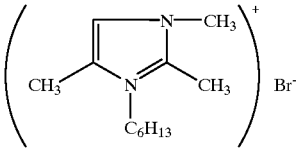
(23)
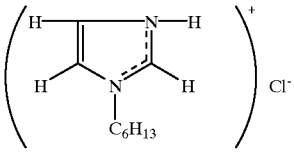

-continued
(24)
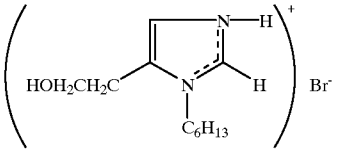
(25)
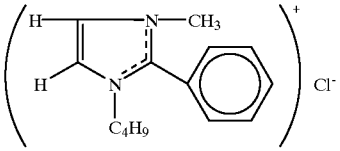
(26)
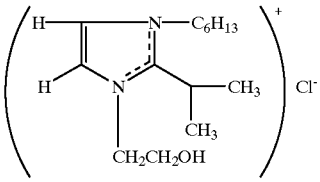
(27)
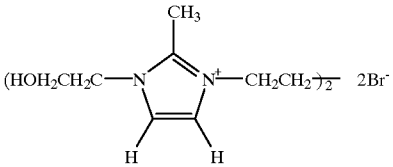
(28)
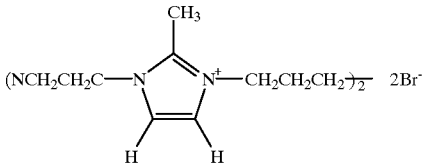
(29)
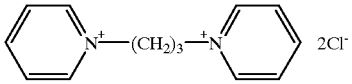
(30)
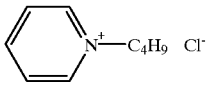
(31)
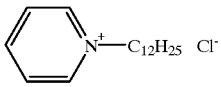
(32)
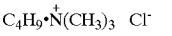
(33)
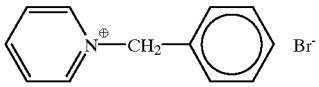
(34)
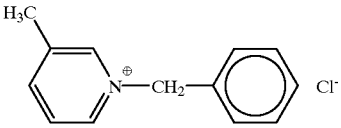
-continued
(35)
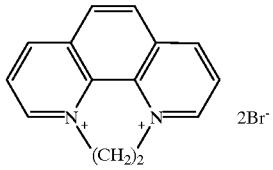
(36)
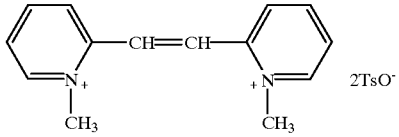
(37)
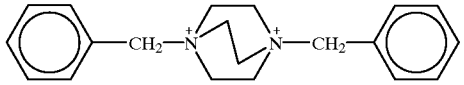
(38)
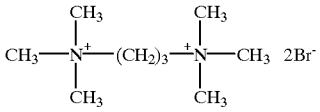
(39)
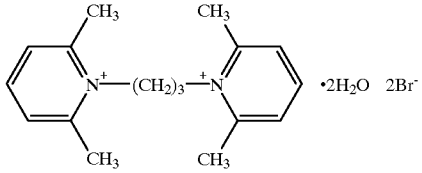
(40)
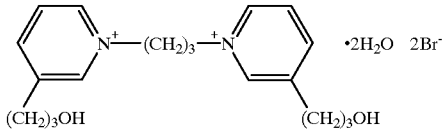
(41)
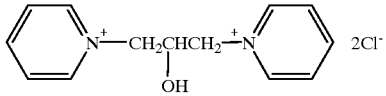
(42)
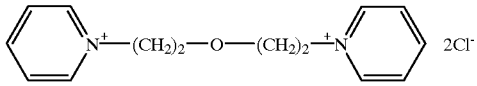
(43)
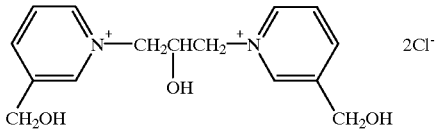
(44)
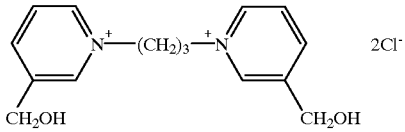

-continued (45)

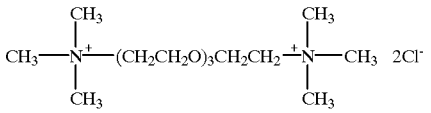

The quaternary onium salt of the present invention is preferably used in an amount of from 0.01 to 10 mmol, more preferably from 0.05 to 2 mmol.

Water-soluble inorganic alkali metal salts (e.g., sodium hydroxide, potassium hydroxide, sodium carbonate, potassium carbonate) which are generally used can be used as an alkali agent to adjust a pH value.

Examples of additives added to the developer of the present invention include a development inhibitior (e.g., sodium bromide, potassium bromide), an organic solvent (e.g., ethylene glycol, diethylene glycol, triethylene glycol, dimethylformamide), an alkanolamine (e.g., diethanolamine, triethanolamine), a development accelerator (e.g., imidazol, derivatives thereof), and an antifoggant or black pepper (black spot) inhibitor (e.g., mercapto compound, indazole compound, benzotriazole compound, benzimidazole compound). Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole and 2-mercaptobenzotriazole. The addition amount of the antifoggant is from 0.01 to 10 mmol, more preferably from 0.05 to 2 mmol, per liter of the developer.

Further, various kinds of organic and inorganic chelating agents can be used in combination in the developing solution of the present invention. Examples of the inorganic chelating agents include sodium tetrapolyphosphate and sodium hexametaphosphate.

Examples of the organic chelating agents include organic carboxylic acid, aminopolycarboxylic acid, organic phosphonic acid, aminophosphonic acid, and organic phosphonocarboxylic acid.

Examples of the organic carboxylic acids include acrylic acid, oxalic acid, malonic acid, succinic acid, glutaric acid, adipic acid, pimelic acid, suberic acid, acielaidic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acids include iminodiacetic acid, nitrilotriacetic acid, nitrilotripropionic acid, ethylenediaminomonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminotetraacetic acid, and compounds disclosed in JP-A-52-25632, JP-A-55-67747, JP-A-57-102624, and JP-B-53-40900.

Examples of the organic phosphonic acids include hydroxyalkylidene-diphosphonic acid disclosed in U.S. Pat. Nos. 3,214,454, 3,794,591 and German Patent Publication No. 2,227,639, and the compounds disclosed in *Research Disclosure,* Vol. 181, Item 18170 (May, 1979).

Examples of the aminophosphonic acids include aminotris(methylenephosphonic acid), ethylenediaminotetramethylenephosphonic acid, aminotrimethylenephosphonic acid, and the compounds disclosed in *Research Disclosure,* No. 18170, JP-A-57-208554, JP-A-54-61125, JP-A-55-29883 and JP-A-56-97347.

Examples of the organic phosphonocarboxylic acids include the compounds disclosed in JP-A-52-102726, JP-A-53-42730, JP-A-54-121127, JP-A-55-4024, JP-A-55-4025, JP-A-55-126241, JP-A-55-65955, and *Research Disclosure,* No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developer.

Furthermore, the developer for use in the present invention can contain the compounds disclosed in JP-A-56-24347, JP-B-56-46585, JP-B-62-2849, and JP-A-4-362942 as a silver stain inhibitor.

Also, the developer for use in the present invention can contain the compounds disclosed in JP-A-62-212651 as a development unevenness inhibitor, and the compounds disclosed in JP-A-61-267759 as a dissolving aid.

Moreover, the developer may contain a color toning agent, a surfactant, an antifoaming agent, and a hardener, if needed.

The developer for use in the present invention may contain carbonates, boric acids such as boric acid, borax, methaboric acid, potassium boric acid as disclosed in JP-A-62-186259, saccharides (e.g., saccharose) as disclosed in JP-60-93433, oximes (e.g., acetoxime), phenols (e.g., 5-sulfosalicylic acid), tertiary phosphates (e.g., sodium tertiary phosphate, potassium tertiary phosphate) or aluminum salts (e.g., sodium salt) as a buffer. The carbonates and borates are preferred as a buffer.

Preferably, the developer for use in the present invention contains a carbonate in an amount of 0.5 mol/l or more, more preferably from 0.5 to 1.5 mol/l.

If the silver halide photographic material containing a hydrazine derivative represented by formula (I) and a compound selected from the compounds represented by formula (II), (III), (IV) or (V) and an amine compound acting as an internal nucleating accelerator is developed, the developer preferably has a pH value of from 9.5 to 11.0, and more preferably from 9.8 to 11.0.

On the other hand, if the silver halide photographic material containing a hydrazine derivative represented by formula (I) and a compound represented by formula (N-I) is developed, the developer preferably has a pH value of 10.0 or less, more preferably from 8.5 to 10.0, and particularly preferably from 9.0 to 10.0.

The developer for use in the present invention can contain various additives, if needed, in addition to the above described components, for example, a buffer (e.g., carbonate, alkanolamine), an alkali agent (e.g., hydroxide, carbonate), an auxiliary solvent (e.g., polyethylene glycols, esters thereof), a pH adjustor (e.g., organic acid such as acetic acid), a development accelerator (e.g., pyridinium compounds and other cationic compounds, cationic dyes such as phenosafranine, neutral salts such as thallium nitrate and potassium nitrate as disclosed in U.S. Pat. No. 2,648,604, JP-B-44-9503, and U.S. Pat. No. 3,171,247, polyethylene glycol and derivatives thereof, nonionic compounds such as polythioethers as disclosed in JP-B-44-9304, U.S. Pat. Nos. 2,533,990, 2,531,832, 2,950,970 and 2,577,127, organic solvents as disclosed in JP-B-44-9509 and Belgian Patent 682,862, thioether based compounds as disclosed in U.S. Pat. No. 3,201,242, and thioether based compounds are particularly preferred of them), and a surfactant.

The development processing temperature and the development processing time are related reciprocally and determined in relationship with the total processing time, and generally the processing temperature is from about 20 to 50° C., preferably from 25 to 45° C., and the processing time is from 10 seconds to 2 minutes, preferably from 7 seconds to one minute and 30 seconds.

If $m^2$ of a silver halide black-and-white photographic material is processed, the replenishment rate of the developing solution is 500 ml or less and preferably 400 ml or less.

Preferably, the processing solution is concentrated for preservation and is diluted when it is used in order to save the transportation cost, package material cost and spaces. The salt component contained in the developer is preferably a potassium salt to concentrate the developer.

The fixing solution for use in the fixing step in the present invention is an aqueous solution containing sodium thiosulfate and ammonium thiosulfate, and if needed, tartaric acid, citric acid, gluconic acid, boric acid, iminodiacetic acid, 5-sulfosalicylic acid, glucohepatnic acid, Tiron, ethylenediamine tertaacetic acid, diethylenetriamine pentaacetic acid, nitrilo triacetic acid, and salts thereof. However, it is preferred that the boric acid is not contained in view of the environmental preservation.

Examples of the fixing agent in the fixing solution for use in the present invention include sodium thiosulfate and ammonium thiosulfate. The sodium thiosulfate is preferred in view of the fixing velocity and the sodium thioammonium is preferred in view of the environmental preservation. The amount added of the fixing agent is not particularly limited, but is generally from about 0.1 to 2 mol/l, and particularly preferably from 0.2 to 1.5 mol/l.

The fixing solution can include, if needed, a hardening agent (e.g., water-soluble aluminum compound), a preservative (e.g., sulfite, bisulfite), a pH buffer (e.g., acetic acid), a pH adjustor (e.g., ammonia, sulfuric acid), a chelating agent a surfactant, a wetting agent, and a fixing accelerator.

Examples of the surfactant include an anionic surfactant (e.g., sulfated product, sulfonated product), a polyethylene surfactant, and amphoteric surfactants disclosed in JP-A-57-6840, and known defoaming agents can also be used. Examples of the wetting agent include alkanolamine and alkylene glycol. Examples of the fixing accelerator include thiourea derivatives disclosed in JP-B-45-35754, JP-B-58-122535 and JP-B-58-122536, alcohol having a triple bond in the molecule, thioether compounds disclosed in U.S. Pat. No. 4,126,459, mesoionic compounds disclosed in JP-A-4-229860, and compounds disclosed in JP-A-2-44355.

Examples of the pH buffer for use in the fixing solution include an organic acid such as acetic acid, malic acid, succinic acid, tartaric acid, citric acid, maleic acid, glycol acid and adipic acid, an inorganic acid such as boric acid, phosphate and sulfite. Among these, preferred are acetic acid, tartaric acid, and sulfite.

The pH buffer is used so as to inhibit the pH increase of the fixing solution by incorporation of the developer. The pH buffer is used in an amount of from 0.01 to 1.0 mol/l, preferably from 0.02 to 0.6 mol/l.

The pH of the fixing solution is preferably from 4.0 to 6.5, more preferably from 0.02 to 0.6 mol/l.

As a dye dissolution accelerator, the compounds disclosed in JP-A-64-4739 can be used.

As a hardener in the fixing solution for use in the present invention, water-soluble aluminum salts and chromium salts are used. The water-soluble ammonium salt is preferred and examples thereof include aluminum chloride, aluminum sulfate and potassium alum. The amount added of the pH buffer is preferably from 0.01 to 0.2 mol, more preferably from 0.03 to 0.08 mol, per liter of the fixing solution.

The fixing temperature is from about 20 to 50° C., preferably from 25 to 45° C.; and the fixing time is from 5 seconds to one minute, preferably from 7 to 50 seconds.

The replenishing amount of the fixing solution is preferably 600 ml or less, more preferably 500 ml or less, per $m^2$ of the processed light-sensitive material.

In the photographic processing method of the present invention, the photographic material is processed with washing water or a stabilizing solution after the development and fixation steps, and then dried. It is possible to perform the washing or stabilizing step using washing water or a stabilizing solution at a replenishment rate of at most 3 liter of a replenisher per $m^2$ of silver halide photographic material (including the replenishment rate of zero, namely the washing with stored water). That is, not only economizing water in the washing step but also making a piping work unnecessary in setting up an automatic developing machine becomes possible.

As a method for reduction in replenishment of washing water, the multistage (e.g., two-stage or three-stage) counter current process has been known for a long time. If this process is applied to the present invention, the fixation-processed photographic material is processed as it is brought into contact with successive, more and more cleaned processing solutions, that is, processing solutions less and less contaminated with the fixer. Accordingly, more efficient washing can be carried out.

When the washing step is performed with a small amount of water, it is preferable to use a washing tank equipped with squeeze rollers or crossover rollers, as disclosed in JP-A-63-18350 and JP-A-62-287252. Further, the addition of various kinds of oxidizing agents and the filtration may be supplemented for the purpose of reduction in pollution load. An increase in pollution load is a big problem that the washing with little water faces.

In the present invention also, part or all of the overflow generated from the washing or stabilizing bath by replenishing the bath with the water, which is rendered moldproof by the above-cited means, in proportion as the processing proceeds can be used in the prior step wherein the processing solution having a fixability is used, as described in JP-A-60-235133.

Moreover, a water-soluble surfactant or a defoaming agent may be included in washing water to prevent generation of irregular foaming which is liable to generate when washing is conducted with a small amount of water and/or to prevent components of the processing agents adhered to a squeegee roller from transferring to the processed film.

In addition, dye adsorbents disclosed in JP-A-63-163456 may be included in a washing tank to inhibit contamination by dyes dissolved from photographic materials.

When a photographic material is subjected to stabilizing processing after the washing processing, bath containing compounds disclosed in JP-A-2-201357, JP-A-2-132435, JP-A-1-102553 and JP-A-46-44446 may be used as a final bath. This stabilizing bath may contain, if needed, ammonium compounds, metal compounds such as Bi and Al, brightening agents, various kinds of chelating agents, film pH adjustors, hardening agents, sterilizers, antimold agents, alkanolamines, and surfactants. Tap water, deionized water, and water sterilized by a halogen, ultraviolet sterilizing lamp or various oxidizing agents (e.g., ozone, hydrogen peroxide, chlorate) or tap water containing the compounds disclosed in JP-A-4-39652 and JP-A-5-241309 are preferably used as washing water in a washing step or a stabilizing step.

The temperature and time of the washing and stabilizing bath processing are preferably from 0 to 50° C. and from 5 seconds and 2 minutes.

The processing solution used in the present invention is preferably stored in a package material slightly pervious to oxygen as disclosed in JP-A-61-73147.

The processing solution for use in the present invention may form a powder agent or a solid material. The formation may be carried out by known methods, and the methods disclosed in JP-A-61-259921, JP-A-4-85533 and JP-A-16841 are preferred, and the method disclosed in JP-A-61-2559921 is particularly preferred.

When the replenishing amount is lowered, the evaporation and air oxidation of the solution are inhibited by reducing the contact area of the solution and the air of the solution tank. Automatic developing machines of roller conveyance type are described in, e.g., U.S. Pat. Nos. 3,025,779 and 3,545,971, and the present invention refers them to simply as processors of roller conveyance type. A processor of roller conveyance type involves four processes, namely development, fixation, washing and drying processes. Also, it is most advantageous for the present method to follow those four processes, although the present method does not exclude other processes (e.g., stop process). The four processes may contain a stabilizing step in place of the washing step.

The photographic materials of the present invention are not particularly restricted as to additives, and so various kinds of additives can be used therein. However, those disclosed in the following patent specifications can be preferably added thereto.

| Item | Reference and Passage therein |
|---|---|
| 1) Surfactants | JP-A-2-12236, at page 9, from right upper column, line 7, to right lower column, line 7; and JP-A-2-185424, from page 2, left lower column, line 13, to page 4, right lower column, line 18. |
| 2) Antifoggants | JP-A-2-103536, from page 17, right lower column, line 19, to page 18, right upper column, line 4, and page 18, right lower column, from line 1 to line 5; the thiosulfinic acid compounds disclosed in JP-A-1-237538. |
| 3) Polymer latexes | JP-A-2-103536, page 18, left lower column, from line 6 to line 20. |
| 4) Compounds containing an acidic group | JP-A-2-103536, from page 18, left lower column, line 6, to page 19, left upper column, line 1. |
| 5) Matting agents, Slipping agents, and Plasticizers | JP-A-2-103536, at page 19, from left upper column, line 15, to right upper column, line 15. |
| 6) Hardeners | JP-A-2-103536, at page 18, right upper column, from line 5 to line 17. |
| 7) Dyes | JP-A-2-103536, at page 17, right lower column, from line 1 to line 18; the solid dyes disclosed in JP-A-2-294638 and JP-A-5-11382. |
| 8) Binders | JP-A-2-18542, at page 3, right lower column, from line 1 to line 20. |
| 9) Black spot inhibitors | The compounds disclosed in U.S. Pat. 4,956,257 and JP-A-1-118832. |

-continued

| Item | Reference and Passage therein |
|---|---|
| 10) Monomethine compounds | The compounds represented by formula (II) in JP-A-2-287532 (especially Exemplified Compounds II-1 to II-26). |
| 11) Dihydroxybenzenes | The compounds disclosed in JP-A-3-39948, from page 11, left upper column to page 12, left lower column, and those disclosed in EP-A-452772. |
| 12) Nucleation accelerators | The compounds represented by formulae (I), (II), (III), (IV) (V) and (VI) disclosed in JP-A-6-82943; the compounds represented by formulae (II-m) to (II-p), and Exemplified Compounds II-1 to II-22, disclosed in JP-A-2-103536, from page 9, right upper column, line 13, to page 16, left upper column, line 10; the compounds disclosed in JP-A-1-179939. |
| 13) Silver halide emulsions and processes producing them | Selenium sensitizing method disclosed in JP-A-2-103536, from page 20, right lower column, line 12 to page 21, left lower column, line 14; JP-A-2-12236, page 7, right upper column, line 19 to page 8, left lower column, line 12; and JP-A-5-11389. |
| 14) Spectral sensitizing dyes | Spectral sensitizing dyes disclosed in JP-A-2-12236, from page 8, left lower column, line 13 to right lower column, line 4; JP-A-2-103536, from page 16, right lower column, line 3 to page 17, left lower column, line 20; JP-A-1-112235; JP-A-2-124560; JP-A-3-7928; and JP-A-5-11389. |
| 15) Redox compounds | The compounds represented by formula (I) disclosed in JP-A-2-301743 (especially Compounds 1 to 50); the compounds represented by formulae (R-1), (R-2) and (R-3), Exemplified Compounds 1 to 75, disclosed at pages 3 to 20 in JP-A-3-174143; the compounds disclosed in JP-A-5-257239 and JP-A-4-278939. |

The present invention will now be illustrated in greater detail by reference to the following examples. However, the invention should not be construed as being limited to these examples.

EXAMPLES

First, how to prepare a silver halide emulsion used in the following examples will be explained.

Emulsion A

An aqueous 0.13 M silver nitrate solution and an aqueous halide solution containing $K_2Rh(H_2O)Cl_5$ in an amount corresponding to $1.5\times10^{-7}$ mol per mol of silver, $K_3IrCl_6$ in an amount of $2\times10^{-7}$ mol per mol of silver, 0.04 M potassium bromide and 0.09 M sodium chloride were added to an aqueous gelatine solution containing sodium chloride and 1,3-dimethyl-2-imidazolidinethione with stirring at 38° C. over a period of 12 minutes according to a double jet method to carry out the nucleating. This gave salt silver bromide particles having an average particle size of 0.14 $\mu$m and salt silver chloride content of 70 mol %. Subsequently, an aqueous 0.87 M silver nitrate solution and an aqueous halide solution containing 0.26 M potassium bromide and 0.65 M sodium chloride were similarly added according to the double jet method over a period of 20 minutes.

Thereafter, a $1\times10^{-3}$ mol KI solution was added to carry out conversion, and the solution was washed with water by a flocculation method according to the conventional method using a copolymer of isobutene and monosodium salt of maleic acid as a settling agent. Then, 40 g of gelatine was added per mol of silver to adjust the pH to 6.5 and pAg to 7.5. Then, 7 mg of sodium benzenesulfonate, 2 mg of sodium benzenefulfinate, and 5 mg of sodium thiosulfate were added per mol of silver, the mixture was heated at 60° C. for 45 minutes to subject it to a chemical sensitization. Thereafter, 150 mg of 4-hydroxy-6-methyl-1,3,3a,7-tetrazaindene as a stabilizer and 100 mg of proxel as a preservative were added. The resulting particles were salt iodine silver bromide cubes having an average particle size of 0.25 μm and containing 69.9 mol % of silver halide. (coefficient of variation: 10%).

Emulsion B

An aqueous 0.37 mol silver nitrate solution and an aqueous halide solution containing $(NH_4)_3RhCl_6$ in an amount corresponding to $1.0\times10^{-7}$ mol per mol of silver in the finished emulsion, $K_3IrCl_6$ in an amount of $2\times10^{-7}$ mol per mol of silver, 0.11 M potassium bromide and 0.27 M sodium chloride were added to an aqueous gelatine solution containing sodium chloride and 1,3-dimethyl-2-imidazolidinethione with stirring at 45° C. over a period of 12 minutes according to the double jet method to carry out the nucleating. This gave salt silver bromide particles having an average particle size of 0.20 μm and salt silver chloride content of 70 mol %. Subsequently, an aqueous 0.63 mol silver nitrate solution and an aqueous halide solution containing 0.19 mol potassium bromide and 0.47 mol sodium chloride were similarly added according to the double jet method over a period of 20 minutes. Thereafter, a $1\times10^{-3}$ mol KI solution was added per mol of silver to carry out conversion, and the solution was washed with water by a flocculation method according to the conventional method. Then, 40 g of gelatine was added to adjust the pH to 6.5 and pAg to 7.5. Then, 7 mg of sodium benzenesulfonate, 5 mg of sodium thiosulfate, and 8 mg of aurate chloride were added, the mixture was heated at 60° C. for 45 minutes to subject it to a chemical sensitization. Thereafter, 150 mg of 4-hydroxy-6-methyl-1,3,3a,7-tetrazaindene as a stabilizer and proxel as a preservative were added. The resulting particles were iodine silver bromide cubes having an average particle size of 0.28 μm and containing 70 mol % of silver halide. (coefficient of variation: 9%).

Emulsion C

With stirring, Liquid 1, Liquid 2 and Liquid 3 described in Table 1, kept at 38° C. and at a pH value of 4.5 were added at the same time over a period of 24 minutes to form 0.18 μm particles. Subsequently, Liquid 4 and Liquid 5 were added over a period of 8 minutes, and 0.15 g of potassium chloride was added to finish the formation of particles.

Thereafter, the particles were washed with water by the flocculation method according to the usual method, gelatine was added, and the pH and pAg were adjusted to 5.2 and 7.5, respectively, followed by adding 4 mg of sodium thiosulphate, 2 mg of N,N-dimethylselenourea, 10 mg of aurate chloride, 4 mg of sodium benzenethiosulfonate, and 1 mg of sodium benzenethiosulfinate to conduct chemical sensitization so as to reach the optimum sensitivity at 55° C.

Furthermore, 50 mg of 2-methyl-4-hydroxy-1,3,3a,7-tetrazaindene as a stabilizer and an appropriate amount of phenoxy ethanol as a preservative so that the concentration was 100 ppm were added to finally obtain iodine silver halide cubic particles containing 80 mol % of silver chloride and having an average particle size of 0.20 μm. (Coefficient of variation: 9%).

TABLE 1

| | |
|---|---|
| Liquid 1: | |
| Water | 1 liter |
| Gelatine | 20 g |
| Sodium chloride | 2 g |
| 1,3-Dimethylimidazolidin-2-thion | 20 mg |
| Sodium benzenethiosulfonate | 6 mg |
| Liquid 2: | |
| Water | 600 ml |
| Silver nitrate | 150 g |
| Liquid 3: | |
| Water | 600 ml |
| Sodium chloride | 45 g |
| Potassium bromide | 21 g |
| Potassium hexachloroiridinate (III) (Aqueous 0.001% solution) | 15 ml |
| Ammonium hexabromoiridinate (III) (Aqueous 0.001% solution) | 1.5 ml |
| Liquid 4: | |
| Water | 200 ml |
| Silver nitrate | 50 g |
| Liquid 5: | |
| Water | 200 ml |
| Sodium chloride | 15 g |
| Potassium bromide | 7 g |
| $K_4Fe(CN)_6$ | 30 mg |

Emulsion D

An aqueous silver nitrate solution and an aqueous sodium chloride solution were mixed with an aqueous gelatine solution kept at 40° C. at the same time in the presence of $(NH_4)_3RhCl_6$ in an amount corresponding to $6.7\times10^{-6}$ mol per mol of silver, and the soluble salts were removed by a method well-known by those skilled in the art. Subsequently, gelatine was added, and 2-methyl-4-hydroxy-1,3,3a,7-tetrazaindene as a stabilizer was added without chemical aging. This emulsion was a single dispersed emulsion having an average particle size of 0.15 μm in the form of a cubic crystal.

EXAMPLE 1

Onto a polyethylene terephthalate film (150 μm) support having an undercoating layer (0.5 μm) comprising a vinylidene chloride copolymer, layers of UL, EM, ML and PC were applied on this order. The preparation and the applied amount of each layer are shown below.

UL Layer

Gelatine (10 g), 50 wt % of polyethylacrylate latex based on gelatine, and 3.5 wt % of hardening compound (a) based on gelatine were added and an amount of water such that the total amount was 250 ml was added to prepare a UL layer, which was applied so that the amount of gelatine was 0.4 $g/m^2$.

EM Layer

After the above-mentioned Emulsion A was dissolved with gelatine at 40° C., $3.2\times10^{-4}$ mol/mol Ag of sensitizer (the above-mentioned S5-9), $2.7\times10^{-4}$ mol/mol Ag of sensitizing dye (S-1), $3.4\times10^{-3}$ mol/mol Ag of KBr, $3.2\times10^{-4}$ mol/mol Ag of compound (b), $7.4\times10^{-4}$ mol/mol Ag of compound (c), $9.7\times10^{-3}$ mol/mol Ag of hydroquinone, $8.0\times10^{-3}$ mol/mol Ag of phosphoric acid, $4.5\times10^{-4}$ mol/mol Ag of the compound represented by formula (I), $5.3\times10^{-4}$ mol/mol Ag of any of the compounds represented by formulae (II) to (V) and the amino compound acting as an internal nucleating accelerator, and $3\times10^{-4}$ mol/mol Ag of compound W-1 were added. Further, 15 wt % of polyethyl acrylate, 15 wt % of a latex copolymer (methyl acrylate:sodium 2-acrylamido-2-methylpropane sulfonate:2-acetoacetoxyethyl methacrylate=88:5:7; weight ratio), and 4 wt % of compound (a) were added all based on gelatine, and the mixture was applied so that the amount of Ag was 3.3 g/m$^2$.

ML Layer

To a gelatine solution were added 7 mg/m$^2$ of compound (d), 15 wt % of polyethyl acrylate, and 3.5 wt % of compound (a), all based on gelatine, and the mixture was applied so that the amount of gelatine was 0.5 g/m$^2$.

PC Layer

To a gelatine solution were added 40 mg/m$^2$ of an amorphous matting agent having an average particle size of 3.5 $\mu$m, 20 mg/m$^2$ of silicone oil, and 5 mg/m$^2$ of compound (e) as an applying aid, and the mixture was applied. The amount of gelatine was 0.3 g/m$^2$.

Additives to Photosensitive Material of Example 1

Compound (a)

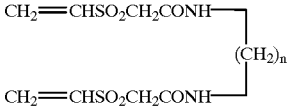

3:1 mixture of compounds wherein $n$ = 2 and wherein $n$ = 3

Compound (b)

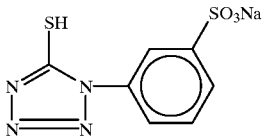

-continued

Compound (c)

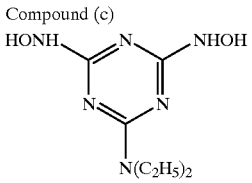

Compound (d)

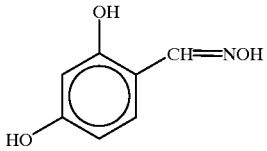

Compound (e)

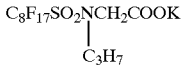

Sensitizing Dye (S-1)

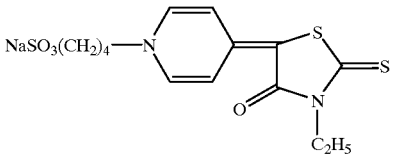

Compound W-1

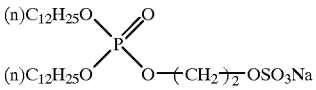

A back layer and a back protective layer having the following formulations were applied:

Formulation of Back Layer

| [Formulation of Back Layer] | |
|---|---|
| Gelatine | 3 g/m$^2$ |
| Latex: Polyethyl acrylate | 2 g/m$^2$ |
| Surfactant: Sodium p-Dodecylbenzenesulfonate | 40 g/m$^2$ |
| Compound (a) | 110 mg/m$^2$ |
| $SnO_2$/Sb (weight ratio 90/10, average particle size: 0.20 $\mu$m) | 200 mg/m$^2$ |
| Dyestuff: | |
| Mixture of Dyestuff (a), Dyestuff (b), and Dyestuff (c) | |
| Dyestuff (a) | 70 mg/m$^2$ |
| Dyestuff (b) | 100 mg/m$^2$ |
| Dyestuff (C) | 50 mg/m$^2$ |

-continued

Dyestuff (a)

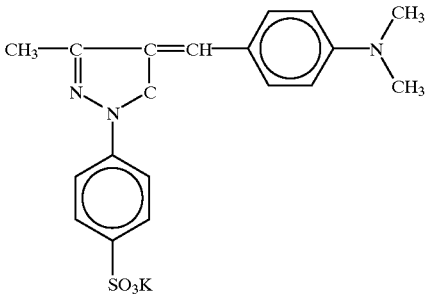

Dyestuff (b)

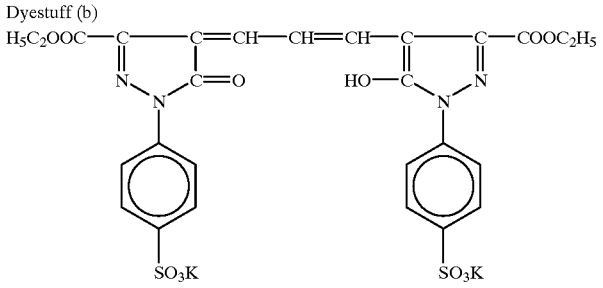

Dyestuff (c)

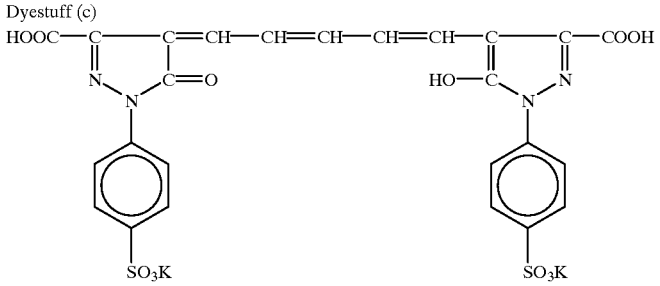

[Back Protective Layer]

| | |
|---|---|
| Gelatine | 0.8 mg/m$^2$ |
| Polymethyl methacrylate fine particle (average particle size: 4.5 $\mu$m) | 30 mg/m$^2$ |
| Sodium dihexyl-$\alpha$-sulfosuccinate | 15 mg/m$^2$ |
| Sodium p-dodecylbenzenesulfonate | 15 mg/m$^2$ |
| Sodium acetate | 40 mg/m$^2$ |

Preparation of Developer

Using formulation as shown in Table 2, Developers, D-1 to D-8, containing the compound represented by formula (VI) according to the present invention were prepared. Also, a developer comprising hydroquinone as a main developing agent was prepared.

TABLE 2

| | Number of developer and Composition | | | | | | | |
|---|---|---|---|---|---|---|---|---|
| Components of Developer (g) | D-1 | D-2 | D-3 | D-4 | D-5 | D-6 | D-7 | D-8 |
| NaOH | 10 | 15 | 15 | 15 | 15 | 15 | 15 | 15 |
| Diethyltriamine pentaacetic acid | 1.5 | 1.5 | 1.5 | 1.5 | 1.5 | 1.5 | 1.5 | 1.5 |
| Potassium carbonate | 15 | 15 | 15 | 15 | 15 | 15 | 15 | 70 |
| Potassium bromide | 3 | 3 | 3 | 3 | 3 | 3 | 3 | 3 |
| 5-Methylbenzotriazole | 0.10 | 0.10 | 0.10 | 0.10 | 0.10 | 0.10 | 0.10 | 0.10 |
| 1-Phenyl-5-mercaptotetrazole | 0.02 | 0.02 | 0.02 | 0.02 | 0.02 | 0.02 | 0.02 | 0.02 |
| Potassium sulfite | 65 | 65 | 30 | 30 | 30 | 30 | 30 | 30 |

TABLE 2-continued

| Components of Developer (g) | Number of developer and Composition | | | | | | | |
|---|---|---|---|---|---|---|---|---|
| | D-1 | D-2 | D-3 | D-4 | D-5 | D-6 | D-7 | D-8 |
| 4-Hydroxymethyl-4-methyl-1-phenyl-3-pyrazolidone | 0.4 | 0.4 | 0.4 | 0.4 | 0.4 | 0.4 | — | 0.4 |
| N-Metyl-p-aminophenol | — | — | — | — | — | 1.2 | — | |
| Hydroquinone | 19 | — | — | — | — | — | — | — |
| Compound VI-1 of the present invention | — | 30 | 30 | 30 | 30 | 30 | 30 | 30 |
| N-n-Butyldiethanol amine | — | — | 15 | — | — | — | — | — |
| Compound (7) of the present invention | — | — | — | 0.3 | — | — | — | — |
| Compound (9) of the present invention | — | — | — | — | 0.3 | — | 0.3 | 0.3 |
| Compound (33) of the present invention | — | — | — | — | — | 0.3 | — | — |
| Water | to 1 liter | | | | | | | |
| pH adjusted to | 10.5 | 10.5 | 10.5 | 10.5 | 10.5 | 10.5 | 10.5 | 10.5 |
| Remarks | Comparison | Comparison | Comparison | Invention | Invention | Invention | Invention | Invention |

The formulation of the fixer used in the present invention is shown below.

| (Formulation of Fixer) | |
|---|---|
| Ammonium thiosulfate | 360 g |
| Ethylenediamine tetraacetate, $2Na \cdot 2H_2O$ | 2.3 g |
| Sodium thiosulfate $5H_20$ | 33.0 g |
| Sodium sulfite | 75.0 g |
| Sodium hydroxide | 37.0 g |
| Glacial acetic acid | 87.0 g |
| Tartaric acid | 8.8 g |
| Sodium gluconate | 6.6 g |
| Aluminum sulfate | 25.0 g |
| Water | to 3 liters |
| pH (adjusted with sulfuric acid or sodium hydroxide) | 4.85 |

Evaluation

The applied sample was subjected to two types of exposure through 3200° K. tungsten light. In one case, only an optical wedge was used, and, in the other case, an optical wedge was piled on a film having a half-tone image formed (Half-tone text: dot %=90%), which was fixed onto a pasting base by an adhesive tape, and adhered so that the protective layer of the film sample and the half-tone text overlapped face to face, and the sample was then exposed. After the exposure, a treatment was carried out using the FG-460A automatic developing machine (produced by Fuji Film Co., Ltd.) at a developing temperature of 35° C. The automatic developing machine used was remolded so that the developing period could be freely changed. The developing period was 30 seconds for the samples for measuring sensitivity and gradation, and 10, 30, 50, and 70 seconds for the samples for measuring the image enlarging speed.

For the measurements of sensitivity and gradation, the sample only exposed by the optical wedge was used. The sensitivity was indicated by a relative value taking an inverted value of an amount of exposure required for obtaining the concentration of 1.5 when being processed with No. 1 in Table 3 as 100. As the value is higher, the sensitivity deems to be high.

The gradation (γ) is shown as the following equation. As the value becomes higher, the photographic character deems to be of a high contrast.

*γ=(3.0−0.3)/[log(the amount of exposure giving the concentration of 3.0)−log(the amount of exposure giving the concentration of 0.3)]

With regard to the image enlarging speed, when the sample exposed with the half-tone text was developed for 10 seconds, it was exposed in an exposure amount such that the dot % became 10%, and the incline of the variation of dot % due to the developing period was taken as the image enlarging speed. (it was separately confirmed that the dot % had a linear relation with the diameter of dot.) The speed was a relative speed taking the image enlarging speed of No. 1 in Table 3 as 100. As the value becomes higher, the image tends to be more enlarged.

TABLE 3

| Sample No. | Nucleating Agent No. | Nucleating Accelerator No. | Developer No. | Sensitivity | Gradation | Image Enlarging Speed | Remarks |
|---|---|---|---|---|---|---|---|
| 1 | I-38 | A-12 | D-1 | 100 | 18.7 | 100 | Comparison |
| 2 | I-38 | A-12 | D-2 | 85 | 12.5 | 8 | Comparison |
| 3 | I-38 | A-12 | D-3 | 98 | 18.5 | 63 | Comparison |
| 4 | I-38 | A-12 | D-4 | 97 | 18.1 | 12 | Invention |
| 5 | I-38 | A-12 | D-5 | 98 | 18.2 | 12 | Invention |
| 6 | I-38 | A-12 | D-6 | 97 | 18.2 | 11 | Invention |
| 7 | I-38 | A-12 | D-7 | 97 | 18.5 | 12 | Invention |
| 8 | I-38 | A-12 | D-8 | 101 | 19.0 | 12 | Invention |
| 9 | I-38 | A-1 | D-1 | 99 | 19.2 | 103 | Comparison |
| 10 | I-38 | A-1 | D-2 | 83 | 13.2 | 8 | Comparison |
| 11 | I-38 | A-1 | D-3 | 98 | 19.1 | 60 | Comparison |
| 12 | I-38 | A-1 | D-4 | 99 | 18.9 | 11 | Invention |
| 13 | I-10 | A-9 | D-5 | 98 | 18.2 | 11 | Invention |
| 14 | I-36 | A-46 | D-5 | 97 | 18.5 | 12 | Invention |

TABLE 3-continued

| Sample No. | Nucleating Agent No. | Nucleating Accelerator No. | Developer No. | Sensitivity | Gradation | Image Enlarging Speed | Remarks |
|---|---|---|---|---|---|---|---|
| 15 | I-38 | B-2 | D-5 | 100 | 19 | 12 | Invention |
| 16 | I-38 | C-1 | D-5 | 98 | 18.7 | 11 | Invention |
| 17 | I-38 | D-1 | D-5 | 97 | 18.3 | 12 | Invention |

The main developing agent according to the present invention has a developing activity lower than hydroquinone and, thus, cannot give any super high contrast, but can provide a developing process having less image enlargement. The developing activity is enhanced by adding an amine compound to the developer, but it is not preferred because of the increase in the image enlargement. However, when the quaternary onium salt compound of the present invention was added, the developing activity could be improved without increasing in the image enlarging speed. Since the image enlarging speed was considered to usually have a positive correlation with developing activity in the hydrazine nucleating developing, the developing method according to the present invention showed an unexpected phenomenon.

EXAMPLE 2

Samples were prepared according to Example 1, except for replacing the formulation of the EM layer of Example 1 with the following formulation.

EM Layer

After the above-mentioned Emulsion B was dissolved with gelatine at 40° C., $4.6\times10^{-4}$ mol/mol Ag of sensitizer (the above-mentioned S1-1), $1.7\times10^{-4}$ mol/mol Ag of sensitizing dye (S-1), $4.5\times10^{-3}$ mol/mol Ag of KBr, $3.1\times10^{-4}$ mol/mol Ag of compound (b), $7.4\times10^{-4}$ mol/mol Ag of compound (c), $2.9\times10^{-2}$ mol/mol Ag of hydroquinone, $2.3\times10^{-3}$ mol/mol Ag of acetic acid, 10 wt % of colloidal silica based on gelatine, $3.4\times10^{-4}$ mol/mol Ag of the compound represented by formula (I), $4.9\times10^{-4}$ mol/mol Ag of the compounds represented by formulae (II) to (V) and the amino compound acting as an internal nucleating accelerator, and $3.4\times10^{-4}$ mol/mol Ag of compound W-1 were added. Further, 30 wt % of polyethyl acrylate latex copolymer and 4 wt % of compound (a) were added both based on gelatine, and the mixture was applied. Compounds (a), (b), (c) were the same as those of Example 1.

The samples thus prepared were exposed using the optical wedge and the half-tone text similar to Example 1 through an interference filter having a peak at 488 nm for $10^{-5}$ of emission period with xenon flush. The compositions of Developers, D-9 to D-16, used are shown in Table 4. The fixer, automatic developing machine, developing method and evaluation were carried out as in Example 1.

TABLE 4

| | Number of developer and Composition | | | | | | | |
|---|---|---|---|---|---|---|---|---|
| Components of Developer (g) | D-9 | D-10 | D-11 | D-12 | D-13 | D-14 | D-15 | D-16 |
| NaOH | 10 | 15 | 15 | 15 | 15 | 15 | 15 | 15 |
| Diethyltriamine pentaacetic acid | 1.5 | 1.5 | 1.5 | 1.5 | 1.5 | 1.5 | 1.5 | 1.5 |
| Potassium carbonate | 15 | 15 | 15 | 15 | 15 | 15 | 15 | 15 |
| Potassium bromide | 3 | 3 | 3 | 3 | 3 | 3 | 3 | 3 |
| 5-Methylbenzotriazole | 0.10 | 0.10 | 0.10 | 0.10 | 0.10 | 0.10 | 0.10 | 0.10 |
| 1-Phenyl-5-mercaptotetrazole | 0.02 | 0.02 | 0.02 | 0.02 | 0.02 | 0.02 | 0.02 | 0.02 |
| Potassium sulfite | 65 | 30 | 30 | 30 | 30 | 30 | 30 | 30 |
| 4-Hydroxymethyl-4-methyl-1-phenyl-3-pyrazolidone | 0.4 | 0.4 | 0.4 | 0.4 | 0.4 | 0.4 | 0.4 | 0.4 |
| Hydroquinone | 19 | — | — | — | — | — | — | — |
| Compound VI-1 of the present invention | — | 30 | — | — | 30 | — | — | — |
| Compound VI-3 of the present invention | — | — | 30 | — | — | 30 | — | 30 |
| Compound VI-5 of the present invention | — | — | — | 30 | — | — | 30 | — |
| Compound (7) of the present invention | — | — | — | — | 0.3 | 0.3 | 0.3 | — |
| Compound (9) of the present invention | — | — | — | — | — | — | — | 0.3 |
| Water | to 1 liter | | | | | | | |
| pH adjusted to | 10.5 | 10.5 | 10.5 | 10.5 | 10.5 | 10.5 | 10.5 | 10.5 |
| Remarks | Comparison | Comparison | Comparison | Comparison | Invention | Invention | Invention | Invention |

TABLE 5

| Sample No. | Nucleating Agent No. | Nucleating Accelerator No. | Developer No. | Sensitivity | Gradation | Image Enlarging Speed | Remarks |
|---|---|---|---|---|---|---|---|
| 18 | I-38 | A-12 | D-9 | 100 | 20.1 | 100 | Comparison |
| 19 | I-38 | A-12 | D-10 | 83 | 12.3 | 8 | Comparison |
| 20 | I-38 | A-12 | D-11 | 81 | 12.3 | 9 | Comparison |
| 21 | I-38 | A-12 | D-12 | 84 | 11.8 | 8 | Comparison |
| 22 | I-38 | A-12 | D-13 | 98 | 20.3 | 11 | Invention |
| 23 | I-38 | A-12 | D-14 | 99 | 19.9 | 12 | Invention |
| 24 | I-38 | A-12 | D-15 | 97 | 20.8 | 11 | Invention |
| 25 | I-38 | A-12 | D-16 | 98 | 20.3 | 12 | Invention |
| 26 | I-10 | A-9 | D-13 | 99 | 20.6 | 11 | Invention |
| 27 | I-36 | A-46 | D-13 | 98 | 19.5 | 13 | Invention |
| 28 | I-38 | B-2 | D-13 | 98 | 20.3 | 11 | Invention |
| 29 | I-38 | C-1 | D-13 | 100 | 20.5 | 12 | Invention |
| 30 | I-10 | D-1 | D-13 | 97 | 20.4 | 11 | Invention |

Results similar to those of Example 1 were obtained. By the developing process of the present invention using a highly safe main developing agent, a super high contrast image with less image enlargement could be obtained even at a high illumination.

EXAMPLE 3

Samples were prepared according to Example 1, except for replacing the formulation of the EM layer of Example 1 with the following formulation.

EM Layer

After the above-mentioned Emulsion C was dissolved with gelatine at 40° C., $3.6\times10^{-3}$ mol/mol Ag of KBr, $7.6\times10^{-4}$ mol/mol Ag of 4-hydroxy-6-methyl-1,3,3a-tetrazaindene, $2.1\times10^{-4}$ mol/mol Ag of sensitizing dye (S-2), $3.4\times10^{-4}$ mol/mol Ag of compound (b), $1.6\times10^{-3}$ mol/mol Ag of compound (c), 10 wt % of colloidal silica based on gelatine, $1.9\times10^{-4}$ mol/mol Ag of the compound represented by formula (I), $3.6\times10^{-4}$ mol/mol Ag of the compounds represented by formulae (II) to (V) and the amino compound acting as an internal nucleating accelerator, and $5.0\times10^{-4}$ mol/mol Ag of compound W-1 were added. Further, 15 wt % of polyethyl acrylate latex, 20 wt % of a latex copolymer (butyl acrylate:sodium 2-acrylamido-2-methylpropane sulfonate:2-acetoacetoxyethyl methacrylate=88:5:7; weight ratio), and 4 wt % of compound (a) were added all based on gelatine, and the mixture was applied so that the amount of Ag was 3.5 g/m$^2$. Compounds (a), (b), (c) were the same as those of Example 1.

Sensitizing Dye (S-2)

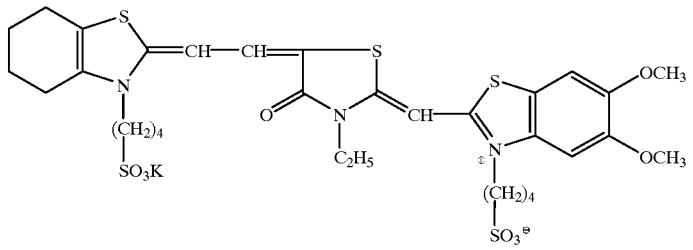

The samples thus prepared were exposed using the optical wedge and the half-tone text similar to Example 1 through an interference filter having a peak at 633 nm for $10^{-5}$ sec of emission period with xenon flush. The developers used were the same as those of Example 2. The fixer, automatic developing machine, developing method and evaluation were carried out as in Example 1.

TABLE 6

| Sample No. | Nucleating Agent No. | Nucleating Accelerator No. | Developer No. | Sensitivity | Gradation | Image Enlarging Speed | Remarks |
|---|---|---|---|---|---|---|---|
| 31 | I-38 | A-12 | D-9 | 100 | 19.5 | 100 | Comparison |
| 32 | I-38 | A-12 | D-10 | 83 | 12.1 | 8 | Comparison |
| 33 | I-38 | A-12 | D-11 | 81 | 12.3 | 8 | Comparison |

TABLE 6-continued

| Sample No. | Nucleating Agent No. | Nucleating Accelerator No. | Developer No. | Sensitivity | Gradation | Image Enlarging Speed | Remarks |
|---|---|---|---|---|---|---|---|
| 34 | I-38 | A-12 | D-13 | 100 | 19.3 | 12 | Invention |
| 35 | I-38 | A-12 | D-14 | 98 | 19.1 | 11 | Invention |

Results similar to those of Example 1 were obtained. By the developing process of the present invention using a highly safety main developing agent, a super high contrast image with less image enlargement could be obtained.

EXAMPLE 4

Onto a polyethylene terephthalate film (150 $\mu$m) support having an undercoating layer (0.5 $\mu$m) comprising a vinylidene chloride copolymer, layers of UL, EM, ML and PC were applied on this order to produce Sample Nos. 101–120. The preparation and the applied amount of each layer are shown below.

EM Layer

After the above-mentioned Emulsion C was dissolved with gelatine at 40° C., $3.6\times10^{-3}$ mol/mol Ag of KBr, $7.6\times10^{-4}$ mol/mol Ag of 4-hydroxy-6-methyl-1,3,3a-tetrazaindene, $2.1\times10^{-4}$ mol/mol Ag of sensitizing dye (S-2), $3.4\times10^{-4}$ mol/mol Ag of compound (b), $1.6\times10^{-3}$ mol/mol Ag of compound (c), 10 wt % of colloidal silica based on gelatine, $1.9\times10^{-4}$ mol/mol Ag of the compound represented by formula (I), $3.6\times10^{-4}$ mol/mol Ag of the compound represented by formulae (N-I) or Comparative Compound 1 or 2 as in Table 7 were added. Further, 15 wt % of polyethyl acrylate latex, 20 wt % of a latex copolymer (butyl acrylate:sodium 2-acrylamido-2-methylpropane sulfonate:2-acetoacetoxyethyl methacrylate=88:5:7; weight ratio), and 4 wt % of compound (a) were added all based on gelatine, and the mixture was applied so that the amount of Ag was 3.5 g/m$^2$.

The UL, ML, and PC layers were prepared as in Example 1 and they were applied in the same amounts. Further, the back layer and the back protective layer applied were also prepared as in Example 1.

The samples thus prepared were exposed through an interference filter having a peak at 633 nm and through a step wedge with xenon flush for an emission period of $10^{-6}$ second, developed at 35° C. for 30 seconds by FG-710 automatic developing machine (produced by Fuji Film Co., Ltd.), fixed (using GR-F1 as a fixer (produced by Fuji Film Co., Ltd.)), washed with water, and dried. The developer used was the following Developer A. The results are shown in Table 7.

| Developer A | |
|---|---|
| Sodium hydroxide | 10.0 g |
| Diethylenetriamine pentaacetic acid | 1.5 g |
| Potassium carbonate | 15.0 g |
| Potassium bromide | 3.0 g |
| 5-Methylbenzotriazole | 0.10 g |
| 1-Phenyl-5-mercaptotetrazole | 0.02 g |
| Potassium sulfite | 10.0 g |

-continued

| Developer A | |
|---|---|
| 4-Hydroxymethyl-4-methyl-1-phenyl-3-pyrazolidone | 0.40 g |
| Compound VI-1 of formula (VI) | 30.0 g |

Potassium hydroxide, and water were added to 1 liter. The pH was adjusted to 9.5.

TABLE 7

| | Formula (I) No. | Formula (N-I) No. | Gamma (γ) | Remarks |
|---|---|---|---|---|
| 101 | I-38 | — | 8.2 | Comparison |
| 102 | I-38 | *N-1 | 14.3 | Invention |
| 103 | I-38 | *N-2 | 13.7 | Invention |
| 104 | I-38 | N-7 | 16.1 | Invention |
| 105 | I-38 | N-8 | 16.4 | Invention |
| 106 | I-38 | N-9 | 17.5 | Invention |
| 107 | I-38 | N-10 | 14.4 | Invention |
| 108 | I-38 | N-11 | 14.2 | Invention |
| 109 | I-38 | N-15 | 15.7 | Invention |
| 110 | I-38 | N-21 | 13.3 | Invention |
| 111 | I-38 | N-22 | 13.8 | Invention |
| 112 | I-38 | N-23 | 16.1 | Invention |
| 113 | I-38 | N-24 | 14.6 | Invention |
| 114 | I-38 | N-26 | 13.5 | Invention |
| 115 | I-38 | N-31 | 17.1 | Invention |
| 116 | I-38 | N-32 | 15.8 | Invention |
| 117 | I-38 | Comparative Compound-1 | 9.7 | Comparison |
| 118 | I-38 | Comparative Compound-2 | 9.4 | Comparison |
| 119 | — | N-15 | 9.0 | Comparison |
| 120 | — | N-31 | 9.3 | Comparison |

*The amount added was doubled.

Comparative Compound-1

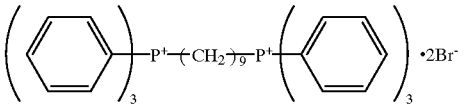

Comparative Compound-2

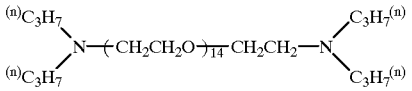

From the results of Table 7, Sample Nos. 101, 119, and 120 gave gamma values of less than 10, indicating that no high contrast was obtained. In Sample Nos. 117 and 118 using Comparative Compounds, sufficient high contrast was not obtained. On the other hand, all the samples according to the present invention had gamma values of 10 or more and gave good high contrast.

EXAMPLE 5

Developer B was prepared in the same formulation as in Developer A except for changing a pH value to 10.5. Developer B was used for comparison.

Test of Time Elapse for Developer

The above-mentioned Developers A and B were charged into the FG-460 A automatic developing machine (produced by Fuji Film Co., Ltd.), and the photosensitive materials of Nos. 104, 109, 112, 115 and 120 according to Example 4 (exposed as in Example 4) were processed immediately after the incorporation and again after 10 days to observe the degree of the change in sensitivity between being fresh and being aged with time elapse (after the developer was left standing for 10 days), which was expressed as ΔlogE. The results are shown in Table 8.

ΔlogE is the difference of the amount of the exposure required for giving the optical strength of 1.5 (logE) between the fresh developer and the time elapsed developer: the higher the value, the bigger the change in sensitivity.

TABLE 8

| Developer | Sample No. | ΔlogE | Remarks |
|---|---|---|---|
| Developer A (pH. 9.5) | 104 | 0.03 | Invention |
| Developer A (pH. 9.5) | 109 | 0.02 | Invention |
| Developer A (pH. 9.5) | 112 | 0.04 | Invention |
| Developer A (pH. 9.5) | 115 | 0.03 | Invention |
| Developer A (pH. 9.5) | 120 | 0.01 | Comparison |
| Developer B (pH 10.5) | 104 | 0.15 | Comparison |
| Developer B (pH 10.5) | 109 | 0.13 | Comparison |
| Developer B (pH 10.5) | 112 | 0.16 | Comparison |
| Developer B (pH 10.5) | 115 | 0.13 | Comparison |
| Developer B (pH 10.5) | 120 | 0.08 | Comparative |

From the results of Table 8, whereas Developer B had a large change in the sensitivity along with time elapse, Developer A had little change, indicating its stability.

EXAMPLE 6

Onto a polyethylene terephthalate film (150 μm) support having an undercoating layer (0.5 μm) comprising a vinylidene chloride copolymer, layers of UL, EM, ML and PC were applied on this order to produce Sample Nos. 501–525. The preparation and the applied amount of each layer are shown below.

UL Layer

Twenty wt % of polyethylacrylate latex based on gelatine, 20 wt % of a latex copolymer (methyl acrylate:sodium 2-acrylamido-2-methylpropane sulfonate:2-acetoacetoxyethyl methacrylate =88:5:7; weight ratio) based on gelatine, 3.5 wt % of Compound (a) of Example 1 based on gelatine, and 5 wt % of Compound (f) based on gelatine were added and applied so that the amount of gelatine was 0.5 g/m$^2$.

EM Layer

After the above-mentioned Emulsion D was dissolved with gelatine at 40° C., $6.5\times10^{-3}$ mol/mol Ag of 4-hydroxy-6-methyl-1,3,3a-tetrazaindene, $4.7\times10^{-4}$ mol/mol Ag of compound (b) of Example 1, $2.0\times10^{-3}$ mol/mol Ag of the compound represented by formula (I), and $3.0\times10^{-3}$ mol/mol Ag of the compound represented by formula (N-I) were added. Further, 20 wt % of a latex copolymer (butyl acrylate:sodium 2-acrylamido-2-methylpropane sulfonate:2-acetoacetoxyethyl methacrylate=88:5:7; weight ratio), and 3.5 wt % of compound (a) of Example 1 were added all based on gelatine, and the mixture was applied so that the amount of Ag was 3.5 g m$^2$. At that time, the amount of gelatine was 1.60 g/m$^2$.

ML Layer

To a gelatine solution were added 100 ppm of proxel based on the finished liquid, $2.8\times10^{-5}$ mol/m$^2$ of 1-phenyl-5-mercapto-1,2,3,4-tetrazole, 20 wt % of polyethyl acrylate latex based on gelatine, and 3.5 wt % of compound (a) based on gelatine, and the mixture was applied such that the amount of gelatine was 0.7 g/m$^2$.

PC Layer

The mixture comprising 1.0 g/m$^2$ of gelatine, 2.1 mg/m$^2$ of thioctic acid, each 50 mg/m$^2$ of the following Solid dyestuffs D-1 and D-2, 9.0 mg/m$^2$ of polymethyl methacrylate (average particle size: 2.5 μm) as a matting agent, 9.0 mg/m$^2$ of silica (average particle size: 4.0 μm) and 37 mg/M$^2$ of Compound (f) and 2.5 mg/m$^2$ of Compound (g) as surfactants was applied.

Solid Dyestuffs

D-1

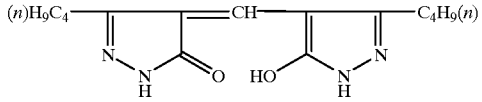

D-2

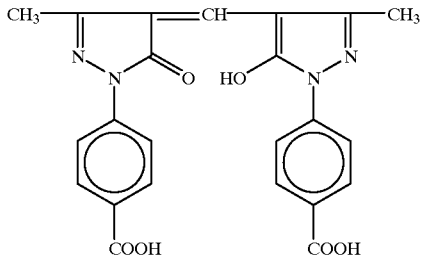

Compound (f)

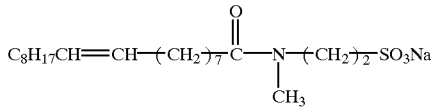

Compound (g)

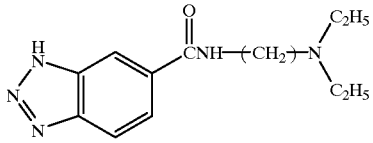

The back layer and the back protective layer having the same formulations as in Example 4 were applied.

Figure 1B:
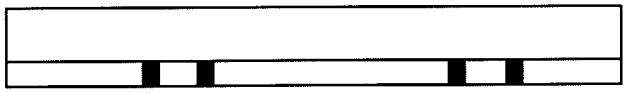
Figure 1C:
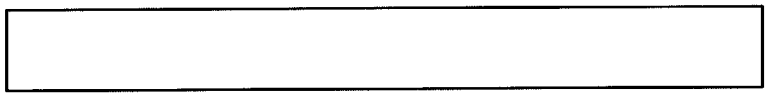
Figure 1D:
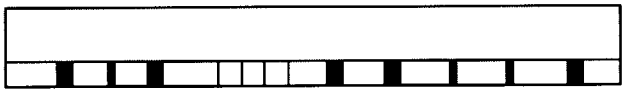
Figure 1E:
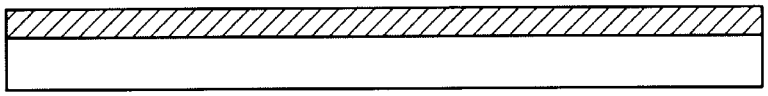

The applied samples were image-exposed through the text as shown in FIG. 1 by a printer for light room, P-627FM, produced by Dainippon Screen Co., Ltd., and developed as in Example 4 with the developer as in Example 4. As for these samples, the image quality of the faded out letters was examined. The samples were also exposed with P-627FM using an optical wedge, and developed as described above to examine γ.

An image quality of 5 of the enlarged letter indicates an image quality such that when an adequate exposure is applied such that 50% of the half-tone areas is transferred to 50% of the half-tone area on the photosensitive material, a 30 μm width letter is reproduced, and is very good image quality of the enlarged letter. On the other hand, an image quality of 1 means the image quality such that when the same exposure was allied, only a 150 μm wide letter can be reproduced, which is a poor image quality of faded out letter. Ratings 4 to 2 were set between 5 and 1 by the panel evaluation. A rate of 3 or more is a practical level.

The results are shown in Table 9.

TABLE 9

| | Formula (I) No. | Formula (N-1) No. | Gamma | Image Quality of Enlarged Letter | Remarks |
|---|---|---|---|---|---|
| 201 | — | — | 9.1 | 2 | Comparison |
| 202 | I-33 | — | 9.3 | 2 | Comparison |
| 203 | — | N-15 | 9.8 | 2 | Comparison |
| 204 | — | N-31 | 9.2 | 2 | Comparison |
| 205 | I-33 | *N-1 | 15.1 | 5 | Invention |
| 206 | I-33 | *N-2 | 13.7 | 4 | Invention |
| 207 | I-33 | N-7 | 14.7 | 5 | Invention |
| 208 | I-33 | N-8 | 14.2 | 5 | Invention |
| 209 | I-33 | N-9 | 16.8 | 5 | Invention |
| 210 | I-33 | N-10 | 15.0 | 5 | Invention |
| 211 | I-33 | N-11 | 13.9 | 4 | Invention |
| 212 | I-33 | N-15 | 16.4 | 5 | Invention |
| 213 | I-33 | *N-21 | 13.7 | 4 | Invention |
| 214 | I-33 | *N-22 | 13.9 | 5 | Invention |
| 215 | I-33 | N-23 | 17.2 | 5 | Invention |
| 216 | I-33 | N-24 | 15.6 | 4 | Invention |
| 217 | I-33 | N-26 | 14.5 | 5 | Invention |
| 218 | I-33 | N-31 | 16.3 | 4 | Invention |
| 219 | I-33 | N-32 | 15.9 | 5 | Invention |
| 220 | I-33 | Comparative Compound-1 | 9.4 | 2 | Comparison |
| 221 | I-33 | Comparative Compound-2 | 9.3 | 2 | Comparison |

*: The amount added was doubled.

From the results of Table 9, Sample Nos. 201–204 and Nos. 220 and 221 gave insufficient high contrast. In Sample Nos. 205–219 according to the present invention, γ values were 10 or more in all cases, and these samples gave good high contrast.

EXAMPLE 7

Developers F to H were prepared in such a manner that the compound represented by formula (VI) was changed in the above-mentioned Developer A. The preparation was carried out in such a manner that the amount of the compound represented by formula (VI) was the same molar amount of that of Developer A.

| | Formula (VI) |
|---|---|
| Developer F | VI-3 |
| Developer G | VI-18 |
| Developer H | VI-24 |

Using the above-mentioned developers, the photosensitive materials of Example 6 were selected as shown in Table 10, and they were exposed and developed as in Example 6.

TABLE 10

| Developer | Sample No. | Gamma | Image Quality of Enlarged Letter | Remarks |
|---|---|---|---|---|
| C | 202 | 9.3 | 2 | Comparison |
| C | 203 | 9.6 | 2 | Comparison |
| C | 204 | 9.6 | 2 | Comparison |
| C | 207 | 14.5 | 5 | Invention |
| C | 212 | 16.7 | 5 | Invention |
| C | 215 | 17.0 | 5 | Invention |
| C | 219 | 15.5 | 5 | Invention |
| D | 202 | 9.4 | 2 | Comparison |
| D | 203 | 9.8 | 2 | Comparison |
| D | 204 | 9.7 | 2 | Comparison |
| D | 207 | 18.8 | 5 | Invention |
| D | 212 | 19.3 | 5 | Invention |
| D | 215 | 21.0 | 5 | Invention |
| D | 219 | 18.4 | 5 | Invention |
| D | 220 | 9.7 | 2 | Comparison |
| D | 221 | 9.3 | 2 | Comparison |
| E | 202 | 9.3 | 2 | Comparison |
| E | 203 | 9.7 | 2 | Comparison |
| E | 204 | 9.5 | 2 | Comparison |
| E | 207 | 14.0 | 5 | Invention |

TABLE 10-continued

| Developer | Sample No. | Gamma | Image Quality of Enlarged Letter | Remarks |
|---|---|---|---|---|
| E | 212 | 16.0 | 5 | Invention |
| E | 215 | 17.3 | 5 | Invention |
| E | 219 | 16.3 | 5 | Invention |

As is clear from the results of Table 10, hard contrast and good performance were obtained in the present invention. Above all, in the present invention developed with Developer D, the gamma value was particularly high, giving good performance.

As the results described above, according to the present invention, a silver halide photosensitive material which is difficult to be image-enlarged and can give super high contrast using no dihydroxybenzene series developing agent but using highly safe main developing agent can be provided.

While the invention has been described in detail and with reference to specific embodiments thereof, it will be apparent to one skilled in the art that various changes and modifications can be made therein without departing from the spirit and scope thereof.

What is claimed is:

1. A development processing method, which comprises the steps of (a) exposing a silver halide photographic material comprising a support having thereon at least one light-sensitive silver halide emulsion layer, wherein at least one layer of the light-sensitive silver halide emulsion layer and a hydrophilic colloid layer contains (i) at least one hydrazine derivative represented by the following formula (I) and (ii) at least one compound selected from compounds represented by the following formula (II), (III), (IV) or (V) acting as an incorporated nucleating accelerator; and (b) developing the exposed silver halide photographic material with a developer containing a developing agent represented by the following formula (VI), containing substantially no dihydroxybenzene developing agent, containing an auxiliary developing agent exhibiting a superadditive property, containing a quaternary onium salt compound, and having pH value of from 9.5 to 11.5;

(I)

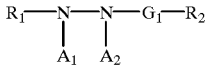

wherein $R_1$ represents an aliphatic group or an aromatic group;

$R_2$ represents a hydrogen atom, an alkyl group, an aryl group, an unsaturated heterocyclic group, an alkoxy group, an aryloxy group, an amino group, a hydrazino group, a carbamoyl group or an oxycarbonyl group;

$G_1$ represents —CO—, —$SO_2$—, —SO—, —PO($R_3$)—, —CO—CO—, a thiocarbonyl group or an iminomethylene group;

$A_1$ and $A_2$ are both a hydrogen atom, or one of them is a hydrogen atom and the other is an alkylsulfonyl group, an arylsulfonyl group or an acyl group;

$R_3$ has the same meaning as $R_2$, but it may be different from $R_2$;

(II)

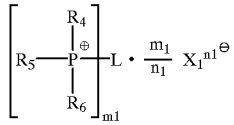

wherein $R_4$, $R_5$ and $R_6$ each independently represents an alkyl group, a cycloalkyl group, an aryl group, an alkenyl group, a cycloalkenyl group or a heterocyclic group;

$m_1$ represents an integer of from 1 to 4;

L represents an $m_1$-valent organic group which bonds to the P atom in formula (II) via a carbon atom within L;

$n_1$ represents an integer of from 1 to 3; and $x_1$ represents an $n_1$-valent anion and $X_1$ may be connected to L;

(III)

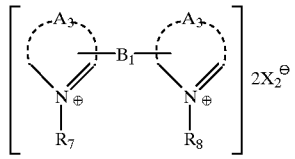

(IV)

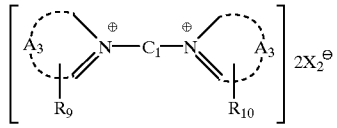

wherein $A_3$ represents an organic group necessary for forming a heterocyclic ring;

$B_1$ and $C_1$ each independently represents a divalent group;

$R_7$ and $R_8$ each independently represents an alkyl group or an aryl group;

$R_9$ and $R_{10}$ each independently represents a hydrogen atom or a substituent; and $X_2$ represents an anion, with the proviso that, if an intermolecular salt is formed, $X_2$ does not exist;

(V)

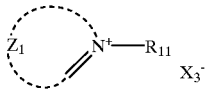

wherein $Z_1$ represents an atomic group necessary for forming a nitrogen-containing heteroaromatic ring;

$R_{11}$ represents an alkyl group; and $X_3^-$ represents a counter anion;

(VI)

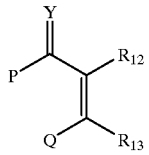

wherein $R_{12}$ and $R_{13}$ each independently represents a hydroxyl group, an amino group, an acylamino group, an alkylsulfonylamino group, an arylsulfonylamino group, an alkoxycarbonylamino group, an alkoxysulfonylamino group, a mercapto group or an alkylthio group;

P and Q each independently represents a hydroxyl group, a carboxyl group, an alkoxy group, a hydroxyalkyl group, a carboxyalkyl group, a sulfo group, a sulfoalkyl group, an amino group, an aminoalkyl group, an alkyl group, an aryl group or a mercapto group, or P and Q may be bonded with each other to represent an atomic group necessary for forming a 5- or 7-membered ring together with the two vinyl carbon atoms substituted by $R_{12}$ and $R_{13}$ and the carbon atom substituted by Y; and Y represents =O or =N—$R_{14}$, in which $R_{14}$ represents a hydrogen atom, a hydroxyl group, an alkyl group, an acyl group, a hydroxylalkyl group, a sulfoalkyl group or a carboxylalkyl group;

wherein the hydrazine derivative of formula (I) is present in an amount of from $1\times10^{-5}$ to $2\times10^{-2}$ mol/mol-Ag;

wherein the compound of formula (II) is present in an amount of from $2\times10^{-5}$ to $1\times10^{-2}$ mol/mol-Ag;

wherein the compound of formula (III) is present in an amount of from $2\times10^{-5}$ to $1\times10^{-2}$ mol/mol-Ag;

wherein the compound of formula (IV) is present in an amount of from $2\times10^{-5}$ to $1\times10^{-2}$ mol/mol-Ag;

wherein the compound of formula (V) is present in an amount of from $2\times10^{-5}$ to $1\times10^{-2}$ mol/mol-Ag; and wherein the compound of formula (VI) is present in an amount of from $1.3\times10^{-8}$ to 1 mol/liter of developer.

2. The development processing method as claimed in claim 1, wherein the developer contains a salt of carbonic acid in an amount of 0.5 mol/l or more.

3. The development processing method as claimed in claim 1, wherein the auxiliary developing agent exhibiting a superadditive property is at least one of a 1-phenyl-3-pyrazolidone compound and a p-aminophenol compound.

4. The development processing method as claimed in claim 1, wherein said at least one compound (ii) is represented by formula (II).

5. The development processing method as claimed in claim 1, wherein said at least one compound (ii) is represented by formula (III).

6. The development processing method as claimed in claim 1, wherein said at least one compound (ii) is represented by formula (IV).

7. The development processing method as claimed in claim 1, wherein said at least one compound (ii) is represented by formula (V).

* * * * *